US006538641B2

(12) United States Patent
Mochizuki

(10) Patent No.: US 6,538,641 B2
(45) Date of Patent: Mar. 25, 2003

(54) KEY SWITCH DEVICE, KEYBOARD WITH THE KEY SWITCH DEVICE, AND ELECTRONIC APPARATUS WITH THE KEYBOARD

(75) Inventor: Isao Mochizuki, Kaizu-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 264 days.

(21) Appl. No.: 09/748,181

(22) Filed: Dec. 27, 2000

(65) Prior Publication Data

US 2001/0011999 A1 Aug. 9, 2001

(30) Foreign Application Priority Data

Jan. 21, 2000 (JP) ..... 2000-013183

(51) Int. Cl.[7] ..... G09G 5/00
(52) U.S. Cl. ..... 345/168; 345/169
(58) Field of Search ..... 345/156, 168, 345/169, 172

(56) References Cited

U.S. PATENT DOCUMENTS 5,635,928 A * 6/1997 Takagi et al. ..... 341/22
5,767,464 A * 6/1998 Dyer et al. ..... 200/5 A
5,812,116 A * 9/1998 Malhi ..... 345/168
5,833,050 A * 11/1998 Takagi et al. ..... 200/344
6,068,416 A * 5/2000 Kumamoto et al. ..... 400/491
6,087,604 A * 7/2000 Suga et al. ..... 200/344
6,087,966 A * 7/2000 Sato ..... 341/22
6,225,586 B1 * 5/2001 Watanabe et al. ..... 200/344
6,236,003 B1 * 5/2001 Suganami ..... 200/5 A
6,366,275 B1 * 4/2002 Lai ..... 345/168

* cited by examiner

*Primary Examiner*—Richard Hjerpe
*Assistant Examiner*—Duc Q Dinh
(74) *Attorney, Agent, or Firm*—Oliff & Berridge, PLC

(57) ABSTRACT

In a key switch device, the depressing load applied to a key top 11 when depressed is defined by a function (equation 26) expressed by: a distance L between the rotation point o of a support shaft 30 of a first link member 12 at a first engagement portion 17 in the key top 11 and the slide starting point s of a support shaft 26 of the first link member 12 at a third engagement portion 40; a distance L1 between the rotation point o and the acting point m at which the urging force of the coil spring 15 acts on the first link member 12; an angle θ4 between a line segment extending from the rotation point o to the slide starting point s and the direction along which the support shaft 26 of the first link member 12 at the third engagement portion 40 is allowed to slide; and various characteristic values of the coil spring 15. In relation to the depressing load curve P defined by the function, based on the difference in loads between the maximum point P1 in an upward projecting curve and the minimum point P2 from which the depressing load is increased after the switching operation, the key clicking function is performed.

37 Claims, 28 Drawing Sheets

KEY SWITCH DEVICE, KEYBOARD WITH THE KEY SWITCH DEVICE, AND ELECTRONIC APPARATUS WITH THE KEYBOARD

BACKGROUND OF THE INVENTION

1. Field of the Invention

The present invention relates to a key switch device in which the vertical movement of a key top is guided by a pair of link members, and which performs a key clicking function when the key top is depressed, thereby achieving an excellent key operability; and a keyboard provided with the key switch device; and an electronic apparatus provided with the keyboard. Specifically, the present invention relates to a key switch device capable of performing a clear key clicking function by employing a specified relationship between link members and urging devices thereof, and thereby achieving an excellent key operability, without using a rubber spring which has been conventionally mounted in a key switch device of this type as a device for performing a key clicking function; a keyboard; and an electronic apparatus.

2. Description of the Related Art

In recent years, as a reduction in size and thickness of notebook-size personal computers and various kinds of mobile computer devices has been promoted, the size and thickness of a key switch device in a keyboard associated with these devices have been also remarkably reduced. In this situation, in order to provide key switch devices having reduced size and thickness, there have been proposed various key switch devices in which the vertical (upward and downward) movement of the key top is guided by a pair of link members.

Among the key switch devices such as described above, there is a key switch device having the following structure. A first and second engagement portions are provided on the underside of the key top, and a holder member is provided below the key top. The key top is formed with a third engagement portion which corresponds to the first engagement portion, and a fourth engagement portion which corresponds to the second engagement portion. An upper end portion of one of the link members is rotatably engaged in the first engagement member, while the lower end portion thereof if slidably engaged in the third engagement portion. On the other hand, an upper end portion of the other link member is rotatably engaged in the second engagement portion, while the lower end portion thereof is slidably engaged in the fourth engagement portion.

There has been also known another key switch device having the following structure. A key top and a holder member are constituted to have the same structure as those of the key switch device described above. Two link members are in a crosslink structure in which they are pivotally supported so as to be rotatable with respect to each other. In addition, an upper end portion of one of the link members is rotatably engaged in the first engagement portion of the key top, while a lower end portion thereof is slidably engaged in the fourth engagement portion of the holder. On the other hand, an upper end portion of the other link member is slidably engaged in the second engagement portion, while a lower end portion thereof is rotatably engaged in the third engagement portion.

In both types of the key switch devices described above, the vertical movement of the key top is guided by a link structure of the two link members. In this manner, neither a key stem nor its guide structure is required, thereby attaining a reduction in size and thickness of the key switch devices. In addition, the key top can be vertically moved with its horizontal condition is maintained regardless the depression condition or situation of the key top.

In the key switch devices described above, a sufficient response from the key when the key top is depressed to the deepest position contributes to an increased key operability. In an attempt to achieve such a response from the key, the key switch devices are provided with a mechanism for performing a key clicking function.

In the key switch devices described above, a key clicking function is generally performed by use of a so-called rubber spring. The rubber spring is mounted below the key top or each of the link members. When the key top is depressed, the rubber spring is compressed by the underside of the key top or the link members. Based on the compression characteristic of the rubber spring obtained when the rubber spring is compressed, the key clicking function is effected.

However, when a rubber spring is used as a mechanism for performing the key clicking function as is the case of the key switch devices described above, the key clicking function is determined by the shape, thickness, and size of the rubber spring itself, and the shapes and sizes of the key top and each link member constituting the key switching mechanism. In the current state of the art, in order to perform a desired key clicking function to be given to a key switch device, trials for the rubber spring and the key switching mechanism are conducted in several times, and test and fault is repeated to determine the final rubber spring and the key switching mechanism. This method has a problem that it requires much cost and takes much too long time to obtain a key switch device having a desired key clicking function.

SUMMARY OF THE INVENTION

The present invention has been made in view of the above circumstances and has an object to overcome the above problems and to provide a key switch device capable of simulating the characteristic of the key clicking function by designing link members and urging devices thereof to have a specified relationship therebetween, without using a rubber spring which has been conventionally mounted in a key switch device of general type as a device for performing a key clicking function, thereby realizing a key switch device having an excellent key operability with a desired key clicking function in a short period at low cost by suppressing the number of trials for the key switching mechanism to the minimum; a keyboard provided with the key switch device; and an electronic apparatus provided with the keyboard.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a key switch device including: a key top provided at its underside with a first engagement portion and a second engagement portion; a third engagement portion corresponding to the first engagement portion, and a fourth engagement portion corresponding to the second engagement portion, both of which are arranged below the key top; a first link member provided with an upper end portion which is rotatably engaged in the first engagement portion and a lower end portion which is slidably engaged in the third engagement portion; a second link member provided with an upper end portion which is rotatably engaged in the second engagement portion and a lower end portion which is slidably engaged in the fourth engagement portion; an urging member for urging the first link member and the second link member in a direction to allow them to come close to each other; and a switching member for conducting a switching operation in association with vertical movement of the key top, the key switch device being designed to be symmetric with respect to a perpendicular line passing through a midpoint between the first engagement portion and the second engagement portion, wherein the upper end portion of the first link member is allowed to rotate about a predetermined rotation point in the first engagement portion, and the lower end portion of the first link member is allowed to slide outwardly from a predetermined slide starting point in the third engagement portion, an urging force of the urging member is exerted on the first link member at a predetermined acting point in the first link member, a depressing load applied to the key top when the key top is depressed is defined by a function expressed by: distance between the rotation point and the slide starting point; a distance between the rotation point and the acting point; an angle between a line segment extending from the rotation point to the slide starting point, and the direction along which the lower end portion of the first link member in the third engagement portion is allowed to slide; and various characteristic values of the urging member; and a curve of the depressing load defined by the function takes a shape of an upward projecting curve having a maximum point, and a key clicking function is performed based on a difference in loads between the maximum point and a point from which the depressing load starts to increase after the switching operation is conducted by the switching member.

According to another aspect of the present invention, there is provided a keyboard provided with at least one of the key switch device recited above.

According to another aspect of the present invention, there is provided an electronic apparatus including: a keyboard for inputting various data such as characters, symbols, and others, the keyboard being provided with a key switch device including: a key top provided at its underside with a first engagement portion and a second engagement portion; a third engagement portion corresponding to the first engagement portion, and a fourth engagement portion corresponding to the second engagement portion, both of which are arranged below the key top; a first link member provided with an upper end portion which is rotatably engaged in the first engagement portion and a lower end portion which is slidably engaged in the third engagement portion; a second link member provided with an upper end portion which is rotatably engaged in the second engagement portion and a lower end portion which is slidably engaged in the fourth engagement portion; an urging member for urging the first link member and the second link member in a direction to allow them to come close to each other; and a switching member for conducting a switching operation in association with vertical movement of the key top, the key switch device being designed to be symmetric with respect to a perpendicular line passing through a midpoint between the first engagement portion and the second engagement portion, wherein the upper end portion of the first link member is allowed to rotate about a predetermined rotation point in the first engagement portion, and the lower end portion of the first link member is allowed to slide outwardly from a predetermined slide starting point in the third engagement portion, an urging force of the urging member is exerted on the first link member at a predetermined acting point in the first link member, a depressing load applied to the key top when the key top is depressed is defined by a function expressed by: a distance between the rotation point and the slide starting point; a distance between the rotation point and the acting point; an angle between a line segment extending from the rotation point to the slide starting point, and the direction along which the lower end portion of the first link member in the third engagement portion is allowed to slide; and various characteristic values of the urging member; and a curve of the depressing load defined by the function takes a shape of an upward projecting curve having a maximum point, and a key clicking function is performed based on a difference in loads between the maximum point and a point from which the depressing load starts to increase after the switching operation is conducted by the switching member; display means for displaying the characters, symbols, and others; and control means for controlling the display means to display the characters, symbols, and others based on input data from the keyboard.

According to another aspect of the present invention, there is provided a key switch device including: a key top provided at its underside with a first engagement portion and a second engagement portion; a third engagement portion corresponding to the first engagement portion, and a fourth engagement portion corresponding to the second engagement portion, both of which are arranged below the key top; a first link member provided with an upper end portion which is rotatably engaged in the first engagement portion and a lower end portion which is slidably engaged in the third engagement portion; a second link member provided with an upper end portion which is rotatably engaged in the second engagement portion and a lower end portion which is slidably engaged in the fourth engagement portion; an urging member for urging the first link member and the second link member in a direction away from each other; and a switching member for conducting a switching operation in association with vertical movement of the key top, the key switch device being designed to be symmetric with respect to a perpendicular line passing through a midpoint between the first engagement portion and the second engagement portion, wherein the upper end portion of the first link member is allowed to rotate about a predetermined rotation point in the first engagement portion, and the lower end portion of the first link member is allowed to slide outwardly from a predetermined slide starting point in the third engagement portion, an urging force of the urging member is exerted on the first link member at a predetermined acting point in the first link member, a depressing load applied to the key top when the key top is depressed is defined by a function expressed by: a distance between the rotation point and the slide starting point; a distance between the rotation point and the acting point; an angle between a line segment extending from the rotation point to the slide starting point, and the direction along which the lower end portion of the first link member in the third engagement portion is allowed to slide; and various characteristic values of the urging member; and a curve of the depressing load defined by the function takes a shape of an upward projecting curve having a maximum point, and a key clicking function is performed based on a difference in loads between the maximum point and a point from which the depressing load starts to increase after the switching operation is conducted by the switching member.

According to another aspect of the present invention, there is provided a keyboard provided with at least one of the above key switch device.

According to another aspect of the present invention, there is provided an electronic apparatus including: a keyboard for inputting various data such as characters, symbols, and others, the keyboard being provided with a key switch device including: a key top provided at its underside with a first engagement portion and a second engagement portion; a third engagement portion corresponding to the first engagement portion, and a fourth engagement portion corresponding to the second engagement portion, both of which are arranged below the key top; a first link member provided with an upper end portion which is rotatably engaged in the first engagement portion and a lower end portion which is slidably engaged in the third engagement portion; a second link member provided with an upper end portion which is rotatably engaged in the second engagement portion and a lower end portion which is slidably engaged in the fourth engagement portion; an urging member for urging the first link member and the second link member in a direction away from each other; and a switching member for conducting a switching operation in association with vertical movement of the key top, the key switch device being designed to be symmetric with respect to a perpendicular line passing through a midpoint between the first engagement portion and the second engagement portion, wherein the upper end portion of the first link member is allowed to rotate about a predetermined rotation point in the first engagement portion, and the lower end portion of the first link member is allowed to slide outwardly from a predetermined slide starting point in the third engagement portion, an urging force of the urging member is exerted on the first link member at a predetermined acting point in the first link member, a depressing load applied to the key top when the key top is depressed is defined by a function expressed by: a distance between the rotation point and the slide starting point; a distance between the rotation point and the acting point; an angle between a line segment extending from the rotation point to the slide starting point, and the direction along which the lower end portion of the first link member in the third engagement portion is allowed to slide; and various characteristic values of the urging member; and a curve of the depressing load defined by the function takes a shape of an upward projecting curve having a maximum point, and a key clicking function is performed based on a difference in loads between the maximum point and a point from which the depressing load starts to increase after the switching operation is conducted by the switching member; display means for displaying the characters, symbols, and others; and control means for controlling the display means to display the characters, symbols, and others based on input data from the keyboard.

According to another aspect of the present invention, there is provided a key switch device including: a key top provided at its underside with a first engagement portion and a second engagement portion; a third engagement portion corresponding to the first engagement portion, and a fourth engagement portion corresponding to the second engagement portion, both of which are arranged below the key top; a guide member including: a first link member provided with an upper end portion which is rotatably engaged in the second engagement portion and a lower end portion which is slidably engaged in the third engagement portion, and a second link member provided with an upper end portion which is rotatably engaged in the first engagement portion and a lower end portion which is slidably engaged in the fourth engagement portion, the first and second link members being pivotally supported to be rotatable with respect to each other; an urging member for urging the first link member and the second link member in a direction to allow them to pivotally rotate about a shaft supporting point; and a switching member for conducting a switching operation in association with vertical movement of the key top, the key switch device being designed to be symmetric with respect to a perpendicular line passing through a midpoint between the first engagement portion and the second engagement portion, wherein the upper end portion of the first link member is allowed to rotate about a predetermined rotation point in the second engagement portion, and the lower end portion of the first link member is allowed to slide outwardly from a predetermined slide starting point in the third engagement portion, an urging force of the urging member is exerted on the first link member at a predetermined acting point in the first link member, a depressing load applied to the key top when the key top is depressed is defined by a function expressed by: a distance between the rotation point and the slide starting point; a distance between the rotation point and the acting point; a distance between the rotation point and the shaft supporting point; an angle between a line segment extending from the rotation point to the slide starting point, and the direction along which the lower end portion of the first link member in the third engagement portion is allowed to slide; and various characteristic values of the urging member; and a curve of the depressing load defined by the function takes a shape of an upward projecting curve having a maximum point, and a key clicking function is performed based on a difference in loads between the maximum point and a point from which the depressing load starts to increase after the switching operation is conducted by the switching member.

According to another aspect of the present invention, there is provided a keyboard provided with at least one of the above key switch device.

According to another aspect of the present invention, there is provided an electronic apparatus including: a keyboard for inputting various data such as characters, symbols, and others, the keyboard being provided with a key switch device including: a key top provided at its underside with a first engagement portion and a second engagement portion; a third engagement portion corresponding to the first engagement portion, and a fourth engagement portion corresponding to the second engagement portion, both of which are arranged below the key top; a guide member including: a first link member provided with an upper end portion which is rotatably engaged in the second engagement portion and a lower end portion which is slidably engaged in the third engagement portion, and a second link member provided with an upper end portion which is rotatably engaged in the first engagement portion and a lower end portion which is slidably engaged in the fourth engagement portion, the first and second link members being pivotally supported to be rotatable with respect to each other; an urging member for urging the first link member and the second link member in a direction to allow them to pivotally rotate about a shaft supporting point; and a switching member for conducting a switching operation in association with vertical movement of the key top, the key switch device being designed to be symmetric with respect to a perpendicular line passing through a midpoint between the first engagement portion and the second engagement portion, wherein the upper end portion of the first link member is allowed to rotate about a predetermined rotation point in the second engagement portion, and the lower end portion of the first link member is allowed to slide outwardly from a predetermined slide starting point in the third engagement portion, an urging force of the urging member is exerted on the first link member at a predetermined acting point in the first link member, a depressing load applied to the key top when the key top is depressed is defined by a function expressed by: a distance between the rotation point and the slide starting point; a distance between the rotation point and the acting point; a distance between the rotation point and the shaft supporting point; an angle between a line segment extending from the rotation point to the slide starting point, and the direction along which the lower end portion of the first link member in the third engagement portion is allowed to slide; and various characteristic values of the urging member; and a curve of the depressing load defined by the function takes a shape of an upward projecting curve having a maximum point, and a key clicking function is performed based on a difference in loads between the maximum point and a point from which the depressing load starts to increase after the switching operation is conducted by the switching member; display means for displaying the characters, symbols, and others; and control means for controlling the display means to display the characters, symbols, and others based on input data from the keyboard.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of preferred embodiments of a key switch device, a keyboard provided with the key switch device, and an electronic apparatus provided with the keyboard embodying the present invention will now be given referring to the accompanying drawings.

It is to be noted that the following explanations are made on four embodiments and respective models including a principle to produce a clicking function.

Figure 1A:
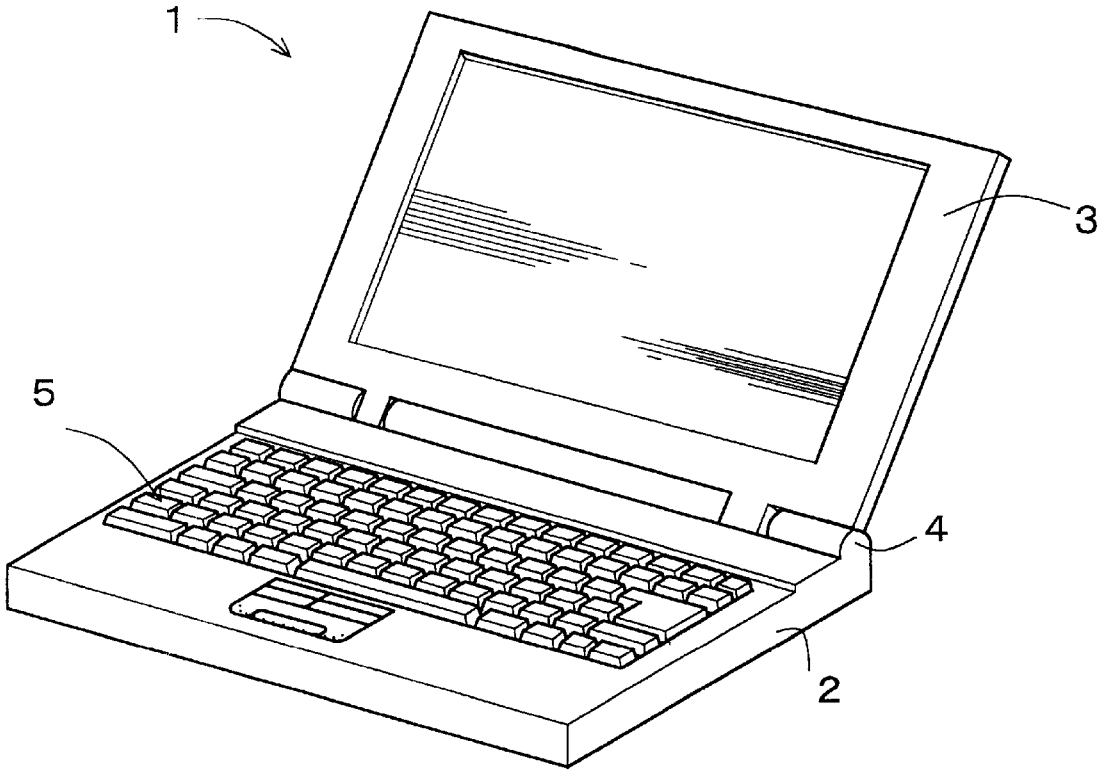
FIG. 1A is a perspective view of a notebook-size personal computer in embodiments according to the present invention.

At first, a notebook-size personal computer which is one of the electronic equipment in a first through fourth embodiments according to the present invention. FIG. 1A is a perspective view of the notebook-size personal computer and FIG. 1B is a block diagram of an electric structure of the computer.

In FIG. 1A, a notebook-size personal computer 1 is basically constructed of a main unit 2 including a CPU for conducting various processes and a display 3 mounted on the main unit 2. This display 3 is rotatably supported by a connecting portion 4 of the main unit 2 so that the display 3 opens and closes with respect to the main unit 2. The main unit 2 is provided with a keyboard 5 with a plurality of key switch devices arranged.

Figure 1B:
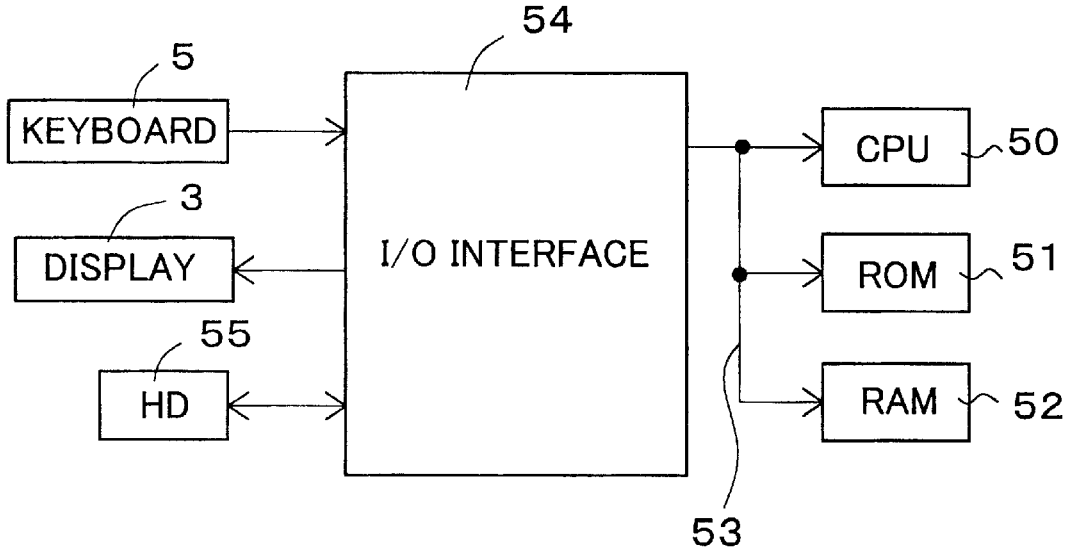
FIG. 1B is a block diagram of an electric structure of the notebook-size personal computer in the embodiments.

In FIG. 1B, a CPU 50 is connected through a bus 53 to a ROM 51 which stores programs for controlling each section of the personal computer and to a RAM 52 for storing various data. The CPU 50 is also connected to an input/output (I/O) interface 54 through the bus 54. This I/O interface 54 is connected to the display 3, the keyboard 5, and a hard disc device 55 which stores programs for word processing, tabular calculations, etc. The CPU 50 reads the programs for word processing, tabular calculations, etc. from the hard disc device 55 to carry out in response to input data from the keyboard 5, and causes the display 3 to display thereon characters and symbols.

Figure 2:
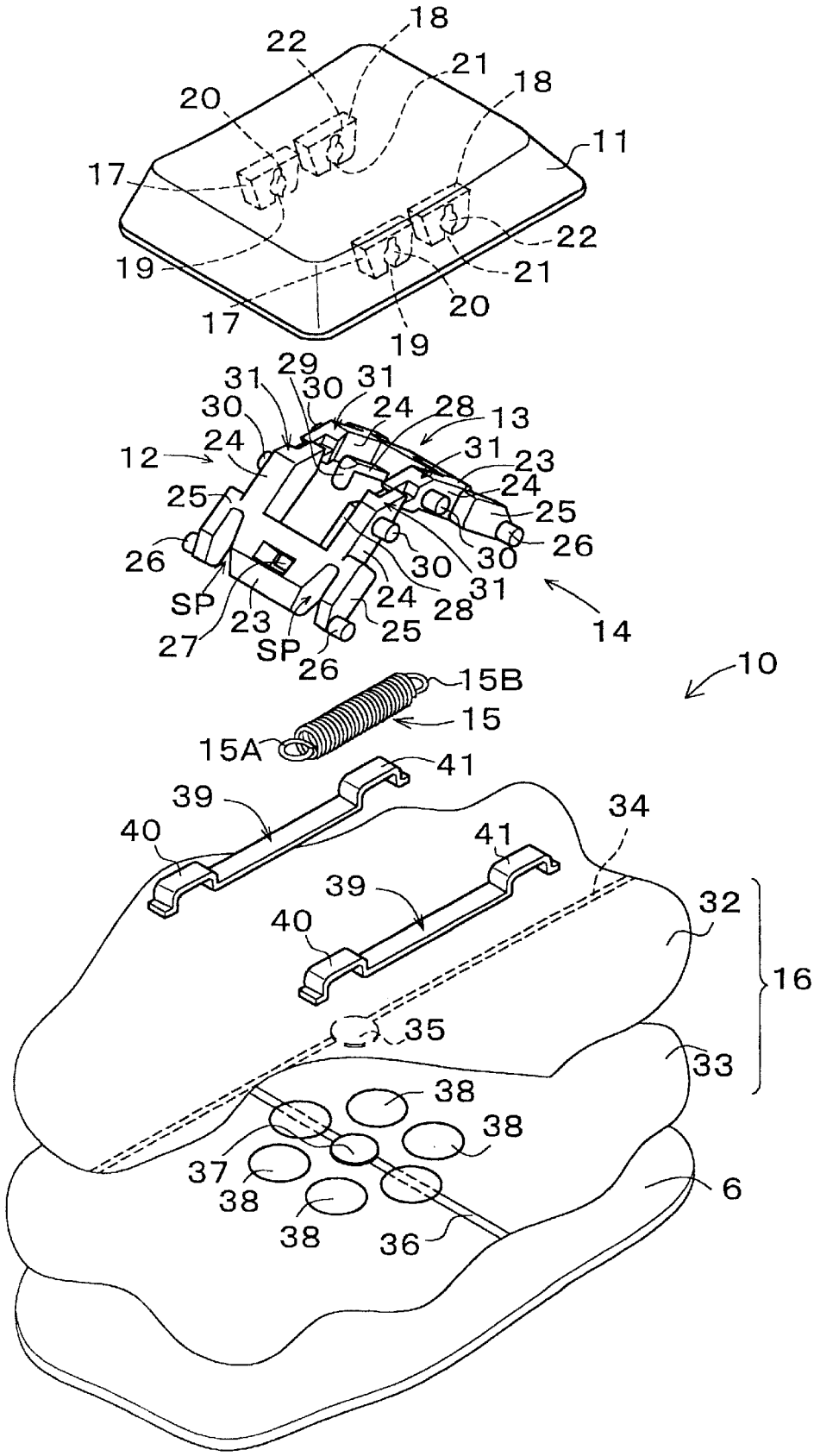
FIG. 2 is an exploded perspective view of a key switch device in the embodiments.
Figure 3:
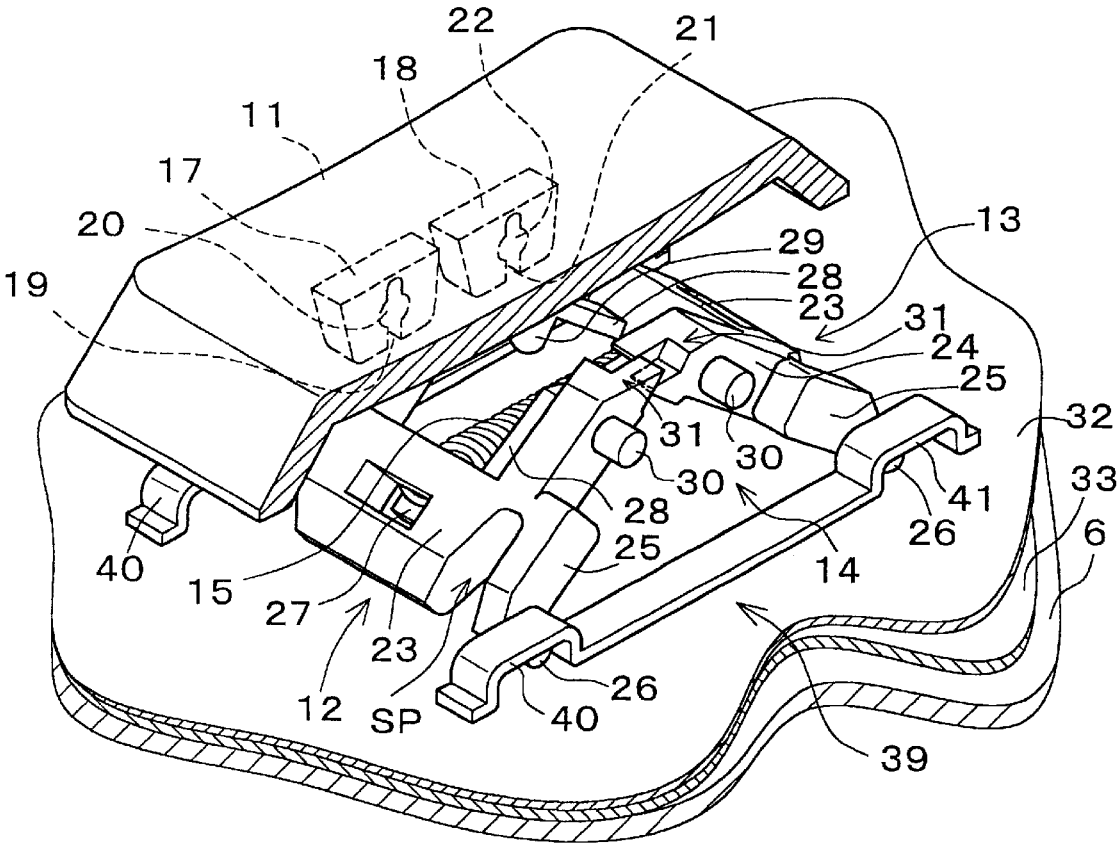
FIG. 3 is a perspective view of the key switch device of which a part is omitted.
Figure 4:
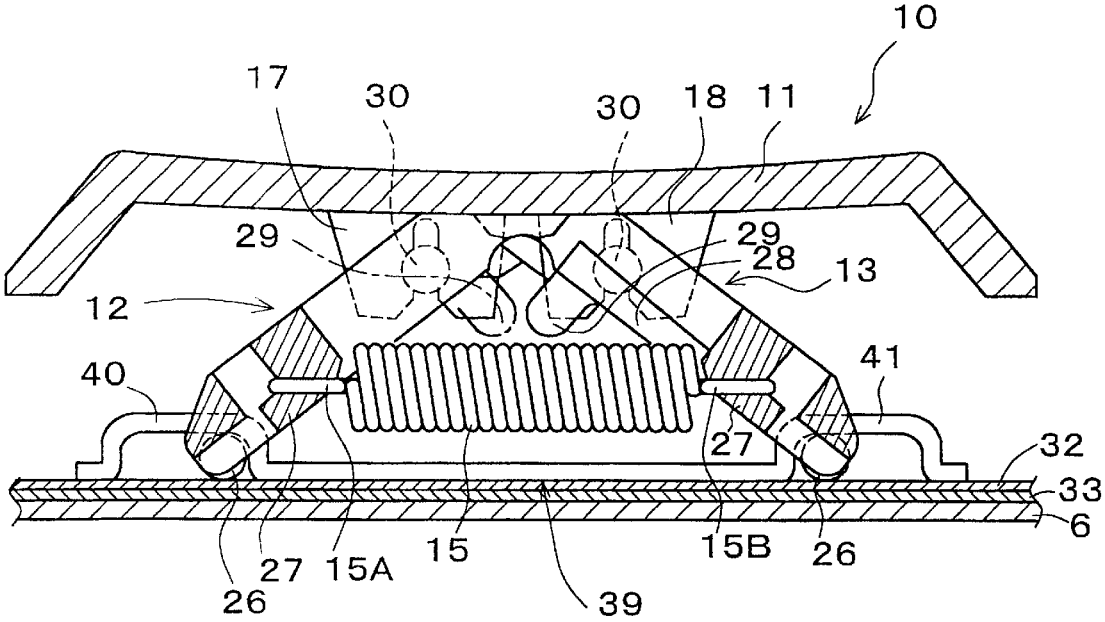
FIG. 4 is a sectional view of the key switch device.

A key switch device provided in the keyboard 5 of the notebook-size personal computer 1 is explained below with reference to FIGS. 2–4. FIG. 2 is a perspective exploded view of the key switch device in the first embodiment. FIG. 3 is a perspective view of the key switch device of which a part is omitted. FIG. 4 is a sectional view of the key switch device.

As shown in FIGS. 2–4, a key switch device 10 is basically constructed of a key top 11, a guide member 14 made up of a pair of a first and second link members 12 and 13 for supporting the key top 11 to guide vertical movement thereof, a coil spring 15 disposed between the first and second link members 12 and 13, thereby urging them in a direction to move respective lower ends inwards, or closer to each other (a closing direction), and a membrane switch sheet 16 disposed under the guide member 14. It is to be noted that a support plate 6 is disposed under the membrane switch sheet 16. The key switch device 10 is entirely supported on the support plate 6.

The key top 11 is formed of a resin material such as an ABS resin, and a character, etc. is printed on the upper surface of the key top 11. On the underside of the key top 11, there are provided a pair of first engagement portions 17 and 17 (left ones in FIGS. 2–4) arranged along a shorter side of the key top 11. In parallel to the first engagement portions 17 and 17, a pair of second engagement portions 18 and 18 (right ones in FIGS. 2–4) is arranged. The first engagement portion 17 is formed with a vertical notch 19 opening at a lower end thereof end and a circular bearing hole 20 formed continuously to the notch 19. Like the first engagement portion 17, the second engagement portion 18 is formed with a vertical notch 21 opening at a lower end thereof and a circular bearing hole 22 formed continuously to the notch 21. An upper support shaft 30 of the first link member 12 mentioned later is inserted in the bearing hole 20 of the first engagement portion 17 through the vertical notch 19 and there rotatably supported. An upper support shaft 30 of the second link member 13 mentioned later is inserted in the bearing hole 22 of the second engagement portion 18 through the notch 21 and there rotatably supported. It is to be noted that the first and second engagement portions 17 and 18 may be integrally formed with the key top 11 or formed independently and fixed on the underside of the key top 11.

The guide member 14 is constructed of the first and second link members 12 and 13 to support the key top 11 for guiding vertical movement of the same. The first link member 12 is formed of a resin such as polyacetal in one body configuration basically having a plate-like base portion 23 and a pair of arms 24 extending from both sides of the base portion 23, thus having a substantial U-shaped configuration as viewed in plan. At joint portions between the arms 24 and both sides of the base portion 23, a pair of shaft support portions 25 are formed extending and bending downwards. A lower support shaft 26 is provided protruding outwards on each lower end of the shaft support portions 25. The support shafts 26 are each slidably received in a slide groove of a third engagement portion 40 of an engagement member 39 bonded to the membrane switch sheet 16, mentioned later.

A space SP is produced between each side surface of the base portion 23 and the inner side surface of each of the shaft support portions 25. This space SP permits the shaft support portion 25 to elastically deform with respect to the joint portion serving as a base point. The elastic deformation of the shaft support portion 25 is utilized when the support shaft 26 is inserted in the slide groove of the third engagement portion 40 of the engagement member 39.

A spring engagement portion 27 is provided protruding downward from the underside of the base portion 23 at about a center in the length direction and width direction of the base portion 23. This spring engagement portion 27 has a hooked portion for seating thereon an end 15A of the coil spring 15. Furthermore, an elastic piece 28 is provided extending inward from the inner side surface of the base portion 23 between the arms 24, in a position off the center of the base portion 23 in its length direction (a position off to the right side in FIGS. 2 and 3), and in parallel to the arms 24. This elastic piece 28 is provided with a switch pressing protrusion 29 in the tip end (see FIG. 4).

An upper support shaft 30 is formed protruding outwards in each of the arms 24 of the first link member 12. The support shaft 30 is rotatably received in the bearing hole 20 of the first engagement portion 17 provided on the underside of the key top 11. The arm 24 is provided with a gear portion 31 at its end. The structure of this gear portion 31 will be mentioned later.

The second link member 13 has the same structure as that of the first link member 12. The link member constructed as above can be used in common as the second link member 13. As shown in FIGS. 2–4, therefore, there generates no assembly orientation of the first and second link members 12 and 13 when assembled to make up the guide member 14. As a result, the guide member 14 can be easily assembled without needing special care to the assembling orientation.

As constructed in common with the first link member 12, the second link member 13 is given the same numbers with respect to structural elements as those of the first link member 12. The detailed explanation thereof is referred to the above description on the first link member 12 and omitted in the present embodiment.

The upper support shafts 30 of the second link member 13 are each rotatably received in the bearing hole 22 of the second engagement portion 18. The lower support shafts 26 of the second link member 13 are each slidably engaged in the slide groove of a fourth engagement portion 41 of the engagement member 39 bonded to the membrane switch sheet 16.

A spring engagement portion 27 provided on the underside of the base portion 23 in the second link member 13 is engaged with the other end 15B of the coil spring 15. In the second link member 13, an elastic piece 28 is provided protruding inwards from the inside surface of the base portion 23 between the arms 24, in parallel thereto, and in a position off to the left as shown in FIGS. 2 and 3. Accordingly, a pressing protrusion 29 of the elastic piece 28 of the second link member 13 is arranged at a predetermined distance with respect to the pressing protrusion 29 of the first link member 12. Either of the pressing protrusions 29 of the first and second link members 12 and 13 may be used to press from above a movable switch electrode 35 of the membrane switch sheet 16. The gear portions 31 of the second link member 13 are engaged with the corresponding gear portions 31 of the first link member 12 so that the link member 12 and 13 are operated synchronously. The detailed structure thereof will be mentioned later.

The coil spring 15 is disposed between the first and second link members 12 and 13 with the end 15A seated over the spring engagement portion 27 of the first link member 12 and the other end 15B seated over the spring engagement portion 27 of the second link member 13. This coil spring 15 urges the first and second link members 12 and 13 in the closing direction so that respective lower ends are moved closer to each other.

The membrane switch sheet 16 is basically constructed of the upper switching sheet 32 and a lower switching sheet 33. The upper switching sheet 32 is provided with a circuit pattern 34 and a movable switch electrode 35 connected to the circuit pattern 34 at the underside. The lower switching sheet 33 is provided with a circuit pattern 36 disposed in matrix or perpendicular relation with respect to the circuit pattern 34 and a fixed switch electrode 37 on the upper face. The fixed switch electrode 37 is connected to the circuit pattern 36 and arranged to face the movable switch electrode 35. On the lower switching sheet 33, there are arranged a plurality of spacer pads 38 around the fixed switch electrode 37. These spacer pads 38 are formed by printing adhesive or the like with a predetermined film thickness. They serve to separate the movable switch electrode 35 and the fixed switch electrode 37.

On the upper face of the upper switching sheet 32, a pair of engagement members 39 each having a predetermined length are bonded with adhesive or the like in parallel arrangement at a predetermined interval therebetween. The engagement member 39 is formed of a metal, resin, or the like which may be selected from various kinds. At one end of the engagement member 39 (a left end in FIGS. 2–4) is formed a third engagement portion 40 of a long groove, while at the other end of the same (a right end in FIGS. 2–4) is formed a fourth engagement portion 41 with a longitudinal groove. The third engagement portion 40 is used for slidably receiving the support shaft 26 of the first link member 12. The fourth engagement portion 41 is used for slidably receiving the support shaft 26 of the second link member 13.

Figure 6:
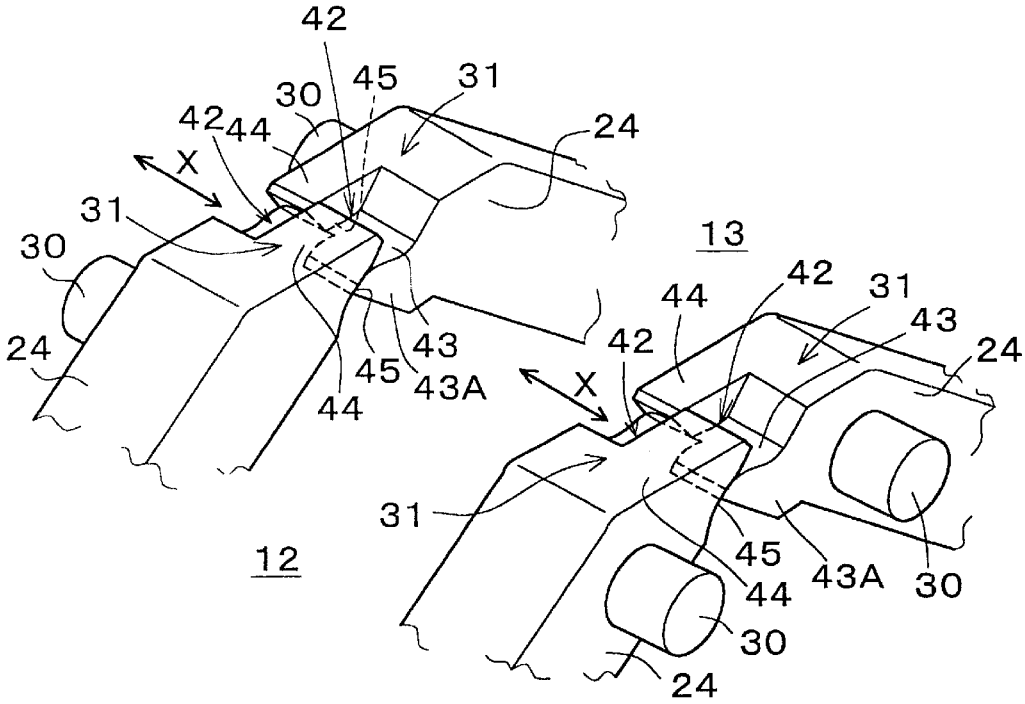
FIG. 6 is a perspective partial enlarged view of gear portions provided arms of a first and second link members.

Next explanation is made on the structure of each of the gear portions 31 formed in the tip ends of the arms 24 in the first and second link members 12 and 13. FIG. 6 is a perspective partial view of the gear portions 31 in the first and second link members 12 and 13.

In FIG. 6, the gear portion 31 formed in the tip end of the arm 24 in each of the first and second link members 12 and 13 includes a shoulder portion 42 at about a center in a direction X corresponding to the width of the arm 24. This shoulder portion 42 provides a lower protrusion 43A and an upper protrusion 44 in the tip end of the arm 24. The upper surface of the lower protrusion 43A constitutes a lower tooth portion 43 having a predetermined curved surface. The lower surface of the upper protrusion 44 constitutes an upper tooth portion 45 formed with a curved surface which is allowed to make close contact with the curved surface of the lower tooth portion 43.

The lower tooth portion 43 and the upper tooth portion 45 have a positional relationship shown in FIG. 6 such that they are arranged in contiguous relation in the width direction X of the arm 24 as viewed in plan and in upper-and-lower relation as viewed in side. The first and second link members 12 and 13 have the same structure as mentioned above. In the gear portion 31 of the arm 24 of the first link member 12 disposed left in FIG. 6, therefore, the lower tooth portion 43 formed on the upper surface of the lower protrusion 43A is on the left, while the upper tooth portion 45 formed on the underside of the protrusion 44 is on the right.

The second link member 13 disposed right in FIG. 6 is in an opposite positional relation to the first link member 12. In the gear portion 31 of the arm 24 of the second link member 13, therefore, the upper tooth portion 45 formed on the underside of the protrusion 44 is on the left in FIG. 6, while the lower tooth portion 43 formed on the upper surface of the lower protruding 43A is on the right. Thus, the lower tooth portion 43 of the first link member 12 and the upper tooth portion 45 of the second link member 13 are brought in contact with each other. The upper tooth portion 45 of the first link member 12 and the lower tooth portion 43 of the second link member 13 are in contact with each other.

In the guide member 14 constructed of a combination of the first and second link members 12 and 13 as mentioned above, the upper and lower tooth portions 45 and 43 in the gear portion 31 of the first link member 12 are arranged in contiguous relation in the width direction X of the first link member 12 and in upper-and-lower relation in the thickness direction of the link member 12. Similarly, the upper and lower tooth portions 45 and 43 in the gear portion 31 of the second link member 13 are arranged contiguously in the width direction X of the second link member 13 and in upper-and-lower relation in the thickness direction of the second link member 13. As above, the upper and lower teeth portions 45 and 43 in each of the link members 12 and 13 are not provided in aligned and spaced relation in the thickness direction of the link members 12 and 13. Accordingly, if only positioning the gear portions 31 of the first and second link members 12 and 13 so that the gear portions 31 come into contact with each other, the link members 12 and 13 can be assembled simply in proper engagement relation between the upper tooth portion 45 of the first link member 12 and the lower tooth portion 43 of the second link member 13 and also between the lower tooth portion 43 of the first link member 12 and the upper tooth portion 45 of the second link member 12. This makes it possible to extremely enhance assembling efficiency of the key switch device 10.

As mentioned above, the upper tooth portion 45 and the lower tooth portion 43 of the first link member 12 are disposed in a laterally deviated relation from each other, or in contiguous relation in the width direction X of the first link member 12. Similarly, the upper and lower tooth portions 45 and 43 of the second link member 13 are disposed in laterally deviated relation from each other, or in contiguous relation in the width direction X of the second link member 13. Even if a reduction in thickness of the key switch device 10 is developed, therefore, the upper and lower tooth portions 45 and 43 have not to be reduced in thickness or size. Consequently, the key switch device 10 usable for long-term in a stable condition with high durability of each tooth portion 43, 45 can be achieved.

Furthermore, the upper and lower tooth portions 45 and 43 of the first link member 12 have the upper-and-lower relation, but deviated contiguously in the width direction X of the first link member 12. The second link member 13 is as with the first link member 12. The first and second link members 12 and 13 can be produced with use of only a single die including an upper and lower part which are opened up and down to take out a finished product, without using a slide die. This makes it possible to produce a plurality of the first and second link members 12 and 13 through one die, thereby enhancing production efficiency of the link members 12 and 13.

Figure 5:
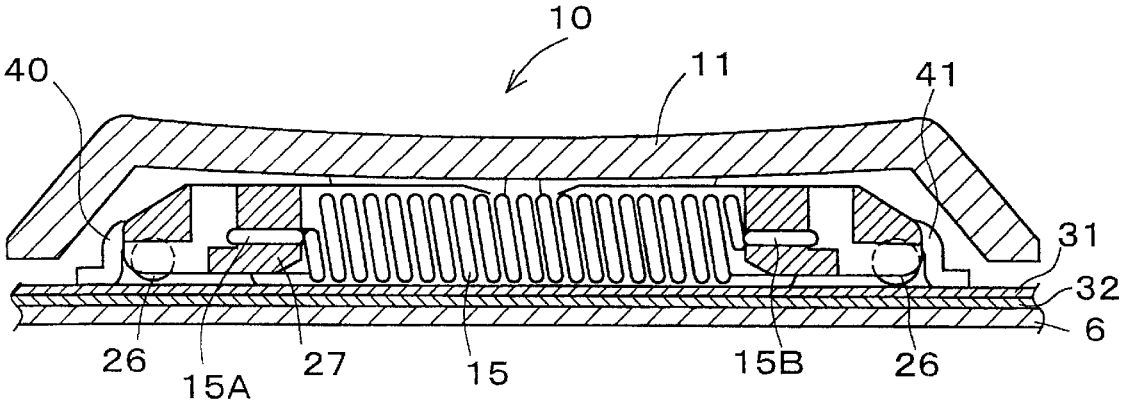
FIG. 5 is a sectional view of the key switch device in a state where a key top has been completely depressed.

Operation of the key switch device 10 constructed as above will be described below with reference to FIGS. 2–6. FIG. 5 is a sectional view of the key switch device in a state where the key top 11 has been depressed completely.

As shown in FIGS. 3 and 4, the coil spring 15 is disposed between the spring engagement portion 27 of the base portion 23 of the first link member 12 and the spring engagement portion 27 of the base portion 23 of the second link member 13. While the key top 11 is not depressed, this coil spring 15 urges the first and second link members 12 and 13 so that respective lower ends are moved closer to each other (in the closing direction) about the support shafts 30 rotatably supported in the baring holes 20 and 22 of the first and second engagement portions 17 and 18.

At this time, each of the support shafts 26 of the first and second link members 12 and 13 is in contact with the inner wall surface of the slide groove of the third engagement portion 40 or that of the slide groove of the fourth engagement portion 41 in the engagement member 39 fixed on the upper switching sheet 32 of the membrane switch sheet 16. The key top 11 is thus stably held in the non-depression position as shown in FIG. 4.

In this non-depression state, the key switch device 10 is configured in symmetry with respect to a perpendicular line passing a midpoint between the center of the bearing hole 20 of the first engagement portion 17 and the center of the bearing hole 22 of the second engagement portion 18, as shown in FIG. 4.

When the key top 11 is depressed from the state shown in FIG. 4 against the urging force of the coil spring 15, each of the support shafts 30 of the first link member 12 is rotated clockwise in the bearing hole 20 of the first engagement portion 17 and each of the support shafts 30 of the second link member 13 is rotated counterclockwise in the bearing hole 22 of the second engagement portion 18. Simultaneously, each of the support shafts 26 of the first link member 12 is slid leftwards in the slide groove of the third engagement portion 40, and each of the support shafts 26 of the second link member 13 is slid rightwards in the slide groove of the fourth engagement portion 41.

The lower tooth portion 43 of the first link member 12 and the upper tooth portion 45 of the second link member 13 are lowered while their contact relation is maintained. Similarly, the upper tooth portion 45 of the first link member 12 and the lower tooth portion 43 of the second link member 13 are lowered as held in contact with each other. In this manner, the first and second link members 12 and 13 are operated in complete synchronization with each other based on the cooperative action of the upper and lower tooth portions 43 and 45.

When the key top 11 is depressed at a predetermined amount, the pressing protrusion 29 of the elastic piece 28 of the first link member 12 or the second link member 13 pushes from above the movable switch electrode 35 provided on the underside of the upper switching sheet 32. When the key top 11 is further depressed, the pressing protrusion 29 clicks and brings the movable electrode 35 into contact with the fixed electrode 37 provided on the lower switching sheet 33, thereby causing the electrodes 35 and 37 to perform a specified switching action. The coil sprint 15 is in a further stretched state as shown in FIG. 5.

When the depression of the key top 11 is released after completion of the switching action as above, the reverse operation to the above is conducted by the urging force of the coil spring 15, lifting the key top 11 to return to the non-depression position (original position) shown in FIG. 4.

[Modeling according to first embodiment]

Figure 7:
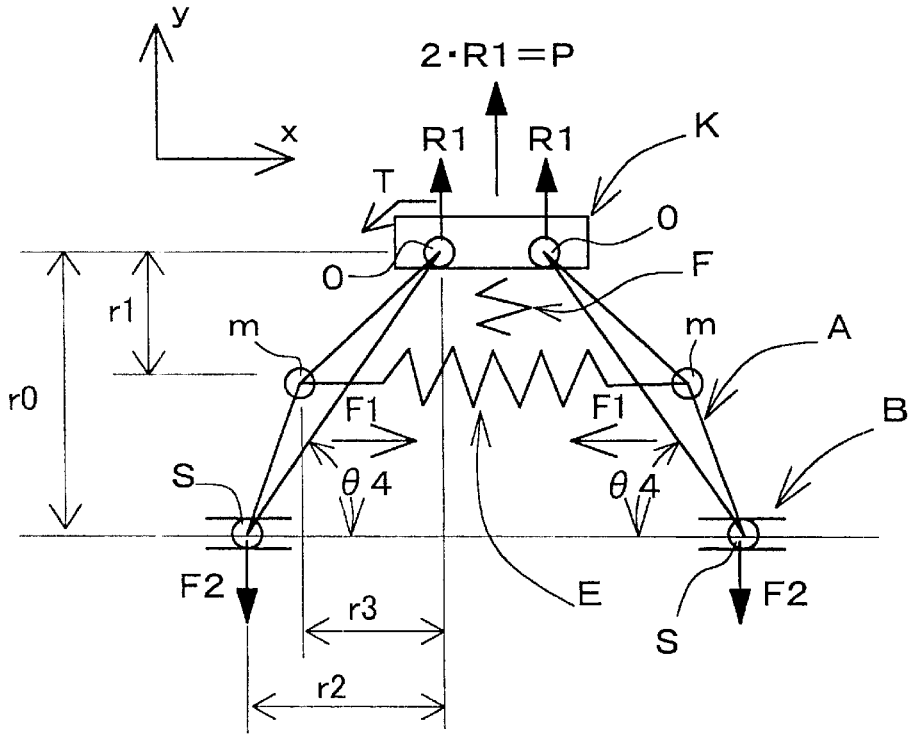
FIG. 7 is an explanatory diagram of a model 1 for schematically showing a modeled key switch device.

Next, the key switch device 10 in the first embodiment according to the present invention is modeled into a model 1, and the principle of performing a key clicking function in the model 1 will be described with reference to FIGS. 7 to 11. FIG. 7 is an explanatory view of the model 1 for schematically showing a modeled key switch device 10.

In FIG. 7, rigid bodies A represent the first link member 12 and the second link member 13 respectively, a rigid body K represents the key top 11, and rigid bodies B represent the third and fourth engagement portions 40 and 41 of the engagement member 39 respectively. Alphabetical marks o represent a rotation center of the support shaft 30 of the first link member 12 received in the bearing hole 20 of the first engagement portion 17 in the key top 11, and a rotation center of the support shaft 30 of the second link member 13 received in the bearing hole 22 of the second engagement member 18 in the key top 11, respectively.

Alphabetical marks s represent a point from which the support shaft 26 of the first link member 12 starts to slide outwardly in the third engagement portion 40, and a point from which the support shaft 26 of the second link member 13 starts to slide outwardly in the fourth engagement portion 41, respectively.

Alphabetical marks m represent an acting point of action of the inward urging force of the coil spring 15 at the spring engagement portion 27 of the first link member 12, and a point of the inward urging force of the coil spring 15 at the spring engagement portion 27 of the second link member 13, respectively.

Marks θ4 represent an angle between the first link member 12 in an inclined state and a sliding direction of the support shaft 26 thereof with respect to the slide starting point s, and an angle between the second link member 13 in an inclined state and a sliding direction of the support shaft 26 thereof with respect to the slide starting point s.

In FIG. 7, the model 1 includes: two rigid bodies A each having three points, that is, the joint point (i.e. rotation points) o, the urging acting point m, and the slide starting point s; a rigid body K which rotatably supports the rigid bodies A at the joint points o; and rigid bodies B each of which allows each rigid body A to be slidable from the point s in a direction x (i.e. in a horizontal direction). The rigid body K can move in a direction y (i.e. in a vertical direction).

Figure 11:
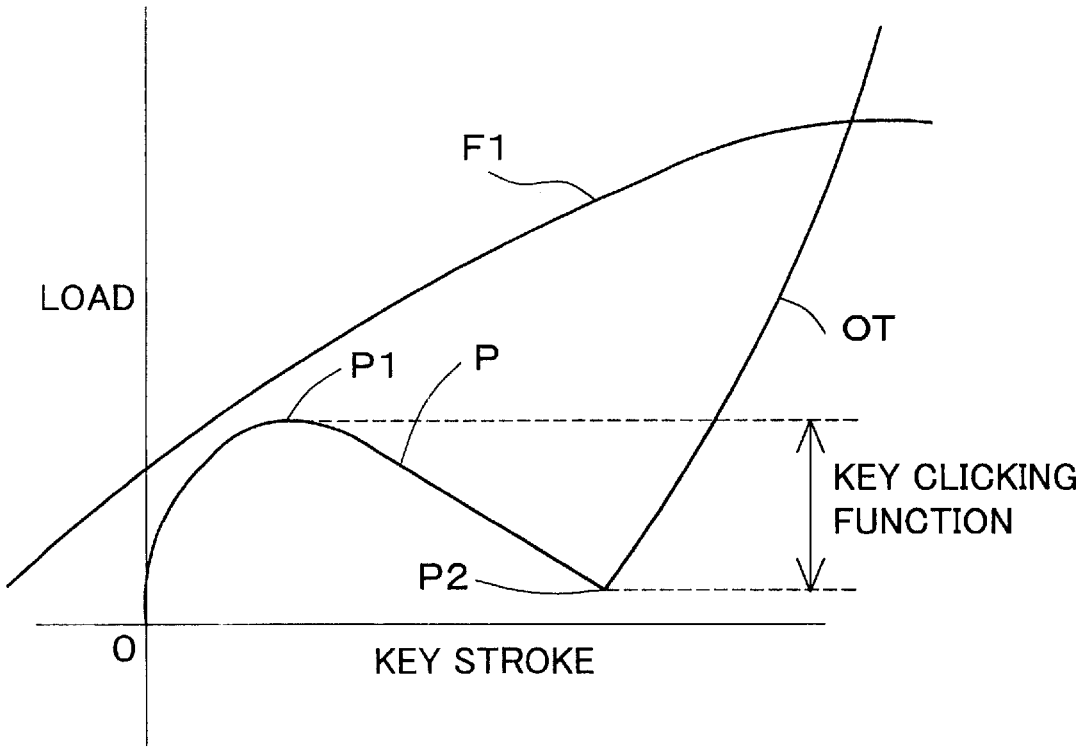
FIG. 11 is a graph of a curve of a depressing load.

As shown in FIG. 7, when two rigid bodies A are coupled to each other via an elastic body E (corresponding to the coil spring 15), a force F1 is generated, and accordingly, a force P in the direction y is generated in the rigid body K. When the rigid body K is deformed in a direction −y (i.e. in a downward direction), the force P is expressed by a function of angle between the joint points o, m, and s, and a curve has a maximum point in the shape of projection as shown in FIG. 11. Then, an elastic body F (corresponding to the elastic piece 28) acts from a position where the switching operation is conducted, and the curve continues to a curve OT.

Figure 8:
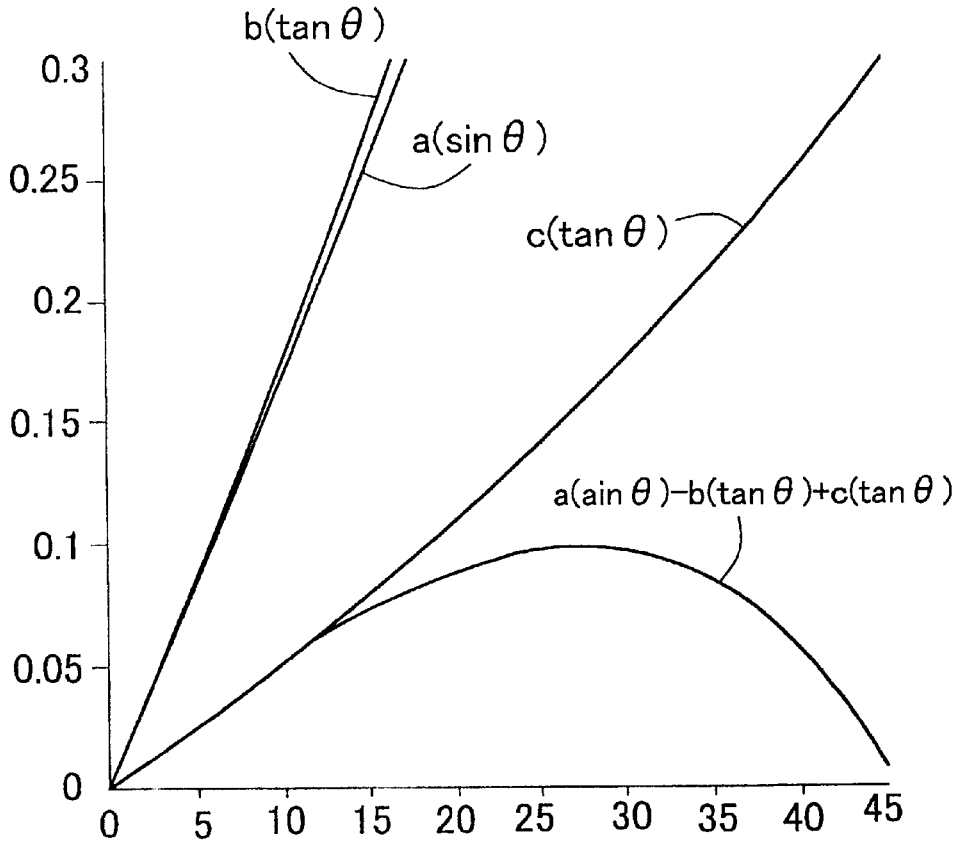
FIG. 8 is a graph showing a curve of a depressing load based on an equation 6.

Hereinafter, the principle of operation of the model 1 will be described with reference to FIGS. 7 and 8. In FIG. 7, when the rigid body K is deformed in the direction y, a rotation torque T is generated at the joint point o. The torque T is expressed by the following equation 1:

$$T=r1\cdot F1=r2\cdot F2 \quad \text{(Eq. 1)}$$

A force F2 exerted downwards at the joint point s is expressed by the following equation 2:

$$F2=(r1/r2)\cdot F1 \quad \text{(Eq. 2)}$$

In this case, a reaction force R1 in the direction y is expressed by the following equation 3:

$$R1=F2 \quad \text{(Eq. 3)}$$

Here, since the force F1 is a tension by the elastic body E, the force F1 is equally exerted on the two rigid bodies A arranged left and right with respect to the elastic body E. As a result, a force F2 and a reaction force R1 are generated in each of the rigid bodies A equally, that is, the force F2 and the reaction force R1 are expressed by the following equation 4:

$$2\cdot F2=2\cdot R1=P \quad \text{(Eq. 4)}$$

The relationship between the forces F1, F2, and the reaction force R1 is expressed by the following equation 5:

$$P=2\cdot(r1/r2)F1 \quad \text{(Eq. 5)}$$

Here, in the case of the joint point m=the joint point s, the relationships of r1=r0 and r3=r2 are established. When these relationships are rearranged and converted into a formula of an angle, the force P becomes a function of θ4 as shown in the following equation 6, and a curve thereof has a maximum point in the shape of projection as shown in FIG. 8:

$$P=a(\sin\theta4)-b(\tan\theta4)+c(\tan\theta4) \quad \text{(Eq. 6)}$$

In the above equation 6, alphabetical marks a, b, and c are constants determined by the lengths between the joint points o, m, and s, the kind of spring, the spring constant, and the like.

From the equations 1 to 6, the reaction force generated when the key top is depressed by a finger and the like results in the reaction force P, and a key clicking function is performed based on the drop of a load from the maximum point of the curve. The key clicking function is fed back to the finger and the like as a tactile response. As a result, a key switch device having a clear key operability can be realized.

Figure 9:
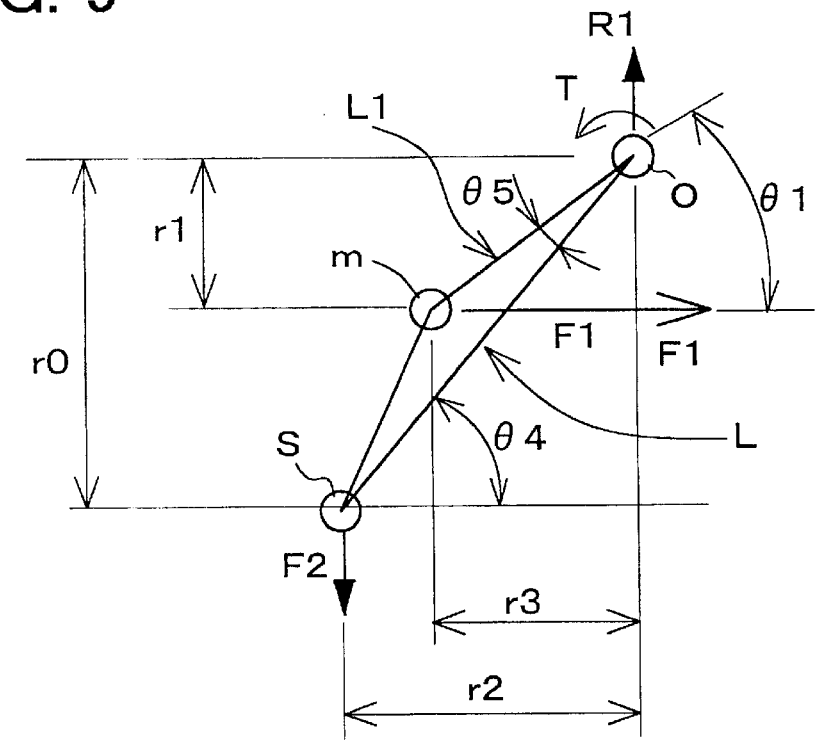
FIG. 9 is an explanatory diagram schematically showing an enlarged view of one side of the model 1 shown in FIG. 7.
Figure 10:
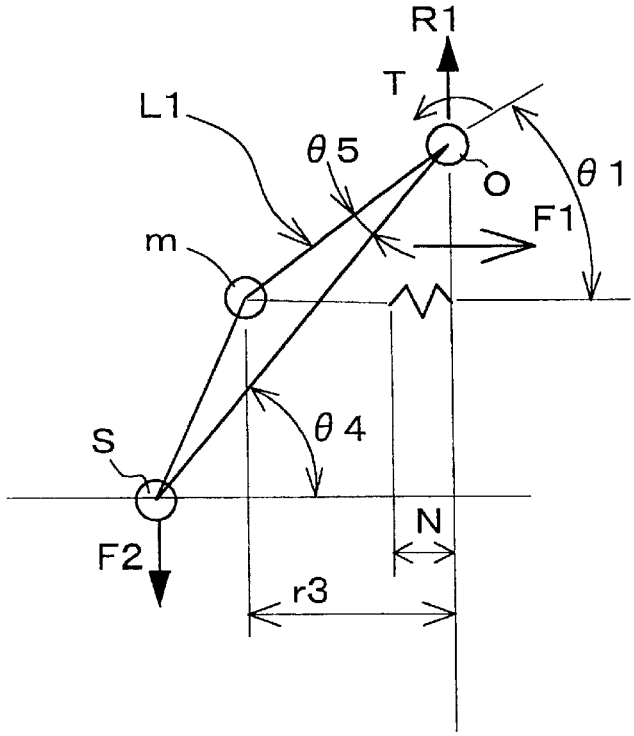
FIG. 10 is an explanatory diagram schematically showing an enlarged view of one side of the model 1 shown in FIG. 7.

Next, r1, r2, r1/r2, and F1 in the above-mentioned equation 5 are expressed in a general equation based on FIGS. 9 and 10, to finally obtain a depressing load P. FIGS. 9 and 10 are diagrams each schematically showing an enlarged portion at one side of the model 1.

(1) As to r2:

From FIG. 9, the following equations 7 and 8 are established:

$$\sin\theta4=r0/L \quad \text{(Eq. 7)}$$

$$L=r0/\sin\theta4 \quad \text{(Eq. 8)}$$

On the other hand, the following mathematical relationship is established:

$$r2=\cos\theta4\cdot L$$

When the equation 8 is substituted into this equation, the following mathematical relationship is established:

$$r2=\cos\theta4\cdot(r0/\sin\theta4)$$

$$\therefore \tan\theta4=\sin\theta4/\cos\theta4$$

As a result, r2 is expressed by the following equation 9:

$$r2=r0/\tan\theta4 \quad \text{(Eq. 9)}$$

(2) As to r1:

From FIG. 9, the following equation 10 is established:

$$r1=\sin\theta1\cdot L1 \quad \text{(Eq. 10)}$$

In addition, the following equation 11 is also established:

$$\theta1=\theta4-\theta5 \quad \text{(Eq. 11)}$$

As a result, the following equation 12 is established for r1:

$$r1=\sin(\theta4-\theta5)\cdot L1 \quad \text{(Eq. 12)}$$

Here, r1 can be expressed in the following equation 13 in accordance with addition theorem of trigonometric function:

$$r1=(\sin\theta4\cdot\cos\theta5-\cos\theta4\sin\theta5)L1 \quad \text{(Eq. 13)}$$

Furthermore, from FIG. 9, the following mathematical relationships are established:

$$\sin\theta4=r0/L;\ \text{and}\ \cos\theta4=r2/L$$

When these mathematical relationships are substituted into the equation 13, the following equation 14 is established:

$$r1=(L1\cdot r0/L)\cdot\cos\theta5-(L1\cdot r2/L)\cdot\sin\theta5 \quad \text{(Eq. 14)}$$

Furthermore, when the equation 9 is substituted into the equation 14, the following equation 15 is established:

$$r1=(L1\cdot r0/L)\cdot\cos\theta5-(L1\cdot r0/L)\cdot\sin\theta5/\tan\theta4 \quad \text{(Eq. 15)}$$

Finally, r1 can be expressed by the following equation 16:

$$r1=(L1\cdot r0/L)(\cos\theta5-\sin\theta5/\tan\theta4) \quad \text{(Eq. 16)}$$

(3) As to r1/r2:

The above-mentioned equations 9 and 16 are substituted, and as a result, the following equation 17 is established:

$$\frac{r1}{r2}=\frac{(L1\cdot r0/L)(\cos\theta5-\sin\theta5/\tan\theta4)}{(r0/\tan\theta4)} \quad \text{(Eq. 17)}$$

In the equation 17, r0 is deleted and 1/tan θ=cos θ/sin θ is substituted. As a result, the following equations 18, 19, and 20 are established:

$$\frac{r1}{r2}=\frac{L1}{L}\cdot\left[\frac{\cos\theta5-\sin\theta5\cdot(\cos\theta4/\sin\theta4)}{(\cos\theta4/\sin\theta4)}\right] \quad \text{(Eq. 18)}$$

$$\frac{r1}{r2}=\frac{L1}{L}\left[\frac{\sin\theta4}{\cos\theta4}\cdot\cos\theta5-\frac{\sin\theta4}{\cos\theta4}\cdot\frac{\cos\theta4}{\sin\theta4}\cdot\sin\theta5\right] \quad \text{(Eq. 19)}$$

$$\frac{r1}{r2}=\frac{L1}{L}\cdot(\tan\theta4\cdot\cos\theta5-\sin\theta5) \quad \text{(Eq. 20)}$$

Here, θ4 is obtained from the following equation 21:

$$\theta4=\sin-1(r0/L) \quad \text{(Eq. 21)}$$

(4) As to F1:

From FIG. 9, on the following definitions:

F1; load (N),

S; initial tension (N), k; spring constant (N/mm),

M; length of spring (mm),

N; free length of spring (mm), u; deflection coefficient of spring =2, the following equations 22 and 23 are established:

$$M=r3=L1\cdot\cos\theta1=L1\cdot\cos(\theta4-\theta5) \quad \text{(Eq. 22)}$$

$$F1=k\cdot u\cdot(M-N)+S \quad \text{(Eq. 23)}$$

When the equation 22 is substituted into the equation 23, F1 can be expressed by the following equations 24 and 25:

$$F1=k(u\cdot L1\cdot\cos(\theta4-\theta5)-uN)+S \quad \text{(Eq. 24)}$$

$$F1=k\cdot u\cdot L1\cdot\cos(\theta4-\theta5)-\text{ukN}+\text{S} \quad \text{(Eq. 25)}$$

(5) As to P:

When the above-mentioned equations 20 and 25 are substituted into the equation 5, P can be expressed by the following equation 26:

$$P=2\cdot\left\{\frac{L1}{L}\cdot(\tan\theta4\cdot\cos\theta5-\sin\theta5)\right\}\cdot\{k\cdot u\cdot L1\cdot\cos(\theta4-\theta5)-ukN+S\} \quad \text{(Eq. 26)}$$

Here, θ4 is obtained in the following mathematical relationship: θ4=sin-1 (r0/L).

In consideration of a movement of the rigid bodies K in the case where the structures of the rigid bodies K, A, and B, and the elastic body E are determined in the equation 26 obtained as described above for expressing the depressing load P, L, L1, and sin θ5 are constants of the rigid bodies A, and are at constant values with respect to r0. K, u, N, and S are constants of the elastic body E, and are at constant values with respect to r0. Therefore, the equation 26 becomes a function of the angle θ4, and the curve of the depressing load P expressed by the equation 26 takes a shape of an upward projecting curve having a maximum point as shown in FIG. 11.

In FIG. 11, the horizontal axis is an amount of stroke of the rigid body K, and the longitudinal axis is a load. F1 is a load applied to the rigid bodies A from the elastic body E. The load F1 is applied to the rigid bodies A even when the rigid body K is not depressed. The load F1 is increased as the amount of the stroke of the rigid body K is increased. In the depressing load curve P, the maximum point P1 appears at the point where the amount of stroke of the rigid body K is still relatively small. After reaching the maximum point P1, the depressing load is decreased, and the minimum point P2 appears after the switching operation is conducted. After the minimum point P2 appears, the depressing load is gradually increased along the curve OT by the action of the elastic body F.

In the depressing load curve P, the difference in loads between the maximum point P1 and the minimum point P2 contributes to the realization of the key clicking function. Based on this difference in loads, a clear key operation feeling can be obtained.

Specifically, the key clicking function is obtained during the time when the depressing load is decreased from the maximum point P1 toward the minimum point P2 along the depressing load curve, as the key top 11 is depressed.

A specific value of the maximum point P1 is about 30 g to 100 g in many cases, and in general, in a range of 50 g to 70 g. The difference in loads between the maximum point P1 and the minimum point P2 is, although depending on the amount of stroke of the key top 11, preferably 10 g or larger. However, when the maximum point P1 is relatively small (for example 40 g or smaller), the key clicking function can be performed even if the difference in loads is small.

As described above, in the key switch device 10 in the first embodiment, the depressing load applied to the key top 11 when the key top 11 is depressed is defined by a function (i.e. the equation 26) expressed by: a distance L between the rotation point o of the support shaft 30 of the first link member 12 at the first engagement portion 17 of the key top 11, and the slide starting point s of the support shaft 26 of the first link member 12 at the third engagement portion 40; a distance L1 between the rotation point o, and the acting point m at which the force exerted by the coil spring 15 acts on the first link member 12; an angle θ4 between a line segment passing from the rotation point o to the slide starting point s, and the direction along which the support shaft 26 of the first link member 12 in the third engagement portion 40 is allowed to slide; and various characteristic values of the coil spring 15. The depressing load curve P defined by this function takes a shape of an upward projecting curve having a maximum point P1. Based on the difference in loads between the maximum point P1 and the minimum point P2 from which the depressing load is increased after the switching operation is conducted by a membrane switch sheet 16, the key clicking function is performed. Therefore, the key clicking function can be evaluated from the depressing load curve P obtained through a simulation conducted by setting the rotation points o, the slide starting points s, the acting points m, the angles θ4, and various characteristics values of the coil spring 15. In this manner, it becomes possible to realize a key switch device having an excellent key operability with a desired key clicking function in a short period at a low cost by suppressing the number of trials for the key switching mechanism to the minimum.

Figure 12:
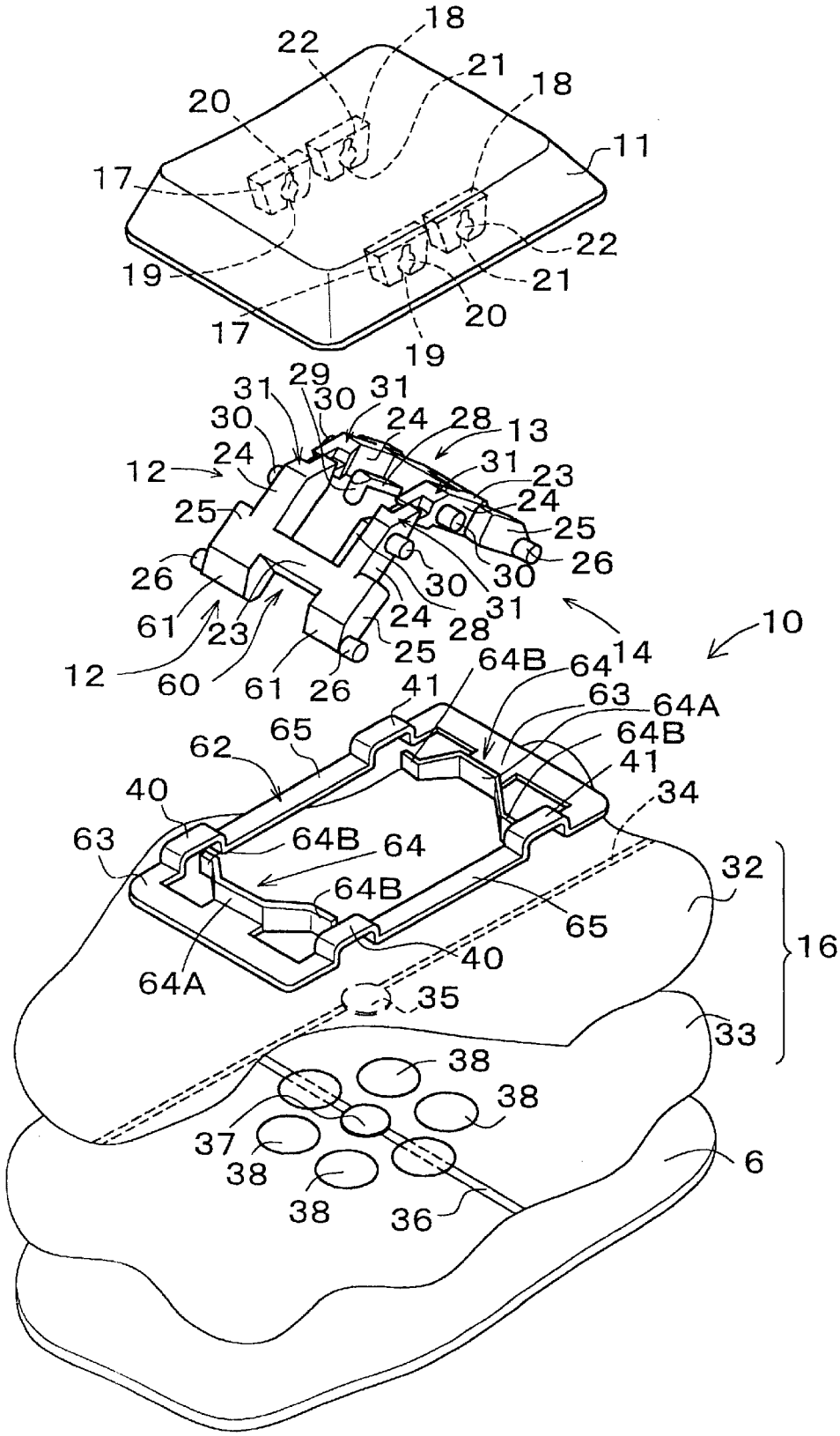
FIG. 12 is an exploded perspective view of a key switch device in a second embodiment.
Figure 13:
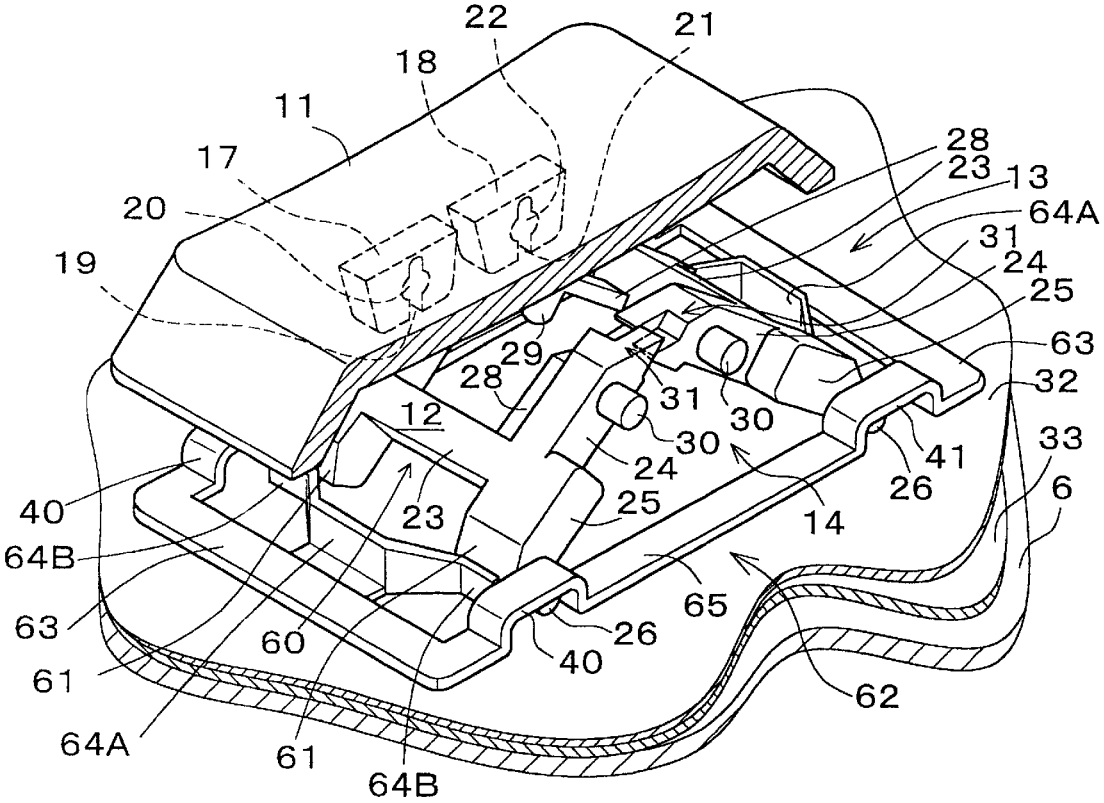
FIG. 13 is a perspective view of the key switch device of which a part is omitted.

Next, a key switch device in a second embodiment will be described with reference to FIGS. 12 and 13. FIG. 12 is an exploded perspective view of a key switch device in the second embodiment according to the present invention. FIG. 13 is a perspective view showing the key switch device but a portion thereof is omitted from the drawing. The key switch device in the second embodiment has basically the same structure as the key switch device 10 in the first embodiment. However, the key switch device in the second embodiment is different from that in the first embodiment in the following points. In the key switch device 10 of the first embodiment, the coil spring 15 is disposed between the spring engagement portions 27 of the first and second link members 12 and 13. The coil spring 15 urges first and second link members 12 and 13 so that respective lower ends are moved closer to each other. In addition, the support shafts 26 of the first link member 12 and the second link member 13 respectively are designed to be slidably engaged in the third and fourth engagement portions 40 and 41 of the engagement member 39 fixedly attached to the upper switching sheet 32 of the membrane switch sheet 16. Contrarily, in the key switch device in the second embodiment, the first and second link members are urged so as to move respective lower ends closer to each other without using neither a coil spring nor an engagement member designed as an independent member. Instead thereof, a spring for inwardly applying a force to the bottom sections at the lower ends of the first link member and the second link member, and an engagement member for slidably engaging the support shafts are integrated into one-piece unit to form an elastic frame-shaped member. The elastic frame-shaped member is fixedly attached to the upper switching sheet 32 of the membrane switch sheet 16. In this state, the first link member and the second link member are urged so as to close in a direction toward each other, and the support shafts are allowed to slide and are engaged via the elastic frame-shaped member. The other structure and elements of the key switch device in the second embodiment is the same as those in the first embodiment. Therefore, the description will be made only for the structure which is distinctive to the second embodiment and is different from that of the key switch device 10 of the first embodiment. The members and constituent elements identical to those of the first embodiment are provided with the same reference numerals, and the description thereof will be omitted.

In FIGS. 12 and 13, a recessed portion 60 is formed in a center at a lower side of a base portion 23 of each of the first link member 12 and the second link member 13 which constitute a guide member 14 together. On both sides of each recessed portion 60, two spring contact portions 61 are formed.

An elastic frame-shaped member 62 is bonded with adhesive to an upper switching sheet 32 of the membrane switch sheet 16 below the guide member 14. The elastic frame-shaped member 62 is formed into the shape of rectangular frame, and an urging spring portion 64 is integrally formed at a substantially central position of each of coupling sections 63 in its short sides (i.e. left and right sides thereof in FIGS. 12 and 13). Thus-designed urging spring portion 64 is bent in such a manner as to rise upwards from the coupling section 63. Plate-shaped urging springs 64B and 64B are provided so as to bifurcate into two directions extending from a central portion 64A which continues to the coupling section 63.

In FIGS. 12 and 13, the urging springs 64B at a left side urge inwardly the spring contact sections 61 of the first link member 12. The urging springs 64B at a right side urge inwardly the spring contact sections 61 of the second link member 13. With this arrangement, the first link member 12 and the second link member 13 are urged so as to close in a direction toward each other by the urging springs 64B formed at left and right sides of the elastic frame-shaped member 62.

Furthermore, the longer sides of the elastic frame-shaped member 62 (i.e. upper and lower sides thereof in FIGS. 12 and 13) are constituted by coupling sections 65. In the vicinity of each corner formed between each coupling section 65 and each coupling section 63 which are continuous to each other, each of third engagement portion 40 and fourth engagement portion 41 is formed. Each third engagement portion 40 slidably receives each support shaft 26 of the first link member 12. Each fourth engagement portion 41 slidably receives each support shaft 26 of the second link member 13.

The elastic frame-shaped member 62 is integrally formed into the rectangular frame continuously formed by the coupling sections 63 and 65. An urging spring 64B is integrally formed into each coupling section 63, and the third and fourth engagement portions 40 and 41 are integrally formed into each coupling section 65. With this arrangement, each urging spring 64B and the third and fourth engagement portions 40 and 41 are usually kept at a constant positional relationship with each other, and the manipulation thereof is extremely facilitated.

Figure 14:
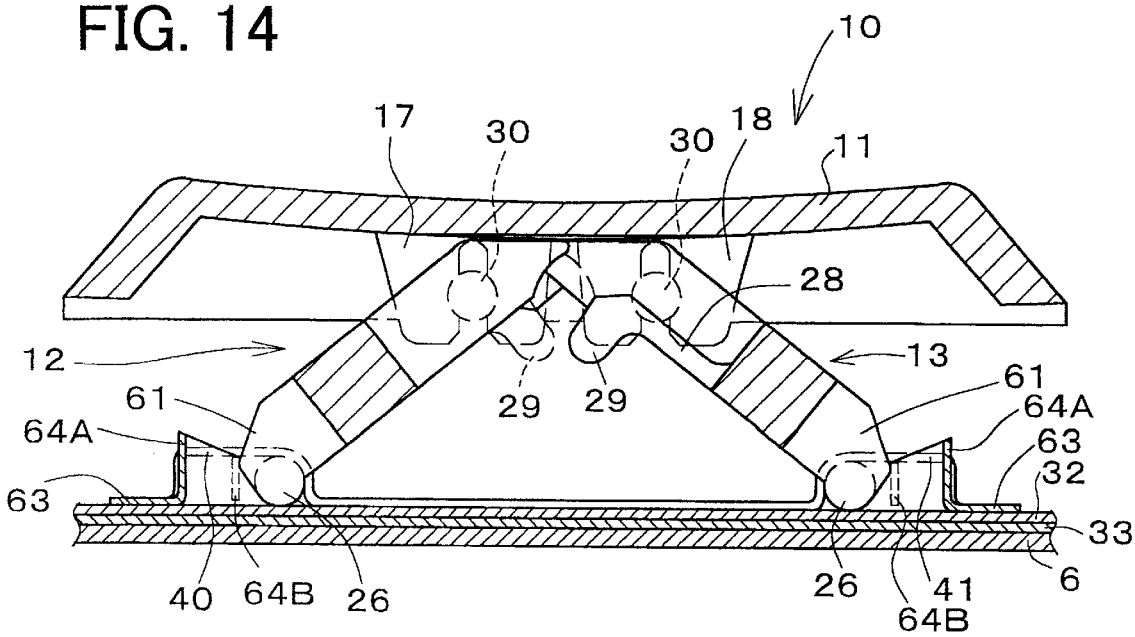
FIG. 14 is a sectional view of the key switch device in a non-depression position.
Figure 15:
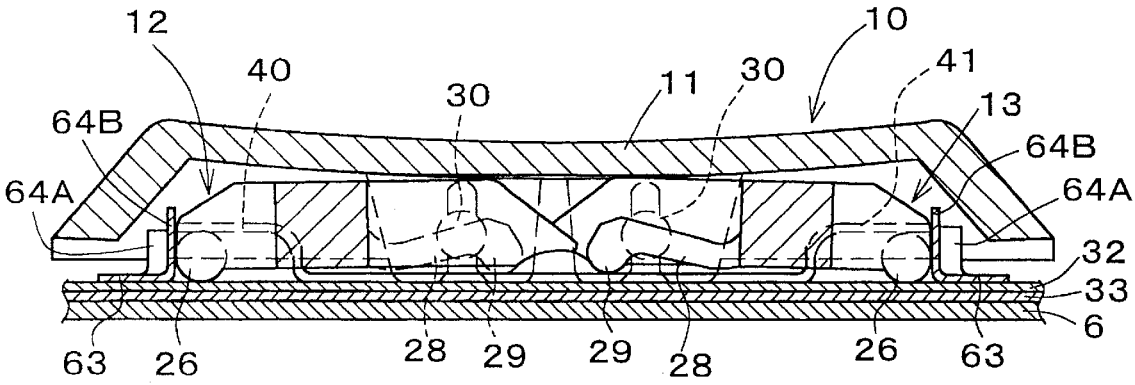
FIG. 15 is a sectional view of the key switch device in a state where a key top has been completely depressed.

Operation of the key switch device 10 designed as described above in the second embodiment will be described with reference to FIGS. 14 and 15. FIG. 14 is a sectional side view of the key switch device 10 before the key top 11 is depressed. FIG. 15 is a sectional side view of the key switch device 10 at the time when the key top 11 is completely depressed.

Before depression of the key top 11, as shown in FIGS. 13 and 14, each spring contact section 61 formed in the base portion 23 of the first link member 12 is urged inwardly by the springs 64B and 64B of the elastic frame-shaped member 62. Similarly, each spring contact section 61 formed in the base portion 23 of the second link member 13 is urged inwardly by the springs 64B of the elastic frame-shaped member 62. Therefore, the urging force of each urging spring 64B causes the first and second link member 12 and 13 to turn about each of the support shafts 30, as a rotation axis, rotatably supported in the corresponding bearing holes 20 and 22 provided on the underside of the key top 11, thereby bringing the lower ends of the link members closer to each other. At this time, each support shaft 26 of the first and second link members 12 and 13 are brought into contact with inner walls of the slide grooves of the third and fourth engagement portions 40 and 41 which are integrally formed into the elastic frame-shaped member 62. Thus, the key top 11 is held in the non-depression position shown in FIG. 14.

In the non-depression state, as is the case of the first embodiment, the key switch device 10 is symmetric with respect to a perpendicular line L passing through a midpoint between the center of the bearing hole 20 of the first engagement portion 17 and the center of the bearing hole 22 of the second engagement portion 18, as shown in FIG. 14.

As the key top 11 in the non-depression state shown in FIG. 14 is depressed against the urging force of each urging spring 64B, the support shaft 30 of the first link member 12 is allowed to rotate clockwise in the bearing hole 20 of the first engagement portion 17. At the same time, the support shaft 30 of the second link member 13 is allowed to rotate counterclockwise in the bearing hole 22 of the second engagement portion 18. In addition, the support shaft 26 of the first link member 12 is allowed to slide leftwards in a slide groove of the third engagement portion 40, while the support shaft 26 of the second link member 13 is allowed to slide rightwards in a slide groove of the fourth engagement portion 41. As this movement proceeds, each urging spring 64B is compressed outwardly by each spring contact section 61, allowing the first link member 12 and the second link member 13 to move respective lower ends in a direction away from each other (in an opening direction).

At this time, the gear tooth portion 31 of each arm 24 of the first link member 12, and the gear tooth portion 31 of each arm 24 of the second link member 13 are lowered while being kept into contact with each other. In this manner, the first link member 12 and the second link member 13 are moved in complete synchronization with each other based on the cooperative action of the gear tooth portions 31.

When the key top 11 is depressed by a specified amount, the depressing projection 29 formed in the elastic piece 28 of the first link member 12 or the second link member 13 pushes from above the movable switching electrode 35 formed on the underside of the upper switching sheet 32 in the membrane switch sheet 16. When the key top 11 is further depressed, the depressing projection 29 brings the movable electrode 35 into contact with the fixed electrode 37 in the lower switching sheet 33, while accompanying a feeling of clicking. In this manner, a specified switching operation is effected by the movable electrode 35 and the fixed electrode 37. At this point, each urging spring 64B is in the most pushed position as shown in FIG. 15.

When the key top 11 is released from being depressed after the switching operation described above, the reverse operation to the above is conducted by the urging force of the urging springs 64B. The key top 11 is then lifted to return to the non-depression position shown in FIG. 14.

[Modeling according to second embodiment]

Figure 16:
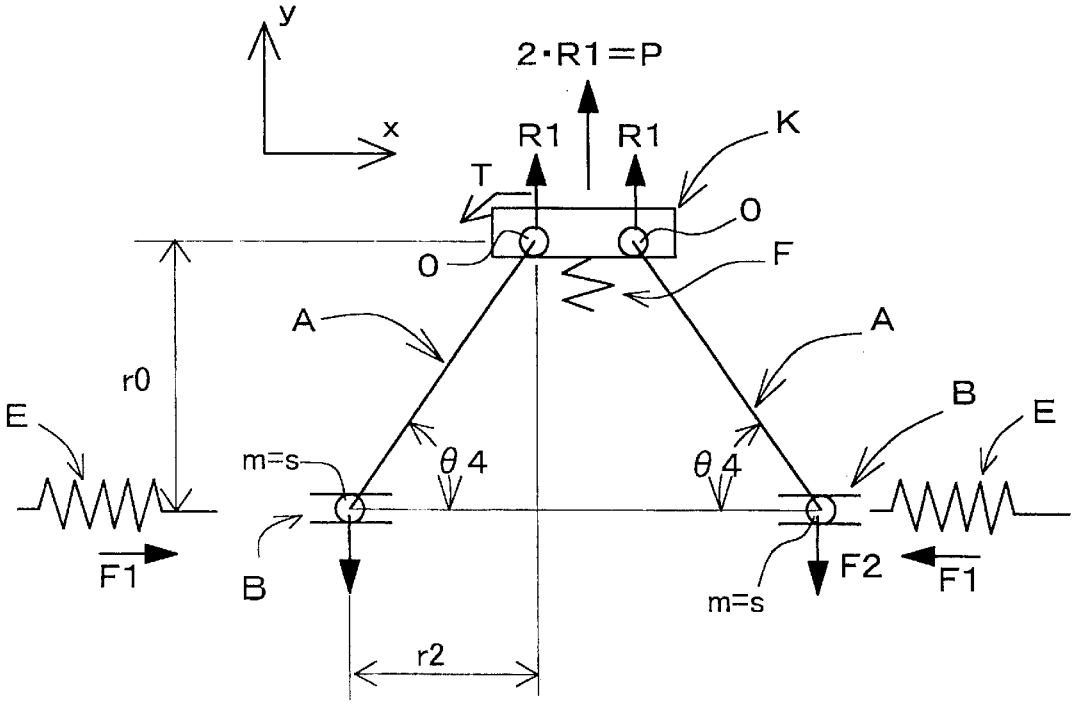
FIG. 16 is an explanatory diagram of a model 2 for schematically showing a modeled key switch device.
Figure 17:
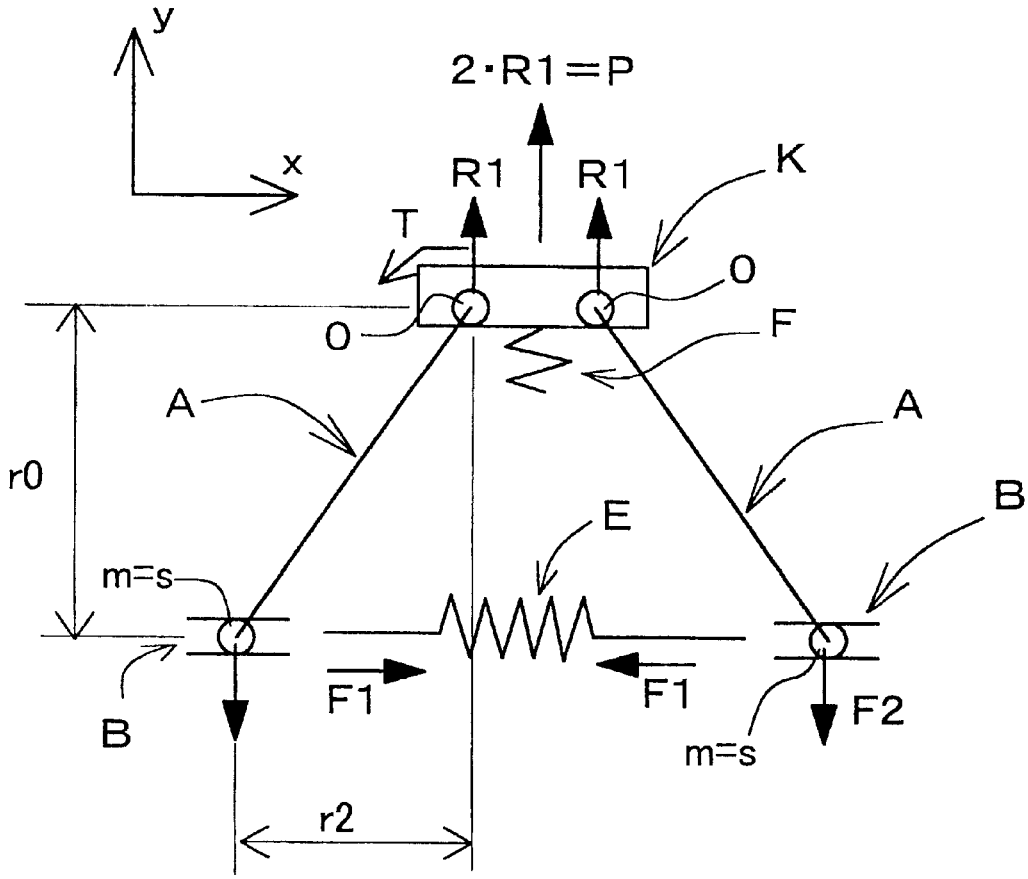
FIG. 17 is an explanatory diagram schematically showing an equivalent to the model 2.

Next, the key switch device 10 in the second embodiment is modeled into a model 2, and the principle of performing a key clicking function in the model 2 will be described with reference to FIGS. 16 and 17. FIG. 16 is an explanatory diagram of the model 2 for schematically showing a modeled key switch device 10. FIG. 17 is an explanatory diagram schematically showing the modeled case where the urging force of the coil spring 15 in the key switch device 10 of the first embodiment is exerted on a slide starting point (i.e. a junction point s) of the support shaft 26 of each of the first link member 12 and the second link member 13. It is obvious that the model 2 shown in FIG. 16 is equivalent to the model shown in FIG. 17.

In FIGS. 16 and 17, rigid bodies A represent the first and second link members 12 and 13, a rigid body K represents the key top 11, and rigid bodies B represent the third and fourth engagement portions 40 and 41 in the elastic frame-shaped member 62. Alphabetical marks o represent a rotation center of a support shaft 30 of the first link member 12 received in the bearing hole 20 at the first engagement portion 17, and a rotation center of the support shaft 30 of the second link member 13 received in the bearing hole 22 at the second engagement portion 18 in the key top 11. Alphabetical marks s represent a slide starting point from which the support shaft 26 of the first link member 12 starts to slide outwardly in the third engagement member 40, and a slide starting point from which the support shaft 26 of the second link member 13 starts to slide outwardly in the fourth engagement member 41.

In the model 2 shown in FIG. 16 and the model shown in FIG. 17 equivalent to the model 2, an urging acting point m from which the spring contact portion 61 of each of the first link member 12 and the second link member 13 is urged inwardly by each urging spring 64B is at a position identical to the slide starting point s. Marks θ4 represent an angle between the first link member 12 in an inclined state and a sliding direction of the support shaft 26 thereof, and an angle between the second link member 13 in an inclined state and a sliding direction of the support shaft 26 thereof, with respect to each slide starting point s.

In FIGS. 16 and 17, the model 2 and the model equivalent thereto each includes: two rigid bodies A each having two joint points (i.e. rotation point) o and m=s (i.e. the acting point and the slide starting points are in an identical position); a rigid body K which rotatably supports the rigid bodies A at the joint points o; and rigid bodies B each of which allows each rigid body A to be slidable from the joint point s in a direction x (i.e. in a horizontal direction). The rigid body K can move in a direction y (i.e. in a vertical direction).

As shown in FIGS. 16 and 17, when two rigid bodies A are coupled to each other via an elastic body E (corresponding to the urging spring 64B in the case of model 2, and corresponding to the coil spring 15 in the case of equivalent model), a force F1 is generated, and accordingly, a force P in the direction y is generated in the rigid body K. When the rigid body K is deformed in a direction −y (i.e. in a downward direction), the force P is expressed by a function of angle between the joint points o and m=s, and a curve of the function has a maximum point in the shape of projection as shown in FIG. 11. Then, an elastic body F (corresponding to the elastic piece 28) acts from a position where the switching operation is conducted, and the curve continues to a curve OT.

Hereinafter, the principle of operation of the model 2 will be described with reference to FIGS. 16 and 17. In FIGS. 16 and 17, since the joint point m=the joint point s, relationships of r1=r0, and r3=r2 are established in FIGS. 7 and 9 described above. In addition, relationships of L1=L, and θ5=0 are established. When these conditions are substituted into the above-mentioned equation 26, the following equations 27, 28, and 29 are established:

$$P=2\cdot\tan\theta4\cdot(k\cdot u\cdot L\cdot\cos\theta4-ukN+S) \quad \text{(Eq. 27)}$$

$$P=2\cdot k\cdot u\cdot L\cdot\tan\theta4\cdot\cos\theta4-2\cdot u\cdot k\cdot N\cdot\tan\theta4+2\cdot S\cdot\tan\theta4 \quad \text{(Eq. 28)}$$

$$P=2\cdot k\cdot u\cdot L\cdot\sin\theta4-2\cdot u\cdot k\cdot N\cdot\tan\theta4+2\cdot S\cdot\tan\theta4 \quad \text{(Eq. 29)}$$

In the equation 29, defining (2·k·u·L) in the first term as a, (2·u·k·N) in the second term as b, and (2·S) in the third term as c, the equation 29 becomes P=a·sin θ4−b·tan θ4+c·tan θ4 which coincides with the equation 6.

In this case, a, b, and c are constants determined by the length between the joint points o and m=s, the kind of spring, and the spring constant and the like. Therefore, the reaction force generated when the key top is depressed by a finger and the like becomes the force P, and a key clicking function is performed based on the drop of a load from the maximum point of the curve. In this case, the key clicking function is fed back to the finger and the like as a tactile response. As a result, a key switch device having a clear key operability can be realized.

As described above, in the key switch device 10 in the second embodiment, as is the case of the first embodiment, the depressing load generated in the key top 11 when depressed is defined by a function (i.e. the equation 29) expressed by: a distance L between the rotation point o of the support shaft 30 of the first link member 12 at the first engagement portion 17 in the key top 11, and the slide starting point s of the support shaft 26 of the first link member 12 at the third engagement portion 40; the angle θ4 between a line segment extending from the rotation point o to the slide starting point s, and the sliding direction along which the support shaft 26 of the first link member 12 at the third engagement portion 40 is allowed to slide; and various characteristic values of the coil spring 15. The depressing load curve P defined by this function takes a shape of an upward projecting curve having a maximum point P1 as shown in FIG. 11. Based on the difference in loads between the maximum point P1 and the minimum point P2 from which the depressing load is increased after the switching operation is conducted by a membrane switch sheet 16, the key clicking function is performed. Therefore, the key clicking function can be evaluated from the depressing load curve P obtained through a simulation conducted by setting the rotation points o=m (the urging acting point), the slide starting points s, the angles θ4, and various characteristics values of the coil spring 15 to various values. In this manner, it becomes possible to realize a key switch device having an excellent key operability with a desired key clicking function in a short period at a low cost by suppressing the number of trials for the key switching mechanism to the minimum.

Figure 18:
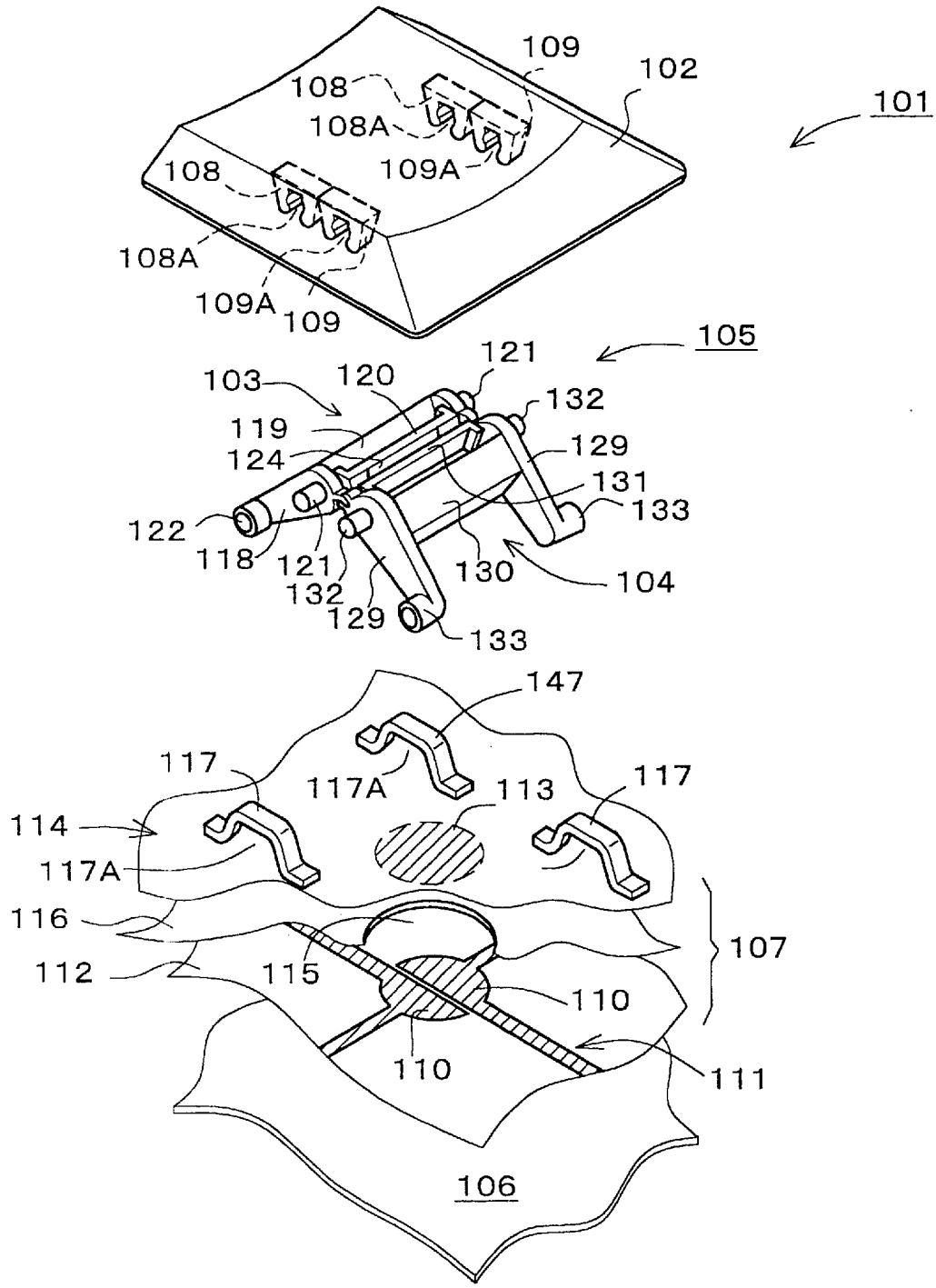
FIG. 18 is an exploded perspective view of a key switch device in a third embodiment.
Figure 19:
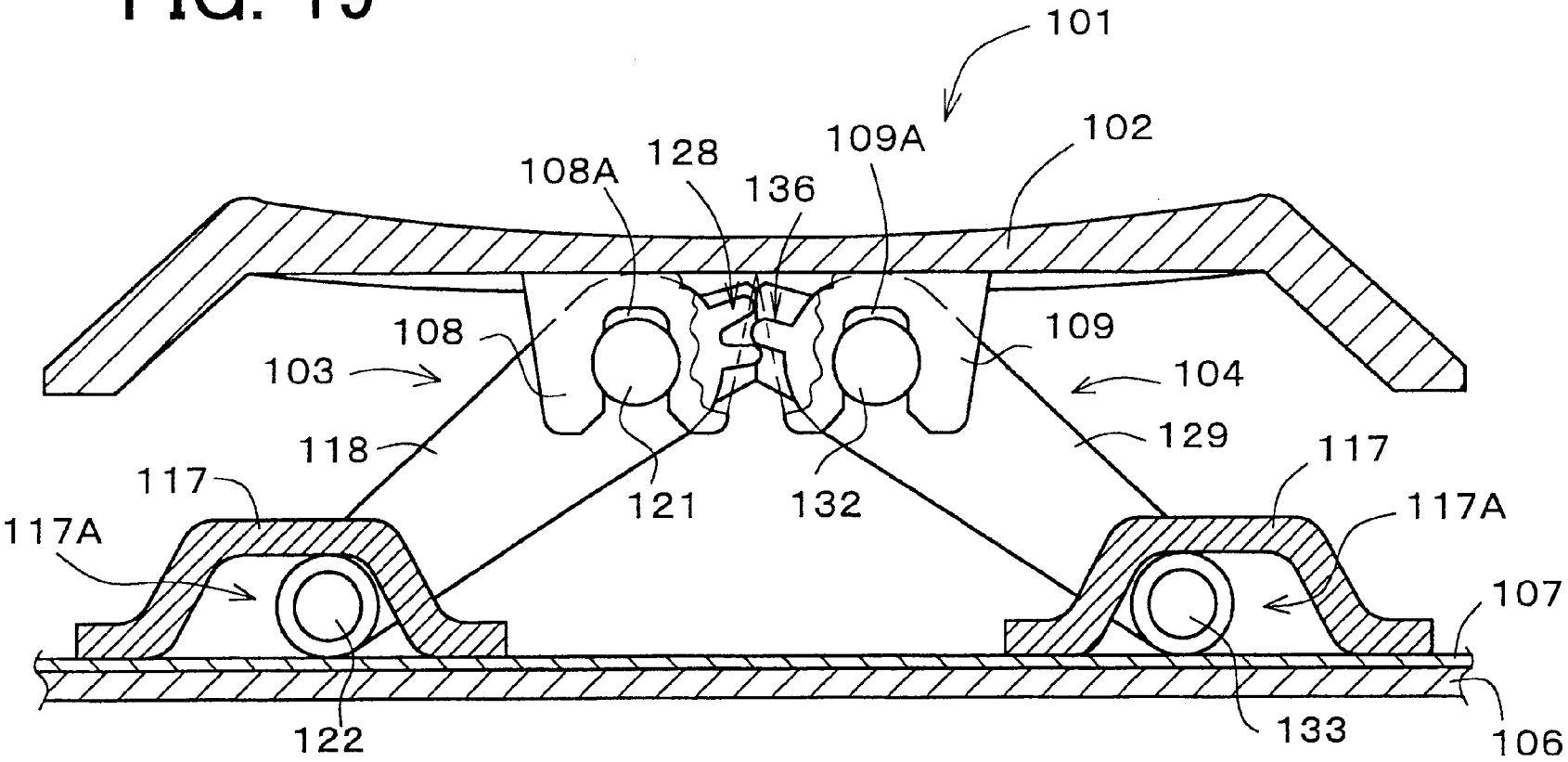
FIG. 19 is a side view of the key switch device of FIG. 18.
Figure 20:
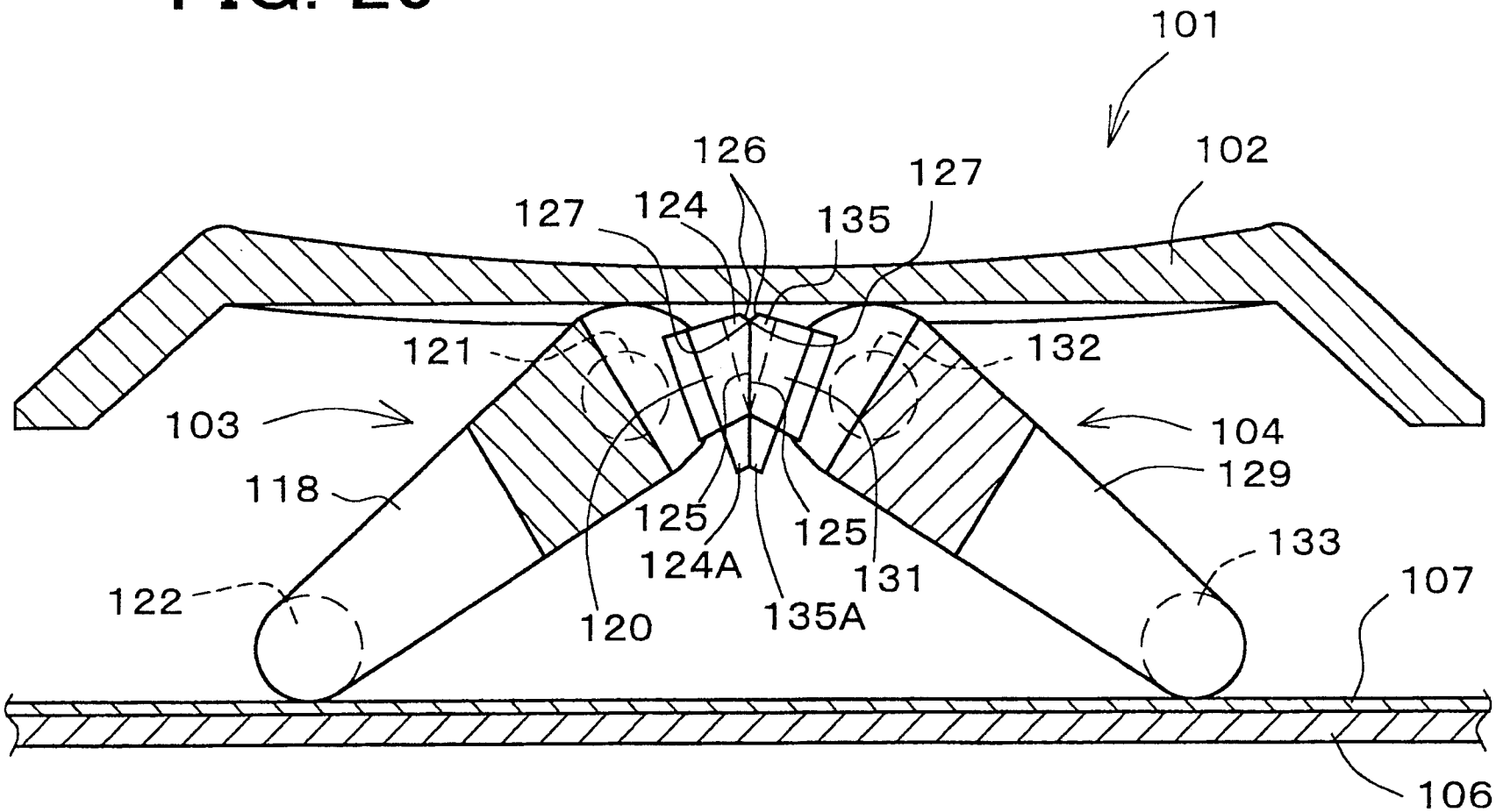
FIG. 20 is a sectional view of the key switch device of FIG. 18.

Next, a key switch device in a third embodiment will be described with reference to FIGS. 18 to 20. FIG. 18 is an exploded perspective view of a key switch device in the third embodiment. FIG. 19 is a schematic side view of the key switch device of FIG. 18. FIG. 20 is a schematic sectional side view of the key switch device of FIG. 18. The key switch device in the third embodiment basically has the same structure as the key switch device 10 in the first embodiment, except for the following points. That is, in the key switch device in the third embodiment, cam mechanisms are interposed between the first link member and the second link member. The cam mechanisms are urged toward each other via plate springs provided in the first link member and the second link member.

First, in FIG. 18, a key switch device 101 basically includes: a key top 102: a guide member 105 which is made up of a pair of first link member 103 and second link member 104 for guiding the vertical movement of the key top 102, and a membrane switch sheet 107 disposed on a support plate 106 and below the guide member 105.

The key top 102 is molded from an ABS resin and the like and is formed with a character such as a letter and a number on its top surface by printing and the like. On the underside of the key top 102, two engagement portions 108 are integrally formed so as to correspond to the first link member 103, and two engagement portions 109 are integrally formed so as to correspond to the second link member 104. The engagement portions 108 and 109 are formed with engagement grooves 108A and 109A, respectively. The engagement groove 108A of each engagement portion 108 rotatably engages a first shaft 121 (which will be described later) of the first link member 103. The engagement groove 109A of each engagement portion 109 rotatably engages a third shaft 132 (which will be described later) of the second link member 104.

The guide member 105 is a combination of the first link member 103 and the second link member 104. The first and second link members 103 and 104 basically have the same structure with each other. The detailed structures of the first link member 103 and the second link member 104 will be described later.

Furthermore, below the guide member 105, a membrane switch sheet 107 is provided on the supporting plate 106 formed from a metal thin plate made of aluminum, iron, or the like. The membrane switch sheet 107 has a three-layered structure constructed of a lower film sheet 112, an upper film sheet 14, and a film spacer 116 interposed between the upper film sheet 114 and the lower film sheet 112. The lower film sheet 112 is formed with a circuit pattern including a fixed electrode pattern 110 made of copper foil, a conductive painting and the like. Similarly, the upper film sheet 114 is formed with a movable electrode pattern 113 on its lower surface. The film spacer 116 is formed with a switching hole 115 at a position corresponding to the fixed electrode pattern 110 and the movable electrode pattern 113. The membrane switch sheet 107 having a structure described above is known in the art.

On the upper switching sheet 114, four engagement members 117 in the shape of chip made of a metal, a resin, and the like are fixed with adhesive in such a manner as to surround the movable electrode pattern 113. Each engagement member 117 forms an engagement groove 117A in the shape of rectangular hole. The engagement groove 117A slidably receives a second shaft 112 (which will be described later) of the first link member 103, and a fourth shaft 133 (which will be described later) of the second link member 104. The structure for fixedly attaching each engagement member 117 on the upper surface of the upper film sheet 114 in the membrane switch sheet 107 is the same as those described in the specification and drawings of Japanese Patent Application No. 11-32608. Therefore, the detailed description of this structure can be found in the specification and drawings of Japanese Patent Application No. 11-32608, and its description will be omitted in this application.

Figure 21:
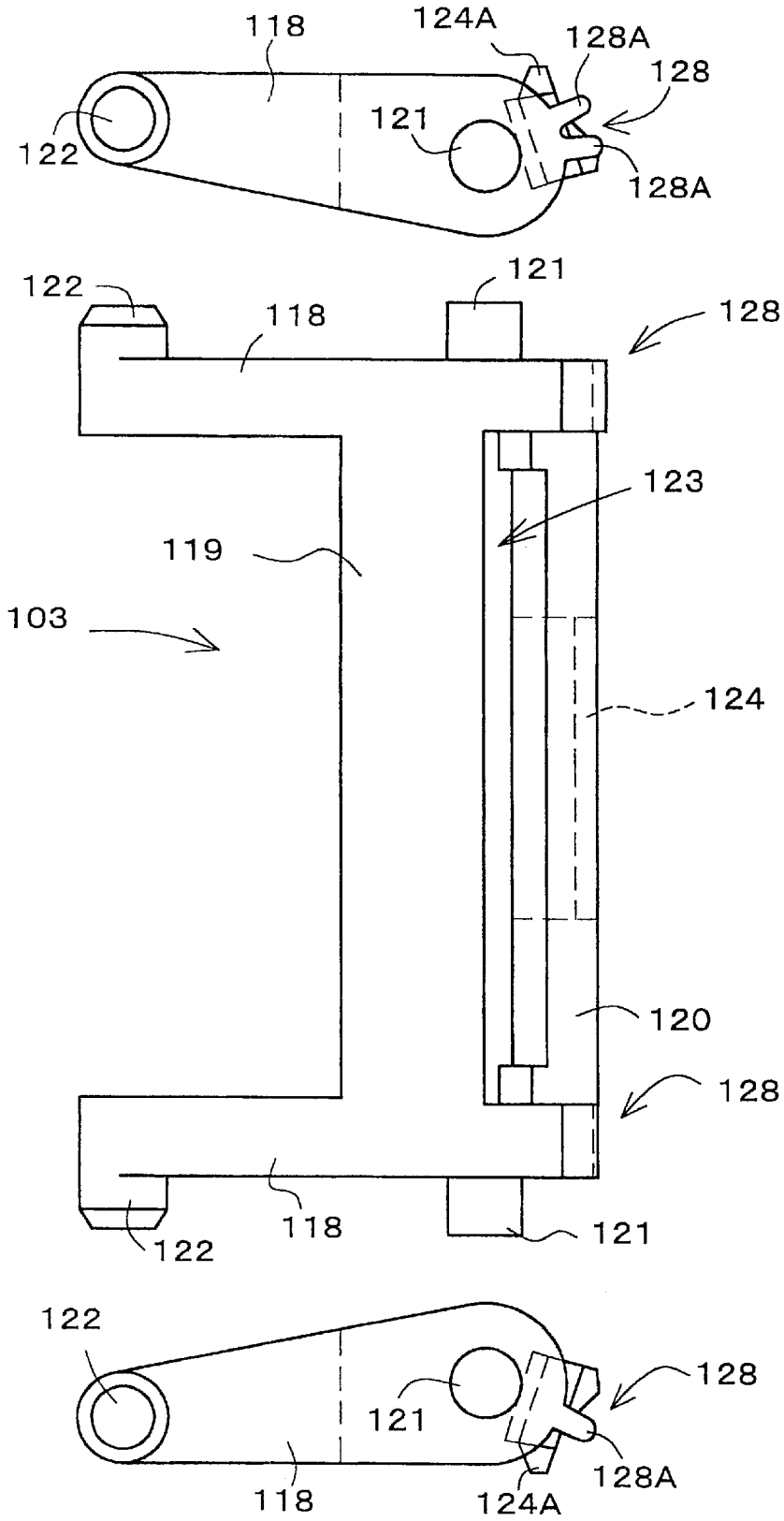
FIG. 21 shows a side and plan views of the first link member.

Next, detailed structures of the first link members 103 and the second link member 104 which constitute the guide member 105 together will be described. First, the structure of the first link member 103 will be described with reference to FIGS. 18 to 21. FIG. 21 shows a side view and a plan view of the first link member 103.

In FIGS. 18 to 21, the first link member 103 includes a pair of plate-shaped bodies 118, a coupling portion 119 for coupling the plate-shaped bodies 118 to each other, and a plate spring portion 120 integrally formed at a position close to the coupling portion 119 by use of polyacetal resin and the like. At a position close to one end (i.e. an upper end in FIGS. 18 to 20, and a right end in FIG. 21) of each plate-shaped body 118, a first shaft 121 is provided projecting outwardly. At a position close to the other end (i.e. a lower end in FIGS. 18 to 20, and a left end in FIG. 21) of each plate-shaped body 118, a second shaft 122 is provided projecting outwardly. The first shaft 121 is rotatably engaged in the engagement groove 108A of the engagement portion 108 in the key top 102 described above. The second shaft 122 is slidably engaged in the engagement groove 117A of the engagement member 117 fixed to the surface of the upper film sheet 114 in the membrane switch sheet 107.

The coupling portion 119 couples the plate-shaped bodies 118 to each other at a distance therebetween. As shown in FIG. 21, the plate spring portion 120 is provided between the plate-shaped bodies 118 so that a space 123 having a constant width is provided between the plate spring portion 120 and the coupling portion 119. At a substantially center position of the plate spring portion 120, a first cam portion 124 is integrally formed. As shown in FIG. 20, a first cam surface 125 is formed in the first cam section 124 at its lower portion.

In addition, a second cam surface 126 is formed in the first cam portion 124 at its upper portion so as to extend upwards from the first cam surface 125. At a boundary between the first cam surface 125 and the second cam surface 126, a cam apex 127 is present. As is obvious from FIG. 20, the first cam surface 125 corresponds to the non-depression position of the key top 102. The second cam surface 126 corresponds to the depressed position of the key top 102, as will be described later.

The angle between the first cam surface 125, the cam apex 127, and the second cam surface 126 is set to be an obtuse angle. Furthermore, as shown in FIGS. 20 and 21, a resinous elastic piece 124A is provided at the bottom end of the first cam portion 124. When the key top 102 is depressed, the elastic piece 124A is brought into contact with the membrane switch sheet 107 to thereby turn on the membrane switch sheet 107.

The plate-shaped body 118 is formed with a gear tooth portion 128 at its end beyond the first shaft 121 (i.e. at a right end in FIGS. 19 and 21). The gear tooth portion 128 has one gear tooth or two gear teeth 128A. In FIG. 21, the gear tooth portion 128 of the plate-shaped body 118 at the upper side has two gear teeth 128A. The gear tooth portion 128 of the plate-shaped body 118 at the lower side has one gear tooth 128A. As will be described later, each gear tooth portion 128 is engaged with the gear tooth portion 136 formed at an end of the plate-shaped body 129 of the second link member 104. When the key top 102 is moved vertically upon depression or release thereof, the engagement between the gear tooth portion 128 and the gear tooth portion 136 allows the first link member 103 and the second link member 104 to move in synchronization with each other.

Figure 22:
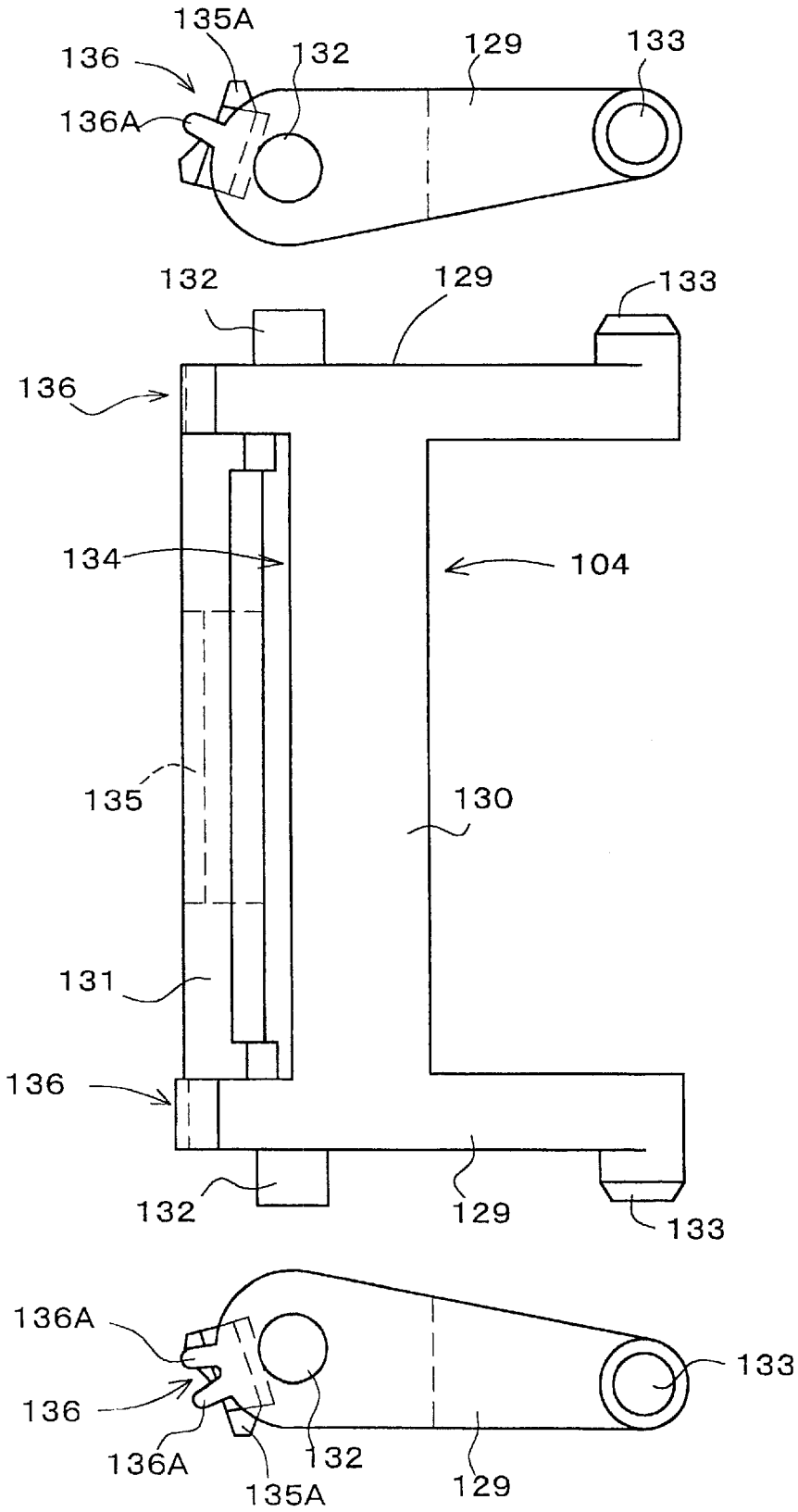
FIG. 22 shows a side and plan views of the second link member.

Next, the structure of the second link member 104 will be described with reference to FIGS. 18 to 20, and 22. FIG. 22 shows a side view and a plan view of the second link member 104. The second link member 104 basically has the same structure as of the first link member 103.

In FIGS. 18 to 20, and 22, the second link member 104 includes a pair of plate-shaped bodies 129, a coupling portion 130 for coupling the plate-shaped bodies 129 to each other, and a plate spring portion 131 integrally formed at a position close to the coupling portion 130 by use of polyacetal resin and the like. At a position close to one end (i.e. an upper end in FIGS. 18 to 20, and a left end in FIG. 22) of each plate-shaped body 129, a third shaft 132 is provided projecting outwardly. At a position close to the other end (i.e. a lower end in FIGS. 18 to 20, and a right left end in FIG. 22) of each plate-shaped body 129, a fourth shaft 133 is provided projecting outwardly.

The third shaft 132 is rotatably engaged in the engagement groove 109A of the engagement portion 109 in the key top 102 described above. The fourth shaft 133 is slidably engaged in the engagement groove 117A of the engagement member 117 fixed to the surface of the upper film sheet 114 in the membrane switch sheet 107.

The coupling portion 130 couples the plate-shaped bodies 129, 129 to each other at a distance therebetween. As shown in FIG. 22, the plate spring portion 131 is provided between the plate-shaped bodies 129 in such a manner that a space 134 is provided between the plate spring portion 131 and the coupling portion 130. At a substantially center position of the plate spring portion 131, a second cam portion 135 is integrally formed.

As is the case of the first cam portion 124 of the first link member 103, as shown in FIG. 20, a first cam surface 125 is formed in the second cam portion 135 at its lower portion. In addition, a second cam surface 126 is formed in the second cam portion 135 at its upper portion so as to extend upwards from the first cam surface 125. At a boundary between the first cam surface 125 and the second cam surface 126, a cam apex 127 is present.

As is obvious from FIG. 20, the first cam surface 125 corresponds to the non-depression position of the key top 102. The second cam surface 126 corresponds to the depressed position of the key top 102, as will be described later. The angle between the first cam surface 125, the cam apex 127, and the second cam surface 126 is set to be an obtuse angle. Furthermore, as shown in FIGS. 20 and 22, a resinous elastic piece 135A is provided at the bottom end of the second cam portion 135. When the key top 102 is depressed, the elastic piece 135A is brought into contact with the membrane switch sheet 107 and thereby turning on the membrane switch sheet 107.

As shown in FIG. 20, the first cam surface 125 of the first cam portion 124 is held in contact with the first cam surface 125 of the second cam portion 135 at the time when the key top 102 is in the non-depression state. In this state, the plate spring portion 120 of the first link member 103, and the plate spring portion 131 of the second link member 104 are urged in a direction to bring the first cam portion 124 and the second cam portion 135 into contact with each other. The state where the first cam surface 125 of the first cam portion 124 is brought into contact with the first cam surface 125 of the second cam portion 135 is defined as a first contact state. In the first contact state, the key top 102 is stably held in the non-depression position.

When the key top 102 is depressed, the first cam portion 124 and the second cam portion 135 are shifted about the cam apex 127 from the first contact state to a second contact state where the second cam surfaces 126 of the first and second cam sections 124, 135 are brought into contact with each other, which will be mentioned later. In the second contact state, the key top 102 comes down to the depressed position. The movable electrode pattern 113 on the upper film sheet 114 in the membrane switch sheet 107 is pushed from above by one or both the resinous elastic piece 124A of the first cam portion 124 and the resinous elastic piece 135A of the second cam portion 135. As a result, the movable electrode 113 is brought into contact with the fixed electrode pattern 110 on the lower film sheet 112 via a switching hole 115 of the film spacer 116. In this manner, a specified switching operation is effected.

The plate-shaped body 129 is formed with a gear tooth portion 136 at its end beyond the third shaft 132 (i.e. at a left end in FIGS. 19 and 22). The gear tooth portion 136 has one gear tooth or two gear teeth 136A. In FIG. 22, the gear tooth portion 136 of the plate-shaped body 129 at the upper side has one gear tooth 136A. The gear tooth portion 136 of the plate-shaped body 129 at the lower side has two gear teeth 136A. As has been described above, each gear tooth portion 136 is engaged with the gear tooth portion 128 formed at an end of the plate-shaped body 119 of the first link member 103. When the key top 102 is moved vertically upon depression or release therefrom, the engagement between the gear tooth portion 128 and the gear tooth portion 136 allows the first link member 103 and the second link member 104 to move in synchronization with each other.

Figure 23A:
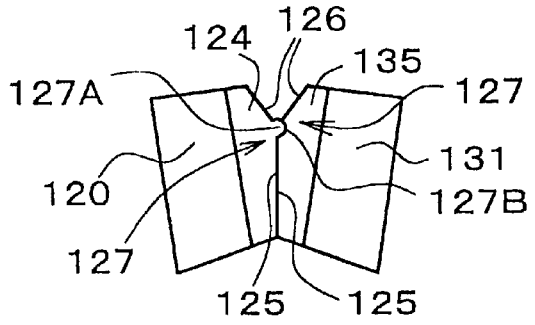
FIGS. 23A to 23C are explanatory views schematically showing a plate spring portion and a first cam portion in the first link member and a plate spring portion and a second cam portion in the second link member.
Figure 23B:
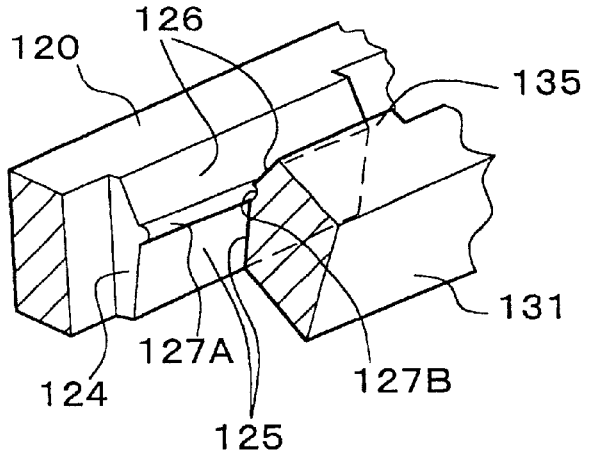
Figure 23C:
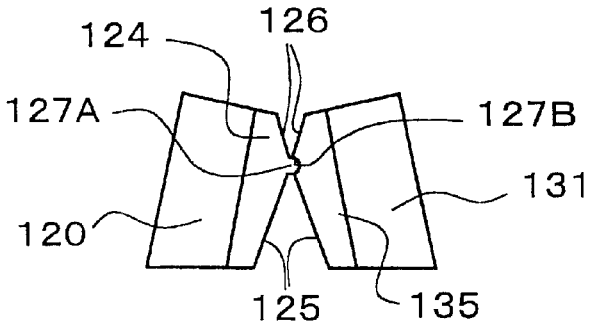

Next, the relationship between the first cam portion 124 and the second cam portion 135 will be described with reference to FIGS. 23A–23C. FIGS. 23A–23C are explanatory views schematically showing the plate spring portion 120 and the first cam portion 124 taken out from the first link member 103, and the plate spring portion 131 and the second cam portion 135 taken out from the second link member 104.

In FIGS. 23A and 23B, a projection 127A is formed on the cam apex 127 of the first cam portion 124 integrally formed with the plate spring portion 120 of the first link member 103 over the entire width of the first cam portion 124. On the cam apex 127 of the second cam portion 135 integrally formed with the plate spring portion 131 of the second link member 104, a recessed groove 127B into which the projection 127A is fitted is formed.

Each of the plate spring members 120 and 131 serves to urge the first cam portion 124 and the second cam portion 135 in a direction to bring them in contact with each other. Thus, the projection 127A and the recessed groove 127B are always fit with each other from the first contact state where the first cam surfaces 125 of the first and second cam sections 124 and 135 are held in contact with each other (FIGS. 23A and 23B) via the state where the first and second cam sections 124 and 135 make contact with each other through only the cam apexes 127 (FIG. 23C) to the second contact state where the second cam surfaces 126 of the first and second cam sections 124 and 135 are held in contact with each other. In this manner, when the first link member 103 and the second link member 104 are moved together in association with the vertical movement of the key top 102 when depressed or released therefrom in the key operation, it is possible to securely achieve the synchronization between the first cam surface 125, the cam apex 127, and the second cam surface 126 at each of the first cam portion 124 of the first link member 103, and the second cam portion 135 of the second link member 104.

Next, operation of the key switch device 101 having the above-described structure will be described with reference to FIGS. 24A–24D. FIGS. 24A–24D are explanatory views showing a series of movements of the key top 102 from the non-depression state to the depression state to effect the switching operation, in view of the movements of the first link member 103 and the second link member 104.

Figure 24A:
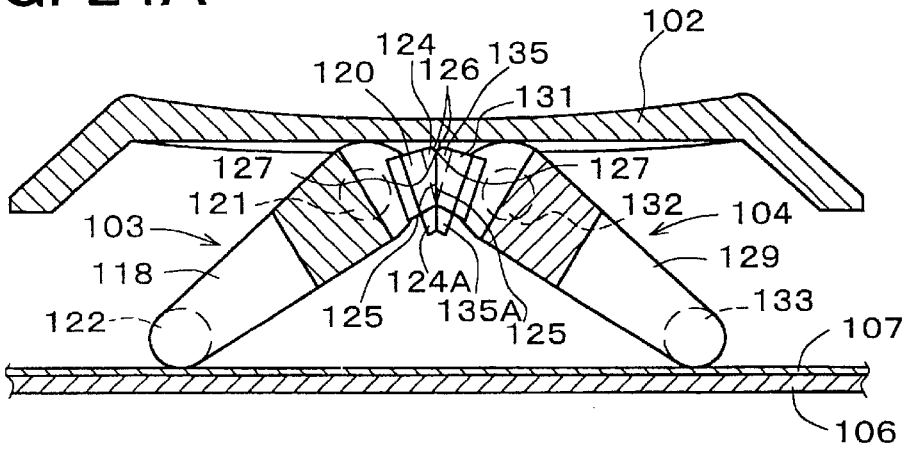
FIGS. 24A–24D are sectional views of the key switch device for explaining a switching operation while focusing attention on movements of the first and second link members, from a non-depression state of the key top to a depressed state.

First, in the non-depression state where the key top 102 is not pushed down, the key top 102 is held in the non-depression position as shown in FIG. 24A. The first cam surface 125 in the second cam portion 124 of the first link member 103 is in contact with the first cam surface 125 in the first cam portion 135 of the second link member 104, that is, they are in the first contact state. In the first contact state, the urging force of the plate spring portions 120 and 131 are exerted in a direction to bring the first cam surfaces 125, 125 of the first and second cam sections 124, 135 into contact with each other. As a result, as shown in FIG. 19, the second shaft 122 of the first link member 103 is positioned at a right side in the engagement groove 117A of the engagement member 117, while the fourth shaft 133 of the second link member 104 is positioned at a left side in the engagement groove 117A of the engagement member 117. In this state, the key top 102 is stably held in the non-depression position.

In the non-depression state, as shown in FIG. 19, the key switch device 101 is symmetric with respect to a perpendicular line L passing a midpoint between the center of the engagement groove 108A of the engagement portion 108 and the center of the engagement groove 109A of the engagement portion 109.

In addition, in the first contact state, the urging forces of the plate spring portions 120 and 131 are exerted in a direction to bring the first cam surfaces 125 of the first and second cam sections 124 and 135 into contact with each other. Therefore, the key top 102 is held in the non-depression position without horizontal motion, thereby preventing the key top 102 from rattling.

Figure 25:
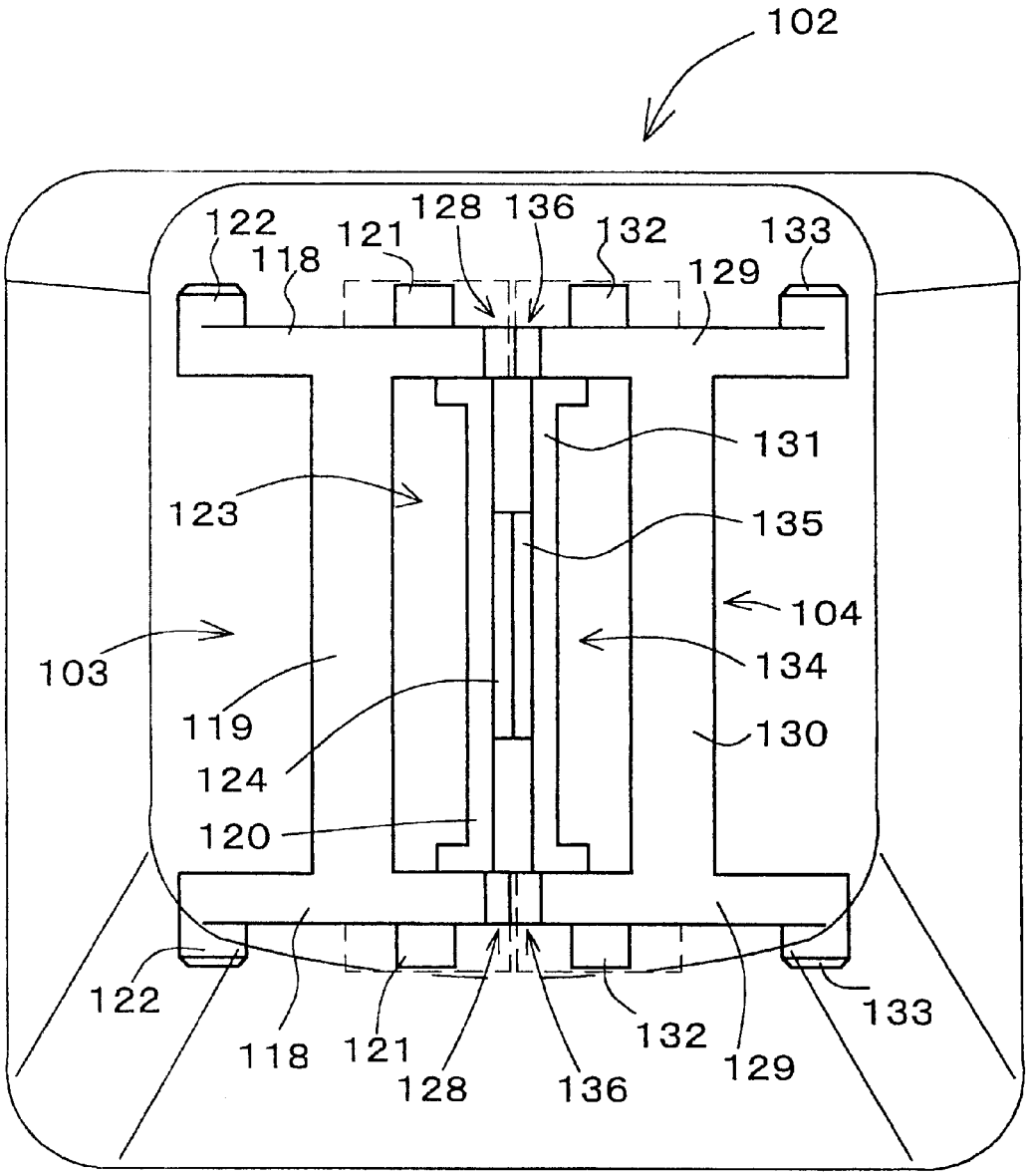
FIG. 25 is a plan view of the key switch device in which the first and second link members are assembled, which are seen through the key top held in the non-depression state.

FIG. 25 is a plan view of the key switch device in which the first and second link members are assembled, which are seen through the key top held in the non-depression state. In FIG. 25, the first cam portion 124 of the first link member 103 and the second cam portion 135 of the second link member 104 are in the first contact state where they are brought into contact with each other. In the first contact state, the plate spring portion 120 of the first link member 103, and the plate spring portion 131 of the second link member 104 are not warped, although the first cam portion 124 and the second cam portion 135 are urged in a direction toward which the first cam portion 124 and the second cam portion 135 are brought into contact with each other. If a pre-load is needed, each of the plate spring portions 120 and 131 is warped in accordance with the required amount of the pre-load.

Figure 24B:
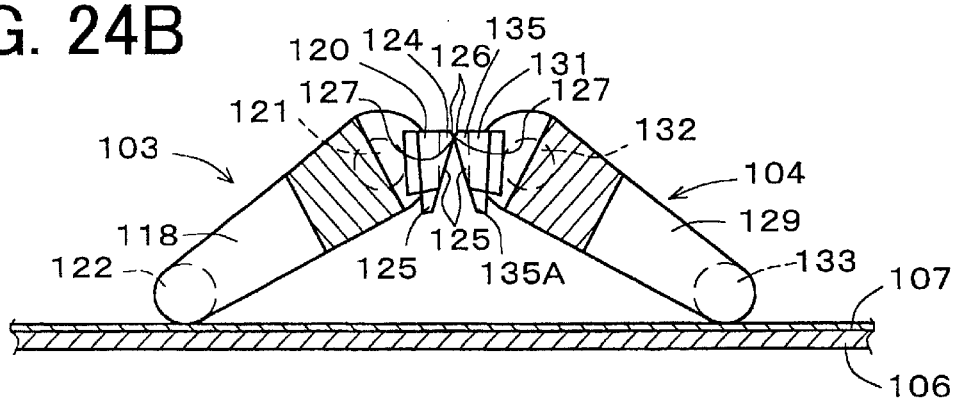
Figure 26:
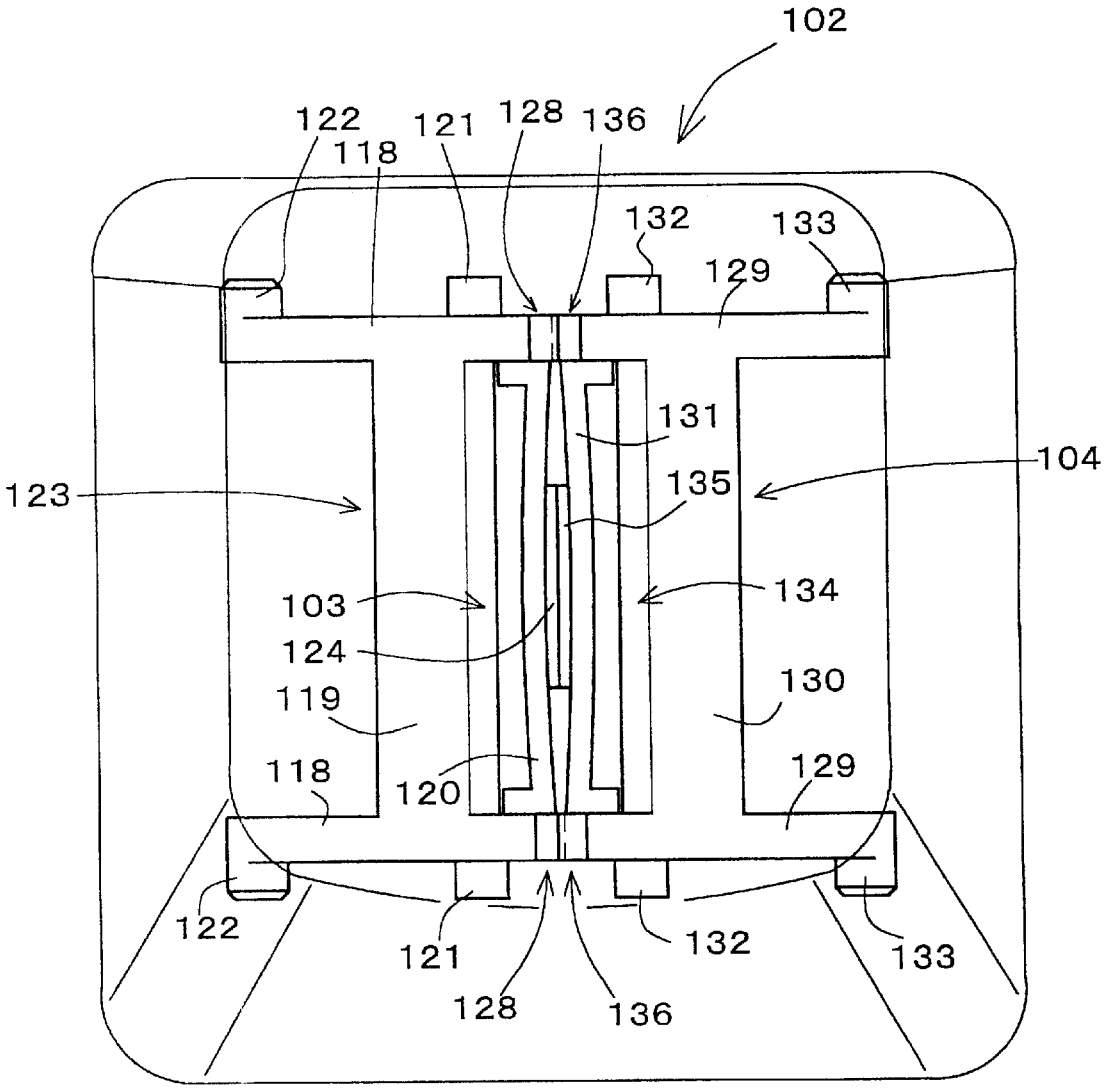
FIG. 26 is a plan view of the key switch device in which cam apexes of the first and second link members are in contact with each other in the depression of the key top.

When the depression of the key top 102 is started, the first shaft 121 of the first link member 103 is allowed to rotate clockwise in the engagement groove 108A in the engagement portion 108, while the third shaft 132 of the second link member 104 is allowed to rotate counterclockwise in the engagement groove 109A in the engagement portion 109, as the key top 102 is depressed. At the same time, the second shaft 122 of the first link member 103 shifts leftwards in the engagement groove 117A in the engagement member 117, while the fourth shaft 133 of the second link member 104 shifts rightwards in the engagement groove 117A in the engagement member 117. At this time, the first cam surface 125 of the first cam portion 124 is gradually distanced from the first cam surface 125 of the second cam portion 135. Then, the first cam portion 124 and the second cam portion 135 are brought into contact with each other at their respective cam apexes 127. This state is shown in FIG. 24B. In this state, as shown in FIG. 26 seen from above, the warpage of each of the plate spring portions 120 and 131 is maximum, and accordingly, the urging forces that each of the plate spring portions 120 and 131 exerts on the first cam portion 124 and the second cam portion 135 respectively become maximum. As a result, the depressing load on the key top 102 becomes maximum.

As has been described above, the cam apex 127 of the first cam portion 124 is formed with a projection 127A, while the cam apex 127 of the second cam portion 135 is formed with a depressed groove 127B. The projection 127A is fitted in the depressed groove 127B, even when the first cam portion 124 is brought into contact with the second cam portion 135 through only the cam apexes 127. With this arrangement, there arises no problem that the cam apexes 127 come off from each other, thereby providing complete synchronous relation between the first cam portion 124 and the second cam portion 135.

Figure 24C:
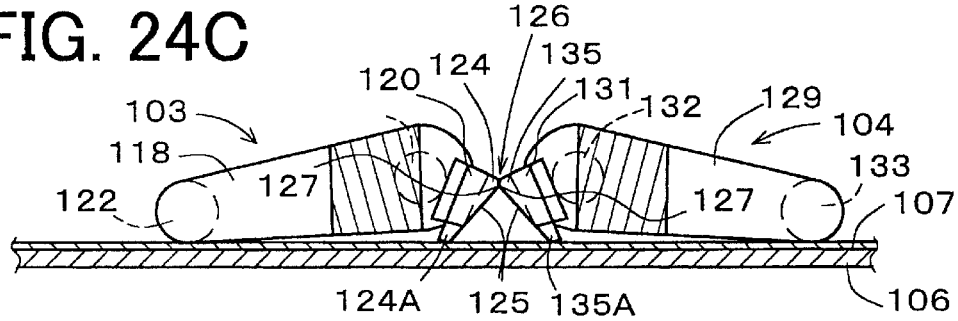

As the key top 102 is further depressed, the second cam surfaces 126 of the first cam portion 124 and the second cam portion 135 gradually come close to each other. This state is shown in FIG. 24C. In this state, the warpage of each of the spring plate sections 120 and 131 is smaller than that of the states shown in FIGS. 24B and 26. The urging force exerted on the first cam portion 124 and the second cam portion 135 by each of the plate spring portions 120 and 131 is gradually decreased, and the depressing load on the key top 102 is decreased accordingly.

Before the second cam surface 126 of the first cam portion 124 is brought into contact with the second cam surface 126 of the second cam portion 135, the resinous elastic piece 124A provided on the bottom end of the first cam portion 124 and the resinous elastic piece 135A provided on the bottom end of the second cam portion 135 push the upper film sheet 114 in the membrane switch sheet 107. As a result, the movable electrode pattern 113 formed on the lower surface of the upper film sheet 114 is brought into contact with the fixed electrode pattern 110 on the lower film sheet 112 via the switching hole 115 in the film spacer 116, thereby conducting a specified switching operation. At substantially the same time or after the switching operation, the second cam surfaces 126 of the first and second cam sections 124 and 135 are brought into contact with each other. Since the second cam surfaces 126 are brought into contact with each other after the switching operation is conducted, each of the resinous elastic pieces 124A and 135A can effect the pushing operation in a stable manner, and chattering and the like can be prevented.

Figure 24D:
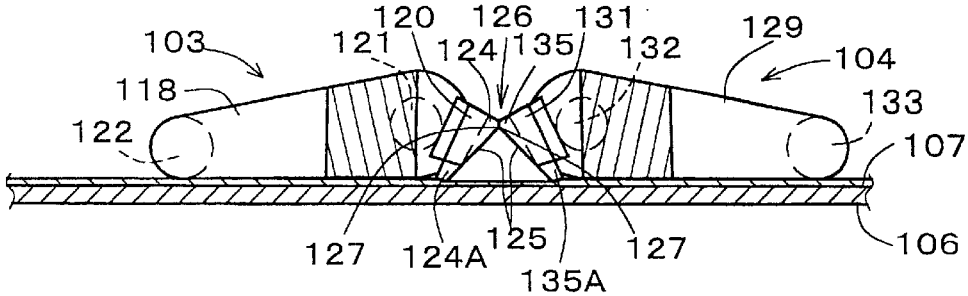

FIG. 24D shows the state where the second cam surfaces 126 are in contact with each other. In this state, the warpage of each of the plate spring portions 120 and 131 is further smaller than that of the state shown in FIG. 24C. The urging force exerted on each of the first cam portion 124 and the second cam portion 135 by each of the plate spring portion 120 and 131 are further reduced accordingly. As a result, the depressing load on the key top 102 is accordingly decreased.

Figure 27:
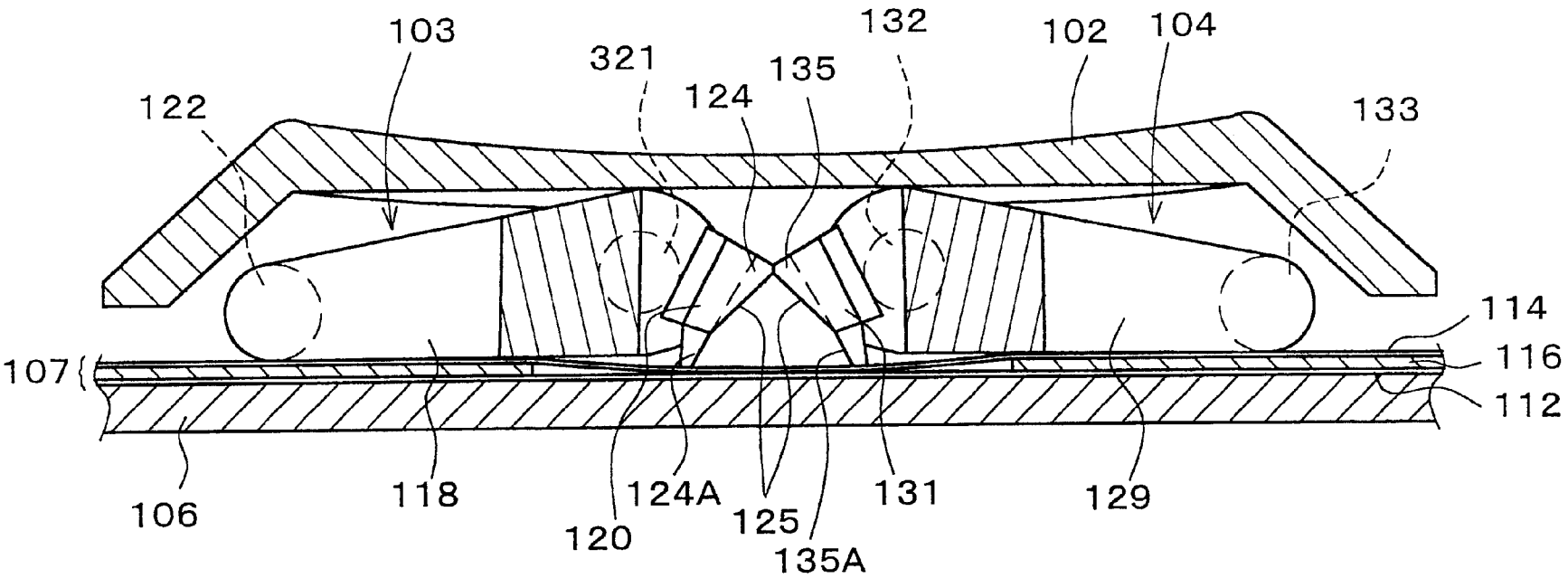
FIG. 27 is a sectional view schematically showing a key switch device when the switching operation is conducted.

As has been described above, in the state where the second cam surface 126 of the first cam portion 124 is brought into contact with the second cam surface 126 of the second cam portion 135, the resinous elastic piece 124A provided on the bottom end of the first cam portion 124 and the resinous elastic piece 135A provided on the bottom end of the second cam portion 135 push the upper film sheet 114 in the membrane switch sheet 107. In this manner, the movable electrode pattern 113 formed on the lower surface of the upper film sheet 114 is brought into contact with the fixed electrode pattern 110 on the lower film sheet 112 via the switching hole 115 in the film spacer 116. This state where the switching operation is conducted is shown in FIG. 27. FIG. 27 is a sectional view schematically showing the key switch device 101 at the switching operation. It can be seen in FIG. 27 that the upper film sheet 114 is pushed by the resinous elastic pieces 124A and 135A, and as a result, the upper film sheet 114 is brought into contact with the lower film sheet 112.

It is desirable that the resinous elastic piece 124A and the resinous elastic piece 135A are simultaneously brought into contact with the upper film sheet 114, and push it. However, even in the case where, for example, only the resinous elastic piece 124A is brought into contact with the upper film sheet 114, immediately after that, the resinous elastic piece 135A is brought into contact with the upper film sheet 114 subsequently. With this arrangement, even if vibrations occurs in the upper film sheet 114 due to the contact of the resinous elastic piece 124A with the upper film sheet 114, such vibrations generated in the upper film sheet 114 can be stopped when the resinous elastic piece 135A is brought into contact with the upper film sheet 114. Thus, chattering generated at the switching operation can be reliably prevented.

The resinous elastic pieces 124A and 135A are elastically deformed when the key top 102 is further pushed from the state shown in FIG. 24D. Therefore, the resinous elastic pieces 124A and 135A absorb the amount of the movement of the key top 102, thereby achieving a so-called over-travel of the key top 102.

Upon release of the depression of the key top 102 after the switching operation as described above, the key top 102 is moved reversely to the above based on the urging force of the plate spring portion 120 of the first link member 103 and the plate spring portion 131 of the second link member 104. Finally, the key top 102 is returned to the non-depression position shown in FIG. 24A.

Figure 28:
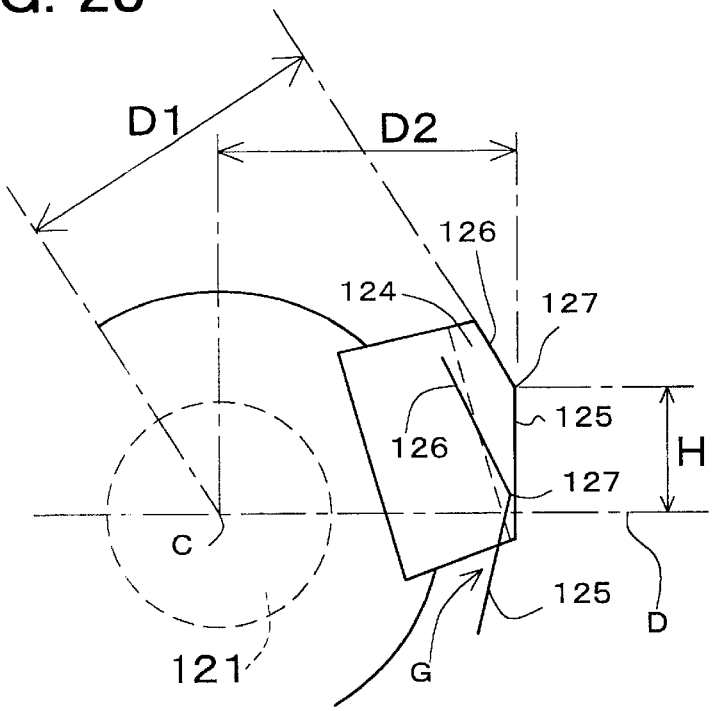
FIG. 28 is an explanatory diagram schematically showing the condition for forming the first and second cam portions.

In order to return the key top 102 to the original non-depression position by the urging forces of the plate spring portions 120 and 131, the following condition is needed. That is, at the switching operation, the contact point between the cam apexes 127 of the first and second cam portions 124 and 135 is needed to be positioned above a straight line connecting the center of the first shaft 121 of the first link member 103 to the center of the third shaft 132 of the second link member 104. This condition is explained below with reference to FIG. 28. FIG. 28 is an explanatory diagram schematically showing the condition for forming the first cam portion 124 and the second cam portion 135.

In FIG. 28, a straight line connecting the center C of the first shaft 121 of the first link member 103 to the center (not shown) of the third shaft 132 of the second link member 104 is indicated by a one-dotted line D. In addition, an outside shape of the first cam portion 124 at the time when the switching operation is conducted is shown by a line G. In the state shown in FIG. 28, it is necessary that the cam apex 127 of the first cam portion 124 shown by the outside shape G (at this time, the cam apex 127 of the second cam portion 135 is present at an identical position to the cam apex 127 of the first cam portion 124) is present at a position above the straight line D. In this configuration, the rotating moment based on the urging force of the plate spring portions 120 and 131 acts onto the first cam portion 124 in the state shown by the outside shape G toward an upward direction. With this arrangement, the key top 102 can be shifted upwards only by the urging force of the plate spring portions 120 and 131 without the need of rubber spring or other urging mechanisms.

Similarly, in order to generate the moment for allowing the first link member 103 and the second link member 104 to rotate in an upward direction based on the urging force of the plate spring portions 120 and 131 at the time when the switching operation is conducted, it is necessary that a distance D2 between the center of the first shaft 121 (the third shaft 132) and the second cam surface 126 is set to be larger than a distance D1 between the center of the first shaft 121 (the third shaft 132) and the first cam surface 125.

In this case, a distance H between the straight line D and the cam apex 127 (i.e. a height of the cam apex 127 measured from the straight line D) is a factor in determining the load (peak load) applied to the key top 102 in the state shown in FIG. 24B.

[Modeling according to third embodiment]

Figure 29:
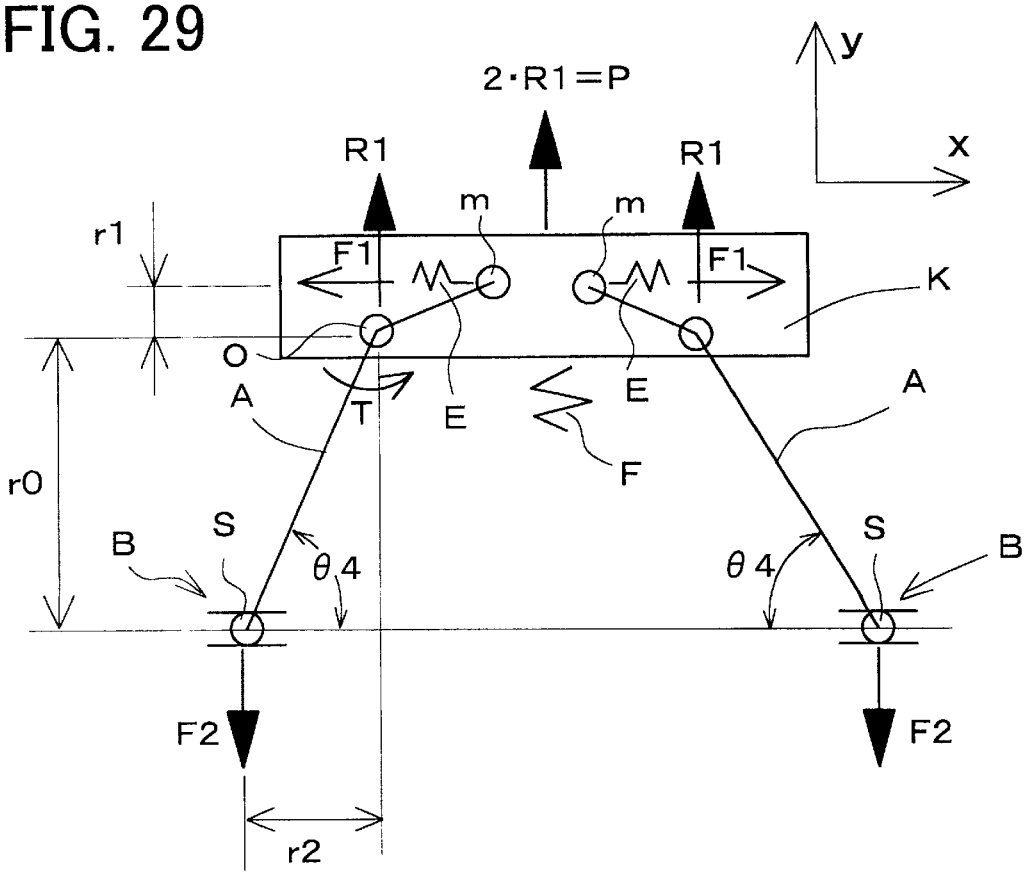
FIG. 29 is an explanatory diagram of a model 3 for schematically showing a modeled key switch device.
Figure 30:
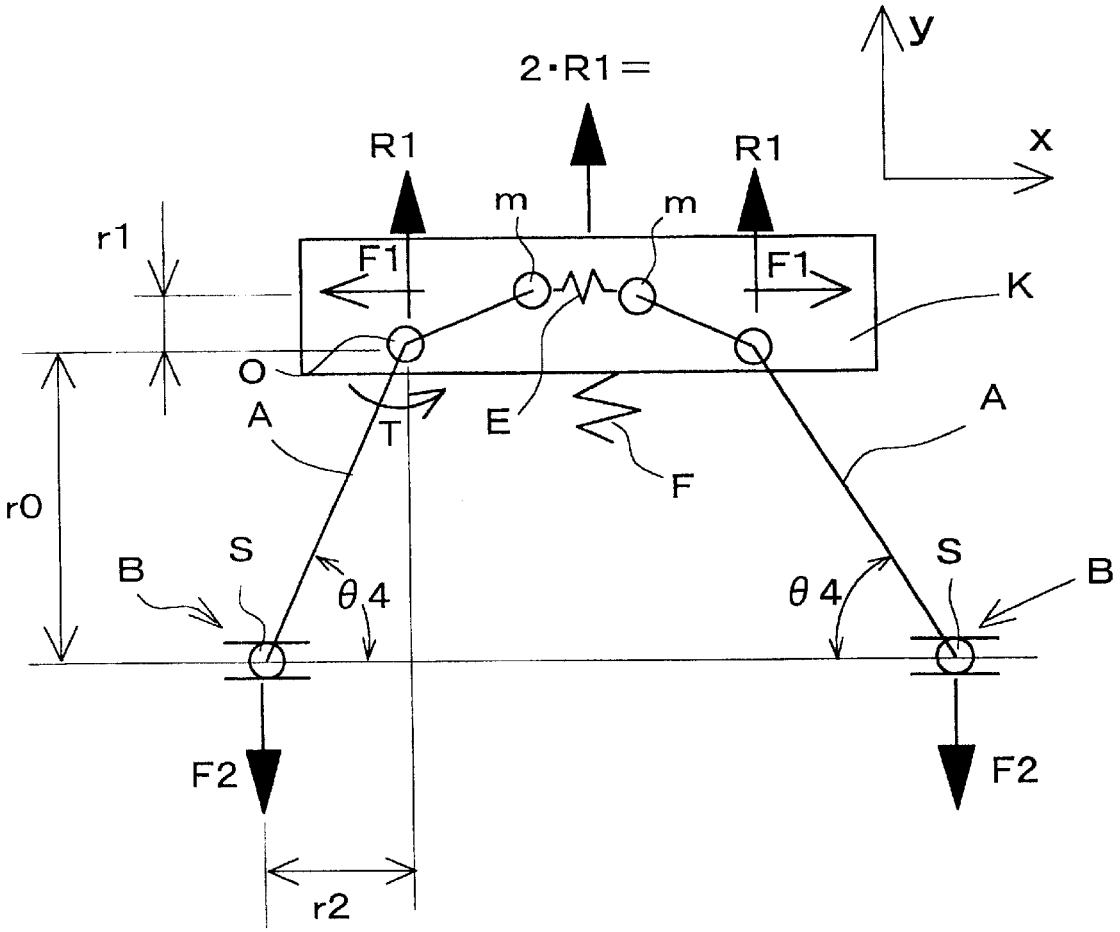
FIG. 30 is an explanatory diagram schematically showing an equivalent to the model 3.
Figure 31:
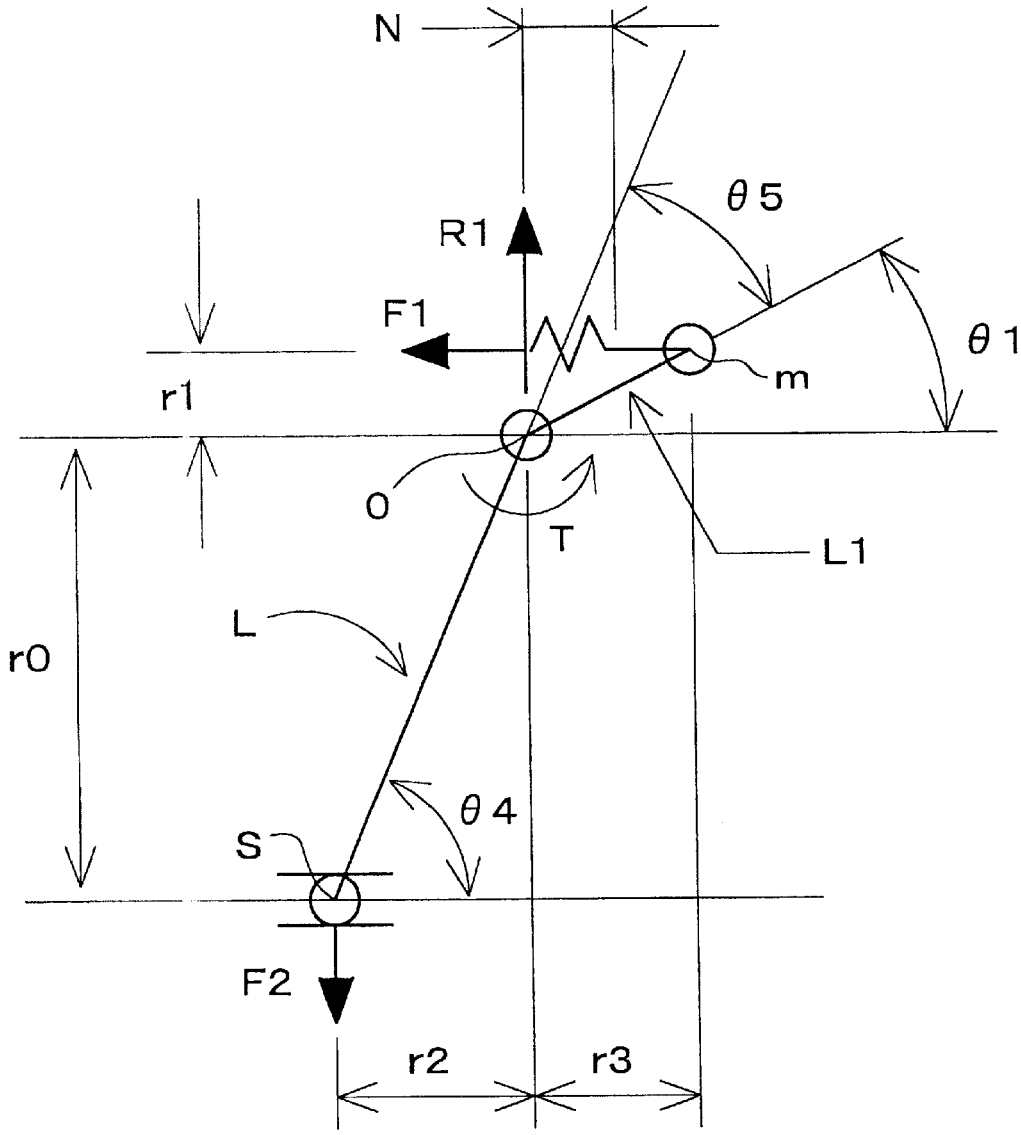
FIG. 31 is an explanatory diagram schematically showing an enlarged view of one side of the model 3 shown in FIG. 29.

Next, a key switch device 10 in the third embodiment of the present invention is modeled into a model 3, and the principle of performing a key clicking function in the model 3 will be described with reference to FIGS. 29 to 31. FIG. 29 is an explanatory diagram of the model 3 for schematically showing a modeled key switch device 10. FIG. 30 is a diagram schematically showing the modeled case where the urging force of the coil spring 15 in the key switch device 10 of the first embodiment is exerted on each point (i.e. a joint point m) which is present at a position upper than the support shaft 23 of the first link member 12 and the support shaft 26 of the second link member 13. It is obvious that the model 3 shown in FIG. 29 is equivalent to the model shown in FIG. 30. FIG. 31 is an explanatory diagram schematically showing an enlarged view of one side of the model 3 shown in FIG. 29.

In FIGS. 29 and 30, rigid bodies A represent the first link member 103 and the second link member 104 respectively, a rigid body K represents the key top 102, and rigid bodies represent the engagement members 117, respectively. Alphabetical marks o represent a rotation center of the first support shaft 121 of the first link member 103 received in the engagement groove 108A of the engagement portion 108 in the key top 102, and a rotation center of the third support shaft 132 of the second link member 104 received in the engagement groove 109A of the engagement portion 109 in the key top 102. Alphabetical marks s represent a slide starting point from which the second shaft 122 of the first link member 103 starts to slide outwardly in the engagement member 117, and a slide starting point from which the fourth support shaft 133 of the second link member 104 starts to slide outwardly in the engagement member 117.

In the model 3 shown in FIG. 29, alphabetical marks m represent an acting point of applying the outwardly urging force exerted by the plate spring portion 120 of the first link member 103 to the first cam portion 124, and a point of exerting the outwardly urging force of the plate spring portion 131 of the second link member 104 on the first cam portion 135.

In the equivalent model shown in FIG. 30, alphabetical marks m represent an acting point of applying the urging force of the coil spring 15 to a position upper than the support shaft 26 in the first link member 12, and a point of applying the urging force of the coil spring 15 to a position upper than the support shaft 26 in the second link member 13 respectively.

Marks θ4 represent an angle between the first link member 103 in an inclined state and a sliding direction of the second shaft 122 thereof, and an angle between the second link member 104 in an inclined state and a sliding direction of the fourth shaft 133 thereof at each slide starting point s, respectively. In addition, a mark θ5 represents an angle between the lengthwise direction of each of the first and second link members 103 and 104, and the straight line passing through two joint points o and m. A mark θ1 represents an angle between the straight line passing through the two joint points o, m, and the horizontal line passing through the joint point o.

In FIGS. 29 and 30, each of the model 2 and the equivalent model thereto includes: two rigid bodies A each having three points, that is, a joint point (i.e. rotation point) o, a joint point (i.e. acting point) m, and a joint point (i.e. slide starting point) s; a rigid body K which rotatably supports the rigid bodies A at the joint points o; and rigid bodies B each of which allows each rigid body A to be slidable from the joint point s in a direction x (i.e. in a horizontal direction). The rigid body K can move in a direction y (i.e. in a vertical direction).

As shown in FIGS. 29 and 30, when two rigid bodies A are coupled to each other via an elastic body E (corresponding to the plate spring portions 120 and 131 in the model 3, and corresponding to the coil spring 15 in the equivalent model), a force F1 is generated, and accordingly, a force P in the direction y is generated in the rigid body K. When the rigid body K is moved in a direction −y (i.e. in a downward direction), the force P is expressed by a function of angle between the joint points 0, m, and s, and a curve of the function has a maximum point in the shape of projection as shown in FIG. 11. Then, an elastic body F (corresponding to an elastic piece 28) acts from a position where the switching operation is conducted, and the curve continues to a curve OT.

The principle of operation of the above model 3 will be described below with reference to FIGS. 29 and 30.

In FIGS. 29 and 30, each of the forces r1, r3, F1, L1, N, and S are applied in the opposite directions with respect to the joint point o. Each of the forces can be expressed in the following equations, with a negative sign (−) applied in each of them.

(1) As to r2:

Referring to FIG. 31, the equations 7, 8, and 9 established for the model 1 in the first embodiment described above are also established for the model 3.

Therefore, r2 can be expressed as follows:

$$r2=r0/\tan\theta4.$$

(2) As to r1:

From FIG. 31, r1 can be expressed by the following equation 30:

$$-r1=\sin\theta1\cdot-L1 \quad \text{(Eq. 30)}$$

Multiplying both sides of the equation 30 by −1 gives an equation identical to the equation 10 described above. As a result, as is the case of the model 1 of the first embodiment, the equations 10 to 16 are established.

Therefore, r1 can be expressed by the equation 16 described above.

(3) As to r1/r2:

As to r1/r2, the equations 9 and 16 obtained for the model 1 of the first embodiment are substituted. As a result, the same results as those obtained from the equations 17 to 21 described above are obtained.

(4) As to F1:

From FIG. 31, on the following definitions:

−F1; load (N),

−S; initial tension (N), k; spring constant (N/mm),

M; length of spring (mm), $$M=-r3=-L1\cdot\cos\theta1=-L1\cdot\cos(\theta4-\theta5)$$

−N; free length of spring (mm), u; deflection coefficient of spring =2, the spring length M can be expressed by the following equation 31:

$$M=-r3=-L1\cdot\cos\theta1=-L1\cdot\cos(\theta4-\theta5)+tm \quad \text{(Eq. 31)}$$

Based on the equation 31, the load −F1 can be expressed by the following equations 32, 33, and 34:

$$-F1=k\cdot u\cdot(M-(-N))+(-S) \quad \text{(Eq. 32)}$$

$$-F1=k\cdot(u\cdot-L1\cdot\cos(\theta4-\theta5)+N)-S \quad \text{(Eq. 33)}$$

$$-F1=-k\cdot u\cdot L1\cdot\cos(\theta4-\theta5)+ukN-S \quad \text{(Eq. 34)}$$

Multiplying both sides of the equation 34 by −1 gives an equation identical to the equation 24 described above. Therefore, the same result as that from the equation 25 can be obtained for F1.

(5) As to P:

As is the case of the model 1 of the first embodiment, as to P, the equations 20 and 24 are substituted into the equation 5. As a result, the same result as that of the equation 26 can be obtained. Therefore, P can be expressed by the equation 26.

Here, θ4 is obtained in the following mathematical relationship: θ4=sin−1 (r0/L).

In the equation 26 obtained as above for expressing the depressing load P, in consideration of a movement of the rigid body K in the case where the structures of the rigid bodies K, A, and B, and the elastic body E are determined in the equation 26 obtained as described above, L, L1, and sin θ5 are constants of the rigid body A, and are at constant values with respect to r0. In addition, k, u, N, and S are constants of the elastic body E, and are at constant values with respect to r0.

Therefore, the equation 26 becomes a function of the angle θ4, and the curve of the depressing load P expressed by the equation 26 becomes a load curve having a maximum point in the shape of projection as is the case of the model 1 shown in FIG. 11.

As described above, in the key switch device 11 in the third embodiment, as is the case of the first embodiment, the depressing load on the key top 11 when depressed is defined by a function (i.e. the equation 26) expressed by: a distance L between the rotation point o of the support shaft 30 of the first link member 12 at the first engagement portion 17 in the key top 11, and the slide starting point s of the support shaft 26 of the first link member 12 at the third engagement portion 40; a distance L1 between the rotation point o, and the acting point m at which the force exerted by the coil spring 15 acts on the first link member 12; an angle θ4 between a line segment extending from the rotation point o to the slide starting point s, and the direction along which the support shaft 26 of the first link member 12 at the third engagement portion 40 is allowed to slide; and various characteristic values of the coil spring 15. The depressing load curve P defined by this function becomes a curve having a maximum point P1 in the shape of an upward projection. Based on the difference in loads between the maximum point P1 and the minimum point P2 from which the depressing load is increased after the switching operation is conducted by a membrane switch sheet 16, the key clicking function is performed. Therefore, the key clicking function can be evaluated from the depressing load curve P obtained through a simulation conducted by setting the rotation points o, the slide starting points S, the acting points m, the angles θ4, and various characteristics values of the coil spring 15 to various values. In this manner, it becomes possible to realize a key switch device having an excellent key operability with a desired key clicking function in a short period at a low cost by suppressing the number of trials for the key switching mechanism to the minimum.

Figure 32:
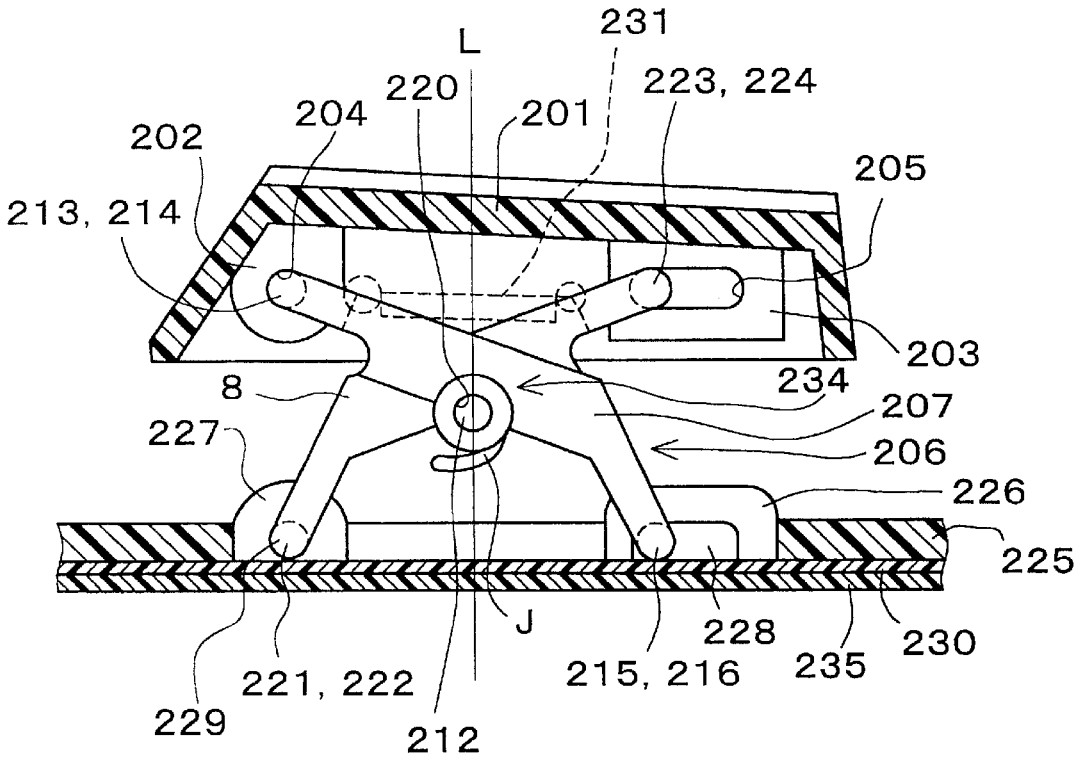
FIG. 32 is sectional view of a key switch device according to the fourth embodiment.

Next, a key switch device in a fourth embodiment will be described with reference to FIGS. 32 to 34. FIG. 32 is sectional view of a key switch device in the fourth embodiment. In FIG. 32, the key top 201 is formed by molding a synthetic resin such as an ABS resin and the like, and is formed with a character such as an alphabet and the like on its top surface by printing and the like. On the underside of the key top 201, an engagement portion 202 and an engagement portion 203 are integrally formed with the main body of the key top 201 in a downward direction.

The engagement portion 202 is formed with a bearing hole 204 for rotatably receiving first engagement pins 213 and 214 which are formed at one end of a link member 207 among two link members 207 and 208 described later. The engagement portion 203 is formed with an engagement groove 205 for slidably, in a horizontal direction, receiving second engagement pins 223 and 224 which are formed at one end of the other link member 208.

Below the key top 201, a guide supporting member 206 for guiding and supporting the vertical movement of the key top 201 is provided. The guide supporting member 206 is made up of two link members 207 and 208.

Figure 33:
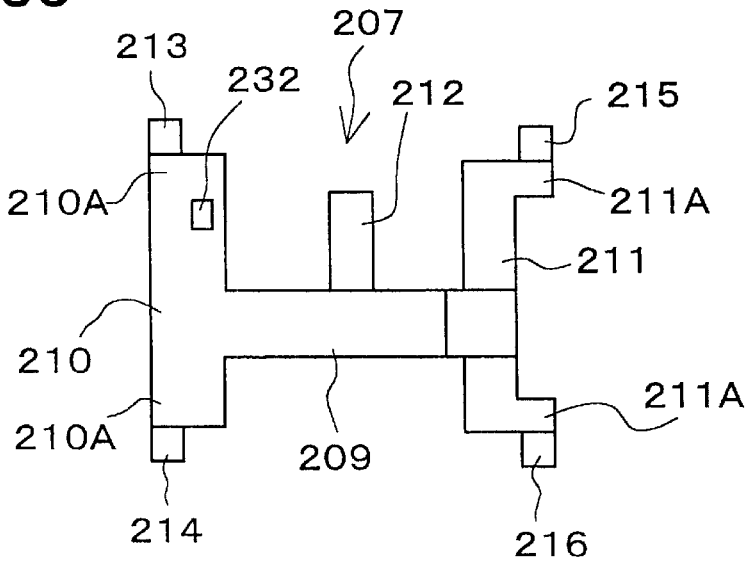
FIG. 33 is a plan view of one of link members in the fourth embodiment.

The link member 207 includes two base end portions 210 and 211 each integrated with each end of the base portion 209, as shown in FIG. 33. A shaft 212 is provided extending from the center of one side surface of the base portion 209. The shaft 212 is pivotally supported so as to be rotatable in a shaft hole 220 formed in the other link member 208.

As shown in FIG. 32, the link member 207 is configured such that the first engagement pins 213 and 214, and, the second engagement pins 215 and 216, are provided in aligned relation with each other, and in parallel with the shaft 212 at the same distance therefrom. In addition, the link member 208 is configured such that the first engagement pins 221 and 222, and, the second engagement pins 223 and 224, are provided in aligned relation with each other, and in parallel with the shaft hole 220 and at the same distance therefrom.

As shown in FIG. 32, in the link members 207 and 208, the top end portion of each of the upper base end sections 210 and 219 is thin in thickness. In this manner, during depression of the key top 201, the top base end sections 210 and 219 of the link members 207 and 208 are not brought into contact with the lower base end sections 211 and 218 of the link members 207 and 208. The key top 201 can be depressed without being interrupted, thereby assuring a sufficient key stroke.

As shown in FIG. 33, the link member 207 includes the first engagement pins 213 and 214 projecting from side surfaces of both end extending sections 210A of the upper base end portion 210. The first engagement pins 213 and 214 are rotatably engaged in the bearing hole 204 formed in the engagement portion 202 of the key top 201. The lower base end portion 211 has a substantially U-shaped configuration as viewed in plan. As is the case described above, the second engagement pins 215 and 216 are provided projecting from side surfaces of both end extending sections 211A of the lower base end portion 211. The second engagement pins 215 and 216 are slidably engaged in the engagement portions 226 formed in a holder member 225 which will be described below. The upper base end portion 210 of the link member 207 has an engagement hole 232 for engaging one end of the coil spring 231.

Figure 34:
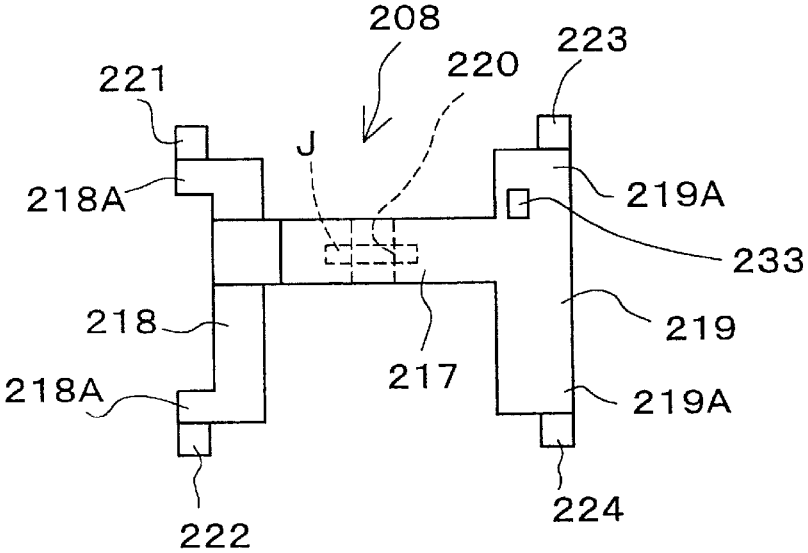
FIG. 34 is a plan view of the other link member in the fourth embodiment.

As shown in FIG. 34, the link member 208 includes two upper and lower base end sections 218 and 219 each integrated with each end of the base portion 217. A shaft hole 220 is formed in the center of the base portion 217. A shaft 212 provided in the base portion 209 of the link member 207 as described above is inserted in the shaft hole 220. The lower base end portion 218 has a substantially U-shaped configuration as viewed in plan. From each of end extending sections 218A of the U-shaped lower base end portion 218, each of the first engagement pins 221 and 222 projects. The first engagement pins 221 and 222 are rotatably engaged in the engagement portions 227 formed in the holder member 225 which will be described later.

From each of the end extending sections 219A of the upper base end portion 219, each of second engagement pins 223 and 224 having the same structure as described above is projected. The second engagement pins 223 and 224 are slidably engaged in the engagement groove 205 formed in the engagement portion 203 of the key top 201. The upper base end portion 219 of the link member 208 has an engagement hole 233 which engages the other end of the coil spring 231 and corresponds to the engagement hole 232 of the link member 207.

As described above, the guide supporting member 206 is constructed by inserting the shaft 212 formed in the base portion 209 of the link member 207 into the shaft hole 220 formed in the base portion 217 of the other link member 208. The link members 207 and 208 are rotatable with respect to each other about a shaft supporting portion 234 constituted by the shaft 212 and the shaft hole 220. In the guide supporting member 206, one end of the coil spring 231 is engaged in the engagement hole 232 of the link member 207. On the other hand, the other end of the coil spring 231 is engaged in the engagement hole 233 of the link member 208. In this structure, each of the link members 207 and 208 are urged respectively by the urging force of the coil spring 231 so that respective lower ends are moved to each other in the closing direction.

A holder member 225 is provided below the guide supporting member 206. On the holder member 225, an engagement portion 226 and an engagement portion 227 are provided. The engagement portion 226 engages the second engagement pin 215 and 216 projecting from the lower base end portion 211 of the link member 207. The engagement portion 227 engages the first engagement pins 221 and 222 projecting from the lower base end portion 218 of the link member 208.

The engagement portion 226 is integrally formed in an upward projecting shape in the holder 225, and is formed with an engagement groove 228 providing a rectangular hole. The second engagement pins 215 and 216 of the link member 207 are slidably, in a horizontal direction, engaged in the engagement groove 228. In the state where the key top 201 is the non-depression state, as shown in FIG. 32, each of the engagement pins 215 and 216 is brought into contact with the left side wall portion of the slide groove 228. The engagement portion 227 is integrally formed in an upward projecting shape in the holder member 225, and is formed with a bearing hole 229, as is the case of the engagement portion 226. The first engagement pins 221 and 222 of the link member 208 are rotatably engaged in the bearing hole 229.

In the structure described above, a bearing hole 204 is provided to an engagement portion 202 formed at the underside of the key top 201 at a left side with respect to the perpendicular line L passing through the center of the shaft supporting portion 234 in FIG. 32. On the other hand, a bearing hole 229 is provided to an engagement portion 227 formed on the holder member 225 at a left side with respect to the perpendicular line L passing through the center of the shaft supporting portion 234 in FIG. 32 as well. The bearing holes 204 each rotatably engage the first engagement pins 213 and 214, and the bearing holes 229 each rotatably engage the first engagement pins 221 and 222. In addition, an engagement groove 205 is formed in the engagement portion 203 formed on the underside of the key top 201 at the right side with respect to the perpendicular line l in FIG. 1. On the other hand, an engagement groove 228 is formed in the holder member 225 at a right side with respect to the perpendicular line L in FIG. 1. The engagement grooves 205 each slidably, in a horizontal direction, receive the second engagement pins 223 and 224, and the engagement grooves 228 each slidably, in a horizontal direction, receive the second engagement pins 215 and 216.

When the key top 201 is in the non-depression state, the perpendicular line L passing through the shaft supporting portion 234 passes through an intermediate position between the center of the bearing hole 204 of the engagement portion 202 (i.e. the center of shaft of each of the first engagement pins 213 and 214), and the center of the shaft of each of the second engagement pins 223 and 224 received in the engagement groove 205 in the engagement portion 203 and in contact with the left side wall thereof. The key switch device has a symmetric structure with respect to the perpendicular line L.

As is the case of the key switch device of the first embodiment, a membrane switch sheet 230 is provided below the holder member 225. The membrane switch sheet 230 has a three-layered structure including an upper switching sheet, a lower switching sheet, and a spacer sheet interposed therebetween. The membrane switch sheet 230 has a switching portion which is pushed by the shaft supporting portion 234 when the key top 201 is depressed, so as to conduct a switching operation.

A switch supporting plate 235 is provided below the switching sheet 230. The switch supporting plate 235 supports the membrane switch sheet 230, the holder member 225, and the guide supporting member 206 which supports the key top 201.

Next, operation of the key switch device having the structure described above will be described. As the key top 201 is depressed to move downwards, the first engagement pins 213 and 124 of the link member 207 rotate counterclockwise in the movable hole 204 of the engagement portion 202, while the second engagement pins 223 and 224 of the link member 208 slide in a horizontal direction (i.e. in a right direction in FIG. 32) within the engagement groove 205 of the engagement portion 203. At the same time, the first engagement pins 221 and 222 of the link member 208 rotate clockwise in a bearing hole 229 of the link member 208, while the second pins 215 and 216 slide in a horizontal direction (i.e. in a right direction in FIG. 32) within the engagement groove 228 of the engagement portion 226.

As a result, an elastic piece J attached to the shaft supporting portion 234 which pivotally supports the link members 207 and 208 with respect to each other is shifted downwards. Simultaneously, the elastic piece J presses the switching portion of the membrane switch sheet 230 while performing a key clicking function which will be described below. In this manner, a specified switching operation is conducted.

When the depression of the key top 201 is released, the shaft supporting portion 234 is pushed up by the force of the coil spring 231. In accordance with this action, the first engagement pins 213,214,221,222, and the second engagement pins 215, 216, 223, 224 operate reversely to the above. As a result, the key top 201 is returned to an original position.

The first engagement pins 213, 214, 221, 222 are rotated only in the bearing holes 204 and 229 respectively, without horizontal motion. Therefore, the key top 201 is never shifted in a horizontal direction, and never hits an adjacent key. In this manner, the key top 201 is allowed to move vertically while its horizontal condition is maintained.

[Modeling according to fourth embodiment]

Figure 35:
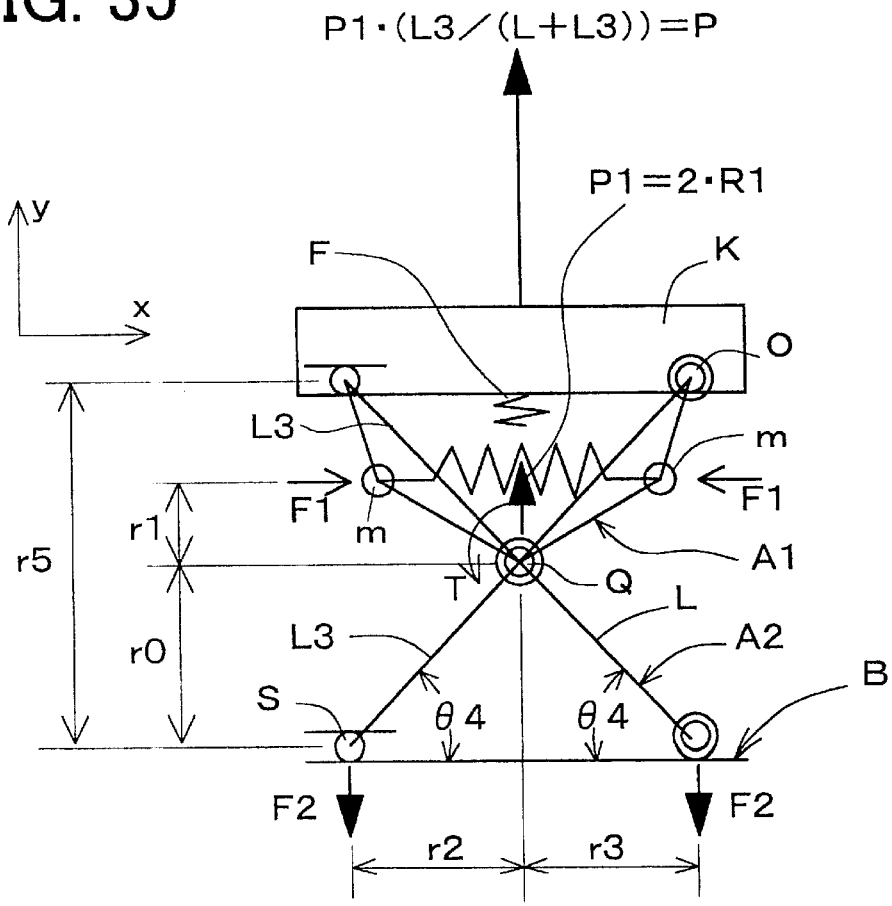
FIG. 35 is an explanatory diagram of a model 4 for schematically showing a modeled key switch device.
Figure 36:
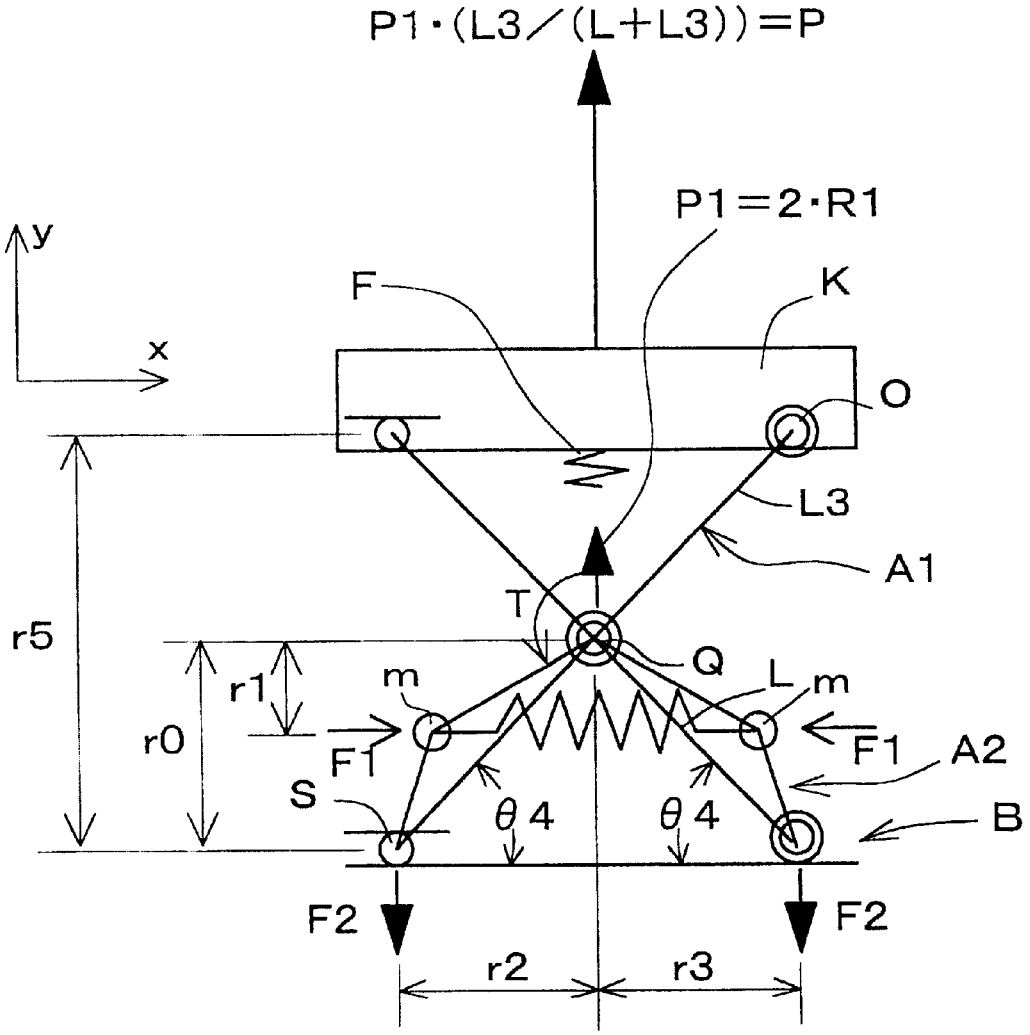
FIG. 36 is an explanatory diagram schematically showing an equivalent to the model 4.

Next, a key switch device in a fourth embodiment is modeled into a model 4, and the principle of performing a key clicking function in the model 4 will be described with reference to FIGS. 35 and 36. FIG. 35 is an explanatory diagram for illustrating the model 4 which schematically shows a modeled key switch device of the fourth embodiment. FIG. 36 is a diagram schematically showing the modeled case where the force exerted by the coil spring 231 in the key switch device of the fourth embodiment is applied to the acting point (i.e. a junction point m) present at a position lower than the shaft supporting portion 234 in each of the link members 207 and 208. It is obvious that the model 4 shown in FIG. 36 is equivalent to the model 4 shown in FIG. 35.

In FIG. 35, a rigid body A1 represents the link member 207, a rigid body A2 represents the link member 208, a rigid body K represents the key top 201, and a rigid body B represents the engagement portion 226 of the holder member 225. An alphabetical mark o represents a rotation center of the first engagement pin 213 of the link member 207 received in the engagement portion 202 in the key top 201.

An alphabetical mark s represents a slide starting point from which the support shaft 226 of the link member 207 starts to slide outwardly within the slide groove 228. Alphabetical marks m represent an acting point of inwardly applying the urging force of the coil spring 231 at an engagement hole 232 of the link member 207 and an acting point of inwardly applying the urging force of the coil spring 231 at the engagement hole 233 of the link member 208, respectively.

Marks θ4 represent an angle between the link member 207 in an inclined state and a sliding direction of the first engagement pin 221 thereof, and an angle between the link member 208 in an inclined state and a sliding direction of the engagement pin 215 thereof at each slide starting point s, respectively. An alphabetical mark Q represents a shaft supporting point for pivotally supporting the link members 207 and 208.

In FIG. 35, the model 4 includes: two rigid bodies A1 each having three points, that is, a joint point (i.e. rotation point) o, an acting point m, and a slide starting point s; a rigid body K which rotatably supports the rigid body A1 at the joint points o; and a rigid body B which allows the rigid body A1 to be slidable from the joint point s in a direction x (i.e. in a horizontal direction). The rigid body K can move in a direction y (i.e. in a vertical direction).

As shown in FIG. 35, when the two rigid bodies A1 and A2 are coupled to each other via an elastic body E (corresponding to the coil spring 231), a force F1 is generated, and accordingly, a force P in the direction y is generated in the rigid body K. When the rigid body K is deformed in a direction −y (i.e. in a downward direction), the force P is expressed by a function of angle between the joints point o, m, and s with each other, and a curve of the function has a maximum point in the shape of projection as shown in FIG. 11. Then, an elastic body F (corresponding to an elastic piece J) acts from a position where the switching operation is conducted, and the curve continues to a curve OT.

The principle of operation in the model 4 will be described below with reference to FIGS. 35 and 36. In FIG.

35, when the rigid body K is deformed in the direction y, a rotation torque T is generated at the shaft supporting point Q. The torque T is expressed by the equation 1 mentioned above. The force F2 is expressed by the above-described equation 2. The reaction force R1 in a direction y is expressed by the above-mentioned equation 3.

Here, since the force F1 is a tension by the elastic body E, the force F1 is equally exerted on the two rigid bodies A1 and A2 at left and right sides. As a result, a force F2 and a reaction force R2 are generated in each of the rigid bodies A1 and A2 equally. That is, the force F2 and the reaction force R2 are expressed by the following equation 35:

$$2 \cdot F2 = 2 \cdot R1 = P1 \quad \text{(Eq. 35)}$$

In addition, the relationship between the F1, F2, and R2 is based on the link ratio, and the following equations 36 to 38 are established:

$$P1 = 2 \cdot (r1/r2) \cdot F1 \quad \text{(Eq. 36)}$$

$$P = P1 \cdot (L3/(L+L3)) \quad \text{(Eq. 37)}$$

$$P = 2 \cdot (r1/r2) \cdot F1 \cdot (L3/(L+L3)) \quad \text{(Eq. 38)}$$

(1) As to r2:

From FIG. 9 described above, as to r2, the equations 7 to 9 are established, as is the case of the model 1 of the first embodiment.

Therefore, r2 can be obtained from the equation 9 as follows: r2=r0/tan θ4.

(2) As to r1:

From FIG. 9, as to r1, the equations 10 to 16 are established, as is the case of the model 1 of the first embodiment.

Therefore, r1 can be obtained from the equation 16 as follows:

$$r1 = (L1 \cdot r0/L)(\cos \theta 5 - \sin \theta 5/\tan \theta 4)$$

(3) As to r1/r2:

As to r1/r2, the equations 17 to 21 are established, as is the case of the model 1 of the first embodiment.

Therefore, r1/r2 can be obtained from the equation 20.

Here, θ4 is obtained from the equation 21.

(4) As to F1:

From FIG. 9, on the following definitions:

F1; load (N),

S; initial tension (N), k; spring constant (N/mm),

M; length of spring (mm),

N; free length of spring (mm), u; deflection coefficient of spring =2,

As to F1, the equations 22 to 25 are established, as is the case of the model 1 of the first embodiment. Therefore, F1 can be obtained from the equation 25.

(5) As to P:

When the equations 20 and 25 described above are substituted into the equation 38, P can be expressed by the following equation 39:

$$P = 2 \cdot \left\{ \frac{L1}{L} \cdot (\tan\theta 4 \cdot \cos\theta 5 - \sin\theta 5) \right\} \cdot \{k \cdot u \cdot L1 \cdot \cos(\theta 4 - \theta 5) - ukN + S\} \cdot (L3/(L+L3)) \quad \text{(Eq. 39)}$$

Here, θ4 is obtained as follows: θ4=sin-1(r0/L) In consideration of a movement of the rigid body K in the case where the structures of the rigid bodies K, A, and B, and the elastic body E are determined in the equation 39 for expressing the depressing load P obtained as described above, L, L1, L3 and sin θ5 are constants of the rigid body A, and are at constant values with respect to r0. In addition, k, u, N, and S are constants of the elastic body E, and are at constant values with respect to r0.

Therefore, the equation 39 becomes a function of the angle θ4, and the curve of the depressing load P expressed by the equation 39 takes a shape of an upward projecting curve having a maximum point, as is the case of the model 1 shown in FIG. 11.

As described above, in the key switch device in the fourth embodiment, as is the case of the first embodiment, the depressing load applied to the key top 201 when the key top 201 is depressed is defined by a function (i.e. the equation 39) expressed by: a distance L between the rotation point o of the first engagement pin 213 of the link member 207 at the engagement portion 202 in the key top 201, and the slide starting point s of the second engagement pin 215 of the link member 207 at the engagement portion 226 in the holder member 225; a distance L1 between the rotation point o, and the acting point m at which the force exerted by the coil spring 231 acts on the link member 207; a distance L3 between the shaft supporting point Q, and the slide starting point s; an angle θ4 between a line segment extending from the rotation point o to the slide starting point s, and the direction along which the second engagement pin 215 of the link member 207 at sliding portion 226 is allowed to slide; and various characteristic values of the coil spring 231. The depressing load curve P defined by this function takes a shape of an upward projecting curve having a maximum point P1 as shown in FIG. 11. Based on the difference in loads between the maximum point P1 and the minimum point P2 from which the depressing load is increased after the switching operation is conducted by the membrane switch sheet 230, the key clicking function is performed. Therefore, the key clicking function can be evaluated from the depressing load curve P obtained through a simulation conducted by setting the rotation points o, the slide starting points s, the acting points m, the angles θ4, and various characteristics values of the coil spring 231 to various values. In this manner, it becomes possible to realize a key switch device having an excellent key operability with a desired key clicking function in a short period at a low cost by suppressing the number of trials for the key switching mechanism to the minimum.

The present invention is not limited to each of the embodiments described above, but it would be obvious that various modifications and variations thereof may be conducted without departing from the scope of the present invention.

For example, whereas two link members have the same length with each other in each of the embodiments, it is also possible to employ two link members different in length from each other in the models 1 to 4.

In addition, in the first and fourth embodiments, whereas the coil spring is used for applying a force to each of the link members, and the coil spring is mounted between the link members, it is also possible to engage one end of the coil spring with one of the link members, and to engage the other end of the coil spring with a fixed member such as a membrane switch sheet.

What is claimed is:

1. A key switch device including:

a key top provided at its underside with a first engagement portion and a second engagement portion;

a third engagement portion corresponding to the first engagement portion, and a fourth engagement portion corresponding to the second engagement portion, both of which are arranged below the key top;

a first link member provided with an upper end portion which is rotatably engaged in the first engagement portion and a lower end portion which is slidably engaged in the third engagement portion;

a second link member provided with an upper end portion which is rotatably engaged in the second engagement portion and a lower end portion which is slidably engaged in the fourth engagement portion;

an urging member for urging the first link member and the second link member in a direction to allow them to come close to each other; and a switching member for conducting a switching operation in association with vertical movement of the key top, the key switch device being designed to be symmetric with respect to a perpendicular line passing through a midpoint between the first engagement portion and the second engagement portion, wherein the upper end portion of the first link member is allowed to rotate about a predetermined rotation point in the first engagement portion, and the lower end portion of the first link member is allowed to slide outwardly from a predetermined slide starting point in the third engagement portion, an urging force of the urging member is exerted on the first link member at a predetermined acting point in the first link member, a depressing load applied to the key top when the key top is depressed is defined by a function expressed by:

a distance between the rotation point and the slide starting point; a distance between the rotation point and the acting point; an angle between a line segment extending from the rotation point to the slide starting point, and the direction along which the lower end portion of the first link member in the third engagement portion is allowed to slide; and various characteristic values of the urging member; and a curve of the depressing load defined by the function takes a shape of an upward projecting curve having a maximum point, and a key clicking function is performed based on a difference in loads between the maximum point and a point from which the depressing load starts to increase after the switching operation is conducted by the switching member.

2. The key switch device according to claim 1, wherein, when the key top is depressed, the key clicking function is performed during a time when the depressing load is decreased from the maximum point to the point from which the depressing load starts to increase in accordance with the depressing load curve.

3. The key switch device according to claim 1 further including:

a bearing hole formed in the first engagement portion; and a first support shaft which is formed at the upper end portion of the first link member and is rotatably engaged in the bearing hole, wherein the rotation point is determined by a center of rotation of the first support shaft engaged in the bearing hole.

4. The key switch device according to claim 1 further including:

a slide groove which is formed in the third engagement portion and has a wall portion; and a second support shaft which is formed at the lower end portion of the first link member and is slidably engaged in the slide groove, wherein the slide starting point is determined by a point at which the second support shaft engaged in the slide groove is brought into contact with the wall portion.

5. The key switch device according to claim 1, wherein the urging member is constructed of a spring having a first end portion and a second end portion, and the key switch device further including:

a first spring engagement portion provided in the first link member for engaging the first end portion of the spring; and a second spring engagement portion provided in the second link member for engaging the second end portion of the spring.

6. The key switch device according to claim 5, wherein the acting point is defined by a point at which the urging force of the spring is exerted on the first spring engagement portion.

7. The key switch device according to claim 5, wherein the spring includes a coil spring, and the characteristic values are determined by a plurality of factors which specify the urging load of the coil spring.

8. The key switch device according to claim 1, wherein the maximum point is in a range of 30 g to 100 g.

9. The key switch device according to claim 8, wherein the maximum point is in the range of 50 g to 70 g.

10. The key switch device according to claim 1, wherein the difference in loads between the maximum point and the point from which the depressing load starts to increase is 10 g or larger.

11. A keyboard provided with at least one key switch device according to claim 1.

12. An electronic apparatus including:

a keyboard for inputting various data such as characters, symbols, and others, the keyboard being provided with a key switch device including:

a key top provided at its underside with a first engagement portion and a second engagement portion;

a third engagement portion corresponding to the first engagement portion, and a fourth engagement portion corresponding to the second engagement portion, both of which are arranged below the key top;

a first link member provided with an upper end portion which is rotatably engaged in the first engagement portion and a lower end portion which is slidably engaged in the third engagement portion;

a second link member provided with an upper end portion which is rotatably engaged in the second engagement portion and a lower end portion which is slidably engaged in the fourth engagement portion;

an urging member for urging the first link member and the second link member in a direction to allow them to come close to each other; and a switching member for conducting a switching operation in association with vertical movement of the key top, the key switch device being designed to be symmetric with respect to a perpendicular line passing through a midpoint between the first engagement portion and the second engagement portion, wherein the upper end portion of the first link member is allowed to rotate about a predetermined rotation point in the first engagement portion, and the lower end portion of the first link member is allowed to slide outwardly from a predetermined slide starting point in the third engagement portion, an urging force of the urging member is exerted on the first link member at a predetermined acting point in the first link member, a depressing load applied to the key top when the key top is depressed is defined by a function expressed by:

a distance between the rotation point and the slide starting point; a distance between the rotation point and the acting point; an angle between a line segment extending from the rotation point to the slide starting point, and the direction along which the lower end portion of the first link member in the third engagement portion is allowed to slide; and various characteristic values of the urging member; and a curve of the depressing load defined by the function takes a shape of an upward projecting curve having a maximum point, and a key clicking function is performed based on a difference in loads between the maximum point and a point from which the depressing load starts to increase after the switching operation is conducted by the switching member;

display means for displaying the characters, symbols, and others; and control means for controlling the display means to display the characters, symbols, and others based on input data from the keyboard.

13. A key switch device including:

a key top provided at its underside with a first engagement portion and a second engagement portion;

a third engagement portion corresponding to the first engagement portion, and a fourth engagement portion corresponding to the second engagement portion, both of which are arranged below the key top;

a first link member provided with an upper end portion which is rotatably engaged in the first engagement portion and a lower end portion which is slidably engaged in the third engagement portion;

a second link member provided with an upper end portion which is rotatably engaged in the second engagement portion and a lower end portion which is slidably engaged in the fourth engagement portion;

an urging member for urging the first link member and the second link member in a direction away from each other; and a switching member for conducting a switching operation in association with vertical movement of the key top, the key switch device being designed to be symmetric with respect to a perpendicular line passing through a midpoint between the first engagement portion and the second engagement portion, wherein the upper end portion of the first link member is allowed to rotate about a predetermined rotation point in the first engagement portion, and the lower end portion of the first link member is allowed to slide outwardly from a predetermined slide starting point in the third engagement portion, an urging force of the urging member is exerted on the first link member at a predetermined acting point in the first link member, a depressing load applied to the key top when the key top is depressed is defined by a function expressed by:

a distance between the rotation point and the slide starting point; a distance between the rotation point and the acting point; an angle between a line segment extending from the rotation point to the slide starting point, and the direction along which the lower end portion of the first link member in the third engagement portion is allowed to slide; and various characteristic values of the urging member; and a curve of the depressing load defined by the function takes a shape of an upward projecting curve having a maximum point, and a key clicking function is performed based on a difference in loads between the maximum point and a point from which the depressing load starts to increase after the switching operation is conducted by the switching member.

14. The key switch device according to claim 13, wherein, when the key top is depressed, the key clicking function is performed during a time when the depressing load is decreased from the maximum point to the point from which the depressing load starts to increase in accordance with the depressing load curve.

15. The key switch device according to claim 13 further including:

a bearing hole formed in the first engagement portion; and a first support shaft which is formed at the upper end portion of the first link member and is rotatably engaged in the bearing hole, wherein the rotation point is determined by a center of rotation of the first support shaft engaged in the bearing hole.

16. The key switch device according to claim 13 further including:

a slide groove which is formed in the third engagement portion and has a wall portion; and a second support shaft which is formed at the lower end portion of the first link member and is slidably engaged in the slide groove, wherein the slide starting point is determined by a point at which the second support shaft engaged in the slide groove is brought into contact with the wall portion.

17. The key switch device according to claim 13, wherein the urging member is constructed of a first plate spring provided in the first link member and a second plate spring provided in the second link member, and the key switch device further including:

a first contact portion provided in the first link member, on which an urging force of the second spring is exerted; and a second contact portion provided in the second link member, on which an urging force of the first spring is exerted.

18. The key switch device according to claim 17, wherein the acting point is defined by a point at which the urging force of the second spring is exerted on the first contact portion.

19. The key switch device according to claim 13, wherein the maximum point is in a range of 30 g to 100 g.

20. The key switch device according to claim 19, wherein the maximum point is in the range of 50 g to 70 g.

21. The key switch device according to claim 13, wherein the difference in loads between the maximum point and the point from which the depressing load starts to increase is 10 g or larger.

22. A keyboard provided with at least one key switch device according to claim 13.

23. An electronic apparatus including:

a keyboard for inputting various data such as characters, symbols, and others, the keyboard being provided with a key switch device including:

a key top provided at its underside with a first engagement portion and a second engagement portion;

a third engagement portion corresponding to the first engagement portion, and a fourth engagement portion corresponding to the second engagement portion, both of which are arranged below the key top;

a first link member provided with an upper end portion which is rotatably engaged in the first engagement portion and a lower end portion which is slidably engaged in the third engagement portion;

a second link member provided with an upper end portion which is rotatably engaged in the second engagement portion and a lower end portion which is slidably engaged in the fourth engagement portion;

an urging member for urging the first link member and the second link member in a direction away from each other; and a switching member for conducting a switching operation in association with vertical movement of the key top, the key switch device being designed to be symmetric with respect to a perpendicular line passing through a midpoint between the first engagement portion and the second engagement portion, wherein the upper end portion of the first link member is allowed to rotate about a predetermined rotation point in the first engagement portion, and the lower end portion of the first link member is allowed to slide outwardly from a predetermined slide starting point in the third engagement portion, an urging force of the urging member is exerted on the first link member at a predetermined acting point in the first link member, a depressing load applied to the key top when the key top is depressed is defined by a function expressed by:

a distance between the rotation point and the slide starting point; a distance between the rotation point and the acting point; an angle between a line segment extending from the rotation point to the slide starting point, and the direction along which the lower end portion of the first link member in the third engagement portion is allowed to slide; and various characteristic values of the urging member; and a curve of the depressing load defined by the function takes a shape of an upward projecting curve having a maximum point, and a key clicking function is performed based on a difference in loads between the maximum point and a point from which the depressing load starts to increase after the switching operation is conducted by the switching member;

display means for displaying the characters, symbols, and others; and control means for controlling the display means to display the characters, symbols, and others based on input data from the keyboard.

24. A key switch device including:

a key top provided at its underside with a first engagement portion and a second engagement portion;

a third engagement portion corresponding to the first engagement portion, and a fourth engagement portion corresponding to the second engagement portion, both of which are arranged below the key top;

a guide member including:

a first link member provided with an upper end portion which is rotatably engaged in the second engagement portion and a lower end portion which is slidably engaged in the third engagement portion, and a second link member provided with an upper end portion which is rotatably engaged in the first engagement portion and a lower end portion which is slidably engaged in the fourth engagement portion, the first and second link members being pivotally supported to be rotatable with respect to each other;

an urging member for urging the first link member and the second link member in a direction to allow them to pivotally rotate about a shaft supporting point; and a switching member for conducting a switching operation in association with vertical movement of the key top, the key switch device being designed to be symmetric with respect to a perpendicular line passing through a midpoint between the first engagement portion and the second engagement portion, wherein the upper end portion of the first link member is allowed to rotate about a predetermined rotation point in the second engagement portion, and the lower end portion of the first link member is allowed to slide outwardly from a predetermined slide starting point in the third engagement portion, an urging force of the urging member is exerted on the first link member at a predetermined acting point in the first link member, a depressing load applied to the key top when the key top is depressed is defined by a function expressed by:

a distance between the rotation point and the slide starting point; a distance between the rotation point and the acting point; a distance between the rotation point and the shaft supporting point; an angle between a line segment extending from the rotation point to the slide starting point, and the direction along which the lower end portion of the first link member in the third engagement portion is allowed to slide; and various characteristic values of the urging member; and a curve of the depressing load defined by the function takes a shape of an upward projecting curve having a maximum point, and a key clicking function is performed based on a difference in loads between the maximum point and a point from which the depressing load starts to increase after the switching operation is conducted by the switching member.

25. The key switch device according to claim 24, wherein, when the key top is depressed, the key clicking function is performed during a time when the depressing load is decreased from the maximum point to the point from which the depressing load starts to increase in accordance with the depressing load curve.

26. The key switch device according to claim 24 further including:

a bearing hole formed in the second engagement portion; and a first support shaft which is formed at the upper end portion of the first link member and is rotatably engaged in the bearing hole, wherein the rotation point is determined by a center of rotation of the first support shaft engaged in the bearing hole.

27. The key switch device according to claim 24 further including:

a slide groove which is formed in the third engagement portion and has a wall portion; and a second support shaft which is formed at the lower end portion of the first link member and is slidably engaged in the slide groove, wherein the slide starting point is determined by a point at which the second support shaft engaged in the slide groove is brought into contact with the wall portion.

28. The key switch device according to claim 24, wherein the urging member is constructed of a spring having a first end portion and a second end portion, and the key switch device further including:

a first spring engagement portion provided in the first link member for engaging the first end portion of the spring; and a second spring engagement portion provided in the second link member for engaging the second end portion of the spring.

29. The key switch device according to claim 28, wherein the acting point is defined by a point at which the urging force of the spring is exerted on the first spring engagement portion.

30. The key switch device according to claim 28, wherein the spring includes a coil spring, and the characteristic values are determined by a plurality of factors which specify the urging load of the coil spring.

31. The key switch device according to claim 24, wherein the maximum point is in a range of 30 g to 100 g.

32. The key switch device according to claim 31, wherein the maximum point is in the range of 50 g to 70 g.

33. The key switch device according to claim 24, wherein the difference in loads between the maximum point and the point from which the depressing load starts to increase is 10 g or larger.

34. A keyboard provided with at least one key switch device according to claim 24.

35. An electronic apparatus including:

a keyboard for inputting various data such as characters, symbols, and others, the keyboard being provided with a key switch device including:

a key top provided at its underside with a first engagement portion and a second engagement portion;

a third engagement portion corresponding to the first engagement portion, and a fourth engagement portion corresponding to the second engagement portion, both of which are arranged below the key top;

a guide member including:

a first link member provided with an upper end portion which is rotatably engaged in the second engagement portion and a lower end portion which is slidably engaged in the third engagement portion, and a second link member provided with an upper end portion which is rotatably engaged in the first engagement portion and a lower end portion which is slidably engaged in the fourth engagement portion, the first and second link members being pivotally supported to be rotatable with respect to each other;

an urging member for urging the first link member and the second link member in a direction to allow them to pivotally rotate about a shaft supporting point; and a switching member for conducting a switching operation in association with vertical movement of the key top, the key switch device being designed to be symmetric with respect to a perpendicular line passing through a midpoint between the first engagement portion and the second engagement portion, wherein the upper end portion of the first link member is allowed to rotate about a predetermined rotation point in the second engagement portion, and the lower end portion of the first link member is allowed to slide outwardly from a predetermined slide starting point in the third engagement portion, an urging force of the urging member is exerted on the first link member at a predetermined acting point in the first link member, a depressing load applied to the key top when the key top is depressed is defined by a function expressed by:

a distance between the rotation point and the slide starting point; a distance between the rotation point and the acting point; a distance between the rotation point and the shaft supporting point; an angle between a line segment extending from the rotation point to the slide starting point, and the direction along which the lower end portion of the first link member in the third engagement portion is allowed to slide; and various characteristic values of the urging member; and a curve of the depressing load defined by the function takes a shape of an upward projecting curve having a maximum point, and a key clicking function is performed based on a difference in loads between the maximum point and a point from which the depressing load starts to increase after the switching operation is conducted by the switching member;

display means for displaying the characters, symbols, and others; and control means for controlling the display means to display the characters, symbols, and others based on input data from the keyboard.

36. The key switch device according to claim 1, wherein the urging member is constructed of a first plate spring provided near the third engagement member and a second plate spring provided near the fourth engagement member, and the key switch device further including:

a first contact portion provided in the first link member, with which the first spring is brought into contact; and a second contact portion provided in the second link member, with which the second spring is brought into contact.

37. The key switch device according to claim 36, wherein the acting point is defined by a point at which an urging force of the first spring is exerted on the first contact portion.

* * * * *